US007320417B2

(12) United States Patent
Eberhardt et al.

(10) Patent No.: US 7,320,417 B2
(45) Date of Patent: Jan. 22, 2008

(54) CONTAINER

(75) Inventors: Heiko Eberhardt, Oberursel (DE); Franz Steigerwald, Griesheim (DE)

(73) Assignee: Wella AG, Darmstadt (DE)

( * ) Notice: Subject to any disclaimer, the term of this patent is extended or adjusted under 35 U.S.C. 154(b) by 0 days.

(21) Appl. No.: 10/240,968

(22) PCT Filed: May 29, 2001

(86) PCT No.: PCT/EP01/06332

§ 371 (c)(1),
(2), (4) Date: Oct. 7, 2002

(87) PCT Pub. No.: WO01/96210

PCT Pub. Date: Dec. 20, 2001

(65) Prior Publication Data

US 2003/0089734 A1 May 15, 2003

(30) Foreign Application Priority Data

Jun. 10, 2000 (DE) ..... 100 28 747

(51) Int. Cl.
*B65D 83/40* (2006.01)

(52) U.S. Cl. ..... 222/635; 222/402.1

(58) Field of Classification Search ..... 222/39, 222/635, 321.7, 402.1
See application file for complete search history.

(56) References Cited

U.S. PATENT DOCUMENTS

| | | | | |
|---|---|---|---|---|
| 3,246,850 A | | 4/1966 | Bourke | 239/394 |
| 3,312,723 A | | 4/1967 | Anderson et al. | |
| 3,963,145 A | | 6/1976 | Fegley et al. | 222/5 |
| 4,227,482 A | | 10/1980 | Scheindel | 116/142 FP |
| 4,291,688 A | | 9/1981 | Kistler | |
| 4,423,823 A | | 1/1984 | Franek et al. | |
| 4,426,026 A | | 1/1984 | Knickerbocker | |
| 4,572,406 A | * | 2/1986 | Pratt et al. | 222/39 |
| 4,759,309 A | * | 7/1988 | Zediker | 116/67 R |
| 4,846,810 A | | 7/1989 | Gerber | 604/247 |
| 4,852,807 A | | 8/1989 | Stoody | 239/337 |

(Continued)

FOREIGN PATENT DOCUMENTS

DE 1 037 377 8/1958

(Continued)

OTHER PUBLICATIONS

Database WPI Week 9732 Derwent Publications Ltd., London, Great Britain, An 1997-34520 XP 002179269 & JP 09 141147 A, Jun. 3, 1997.

(Continued)

*Primary Examiner*—Joseph A. Kaufman
(74) *Attorney, Agent, or Firm*—Michael J. Striker

(57) ABSTRACT

In a container (1) with a reservoir (2), a product dispensing opening (3), and a device (4) for discharging the product contained in the reservoir (2) out through the product dispensing opening (3), a sound generator (5) or a noise damper (13) is provided on the container (1) and the sound generator (5) or the noise damper (13) is functionally connected to the discharge device (4) in order to generate a desired sound for a product discharge when dispensing the product. The desired sound is one that a consumer experiences as a positive sound.

3 Claims, 41 Drawing Sheets

U.S. PATENT DOCUMENTS

| | | | | |
|---|---|---|---|---|
| 5,186,368 | A | 2/1993 | Garcia | 222/490 |
| 5,219,102 | A | 6/1993 | Wright | |
| 5,456,626 | A * | 10/1995 | Ming-Kang | 446/397 |
| 5,487,502 | A | 1/1996 | Liao | |
| 5,758,638 | A | 6/1998 | Kreamer | 128/200.23 |
| 5,794,822 | A | 8/1998 | Foster | |
| 5,878,913 | A | 3/1999 | Fisher et al. | 222/39 |
| 5,881,929 | A * | 3/1999 | Coerver, Jr. | 222/402.1 |
| 5,967,382 | A | 10/1999 | Lasserre et al. | |
| 6,161,599 | A * | 12/2000 | Smith | 141/20 |
| 6,341,735 | B1 | 1/2002 | Baudin | |
| 6,588,629 | B1 * | 7/2003 | De Pous | 222/182 |
| 6,607,106 | B2 * | 8/2003 | Henry et al. | 222/402.1 |

FOREIGN PATENT DOCUMENTS

| | | |
|---|---|---|
| DE | 10 40 464 B | 10/1958 |
| DE | 28 03 993 | 8/1978 |
| EP | 0 875 469 A | 11/1980 |
| EP | 0 112 035 A | 6/1984 |
| EP | 0 437 706 | 7/1991 |
| EP | 0 593 317 | 4/1994 |
| EP | 0 669 268 | 8/1995 |
| EP | 0 863 089 | 9/1998 |
| EP | 0 863 089 A | 9/1998 |
| EP | 0 875 469 | 11/1998 |
| EP | 1 052 191 | 11/2000 |
| EP | 1 072 316 A | 1/2001 |
| FR | 1 376 028 A | 10/1964 |
| FR | 1 414 014 A | 10/1965 |
| FR | 1539302 | 9/1968 |
| FR | 1 603 001 A | 3/1971 |
| FR | 1 603 001 | 4/1971 |
| GB | 1 036 955 | 7/1966 |
| GB | 1 103 074 | 2/1968 |
| GB | 1 397 930 | 6/1975 |
| GB | 1 460 000 | 12/1976 |
| GB | 1 493 031 A | 11/1977 |
| GB | 2 021 698 A | 12/1979 |
| GB | 1 587 087 | 3/1981 |
| GB | 2 297 126 | 7/1996 |
| GB | 2 340 891 | 3/2000 |
| JP | 11-128776 | 5/1999 |
| JP | 11-157586 | 6/1999 |
| JP | 2001-130660 | 5/2001 |

OTHER PUBLICATIONS

Patent Abstracts of Japan vol. 1998, No. 06, Apr. 30, 1998 & JP 10 029658 A, Feb. 3, 1998.

Patent Abstracts of Japan vol. 1999, No. 10, Aug. 31, 1999 & JP 11128776 A May 18, 1999.

* cited by examiner

CONTAINER

BACKGROUND OF THE INVENTION

1. Field of the Invention

The invention relates to a container with a reservoir, a product dispensing opening, and a device for discharging the product contained in the reservoir out through the product dispensing opening.

2. Related Art

Containers of this kind are sufficiently well-known. Squeeze containers, aerosol containers, and containers with spray pumps have a discharge device. The discharge device has a deformable container wall in squeeze containers, a valve in aerosol containers, and a spray pump in spray pump containers. The product travels either directly from the reservoir to an open product dispensing opening or through a conduit and a stem to a product dispensing opening embodied as a nozzle. In the vicinity of the product dispensing opening of an aerosol container or a spray pump container, a foam generator can also be provided in order to deliver the product in the form of a foam. Whereas with squeeze containers, hardly any perceptible noise is produced when the product, e.g. hair shampoo, is being dispensed, aerosol containers and spray pump containers generate a typical noise. This is particularly true for an aerosol container with a foam generator.

The known containers have the disadvantage that the noise generated by them while the product is being dispensed depends solely on the technical embodiment of the container, e.g. its product dispensing opening, its discharge device, its dimensions (resonances), and its materials. This noise can be subjectively experienced as good or as less than good. If the noise does not sound good to the user, he may draw incorrect and negative conclusions about the technical design of the container and its contents.

SUMMARY OF THE INVENTION

The object of the invention is to prevent, suppress, or mask the noise of the container when dispensing the product, which is subjectively found to be unpleasant.

According to the invention the container has a reservoir for a product;

a discharge device with a product dispensing opening, which comprises means for discharging the product from the reservoir through the product dispensing opening; and means (5, 13) for preventing, suppressing or masking noise produced by a product discharge when dispensing the product by means of the discharge device.

The invention has the advantage that during a product discharge, a sound is produced that is appealing to the user. This sound can initially be empirically determined through customer surveys and then technically implemented. Either the container is provided with a sound generator, which masks the natural discharge noise with a special sound, or else the natural dispensing noise, i.e. the noise produced when there is no sound generator or noise damper, is entirely or selectively dampened so that its unpleasant frequencies are reduced with regard to their sound intensity or so that these frequencies are eliminated.

If the container is an aerosol container or a spray pump container in which a spray conduit leading to a nozzle is provided on the container and the spray conduit has a mathematically continuous course with regard to its inner wall, particularly a continuously curved section of the spray conduit, i.e. a section without any corners, then there is only a low probability of eddies being produced in the emerging product. Since eddies generate undesirable noises, this results in a more pleasant sound when the product is being dispensed.

At least one sounding rib in the spray conduit, which points in a particular direction radially away from the spray conduit, advantageously generates tones in accordance with its dimensions. It is also possible to provide a number of sounding ribs, whose tones heterodyne with one another. Due to resonance and stationary sound waves, particular pleasant sounds can thus be generated in a cap that encompasses the spray conduit and the sounding ribs.

A spray conduit can be encompassed by a sound absorbing material in order to thus reduce the intrinsic sound level but also to damp certain frequency ranges to a particularly strong degree. In the vicinity of the valve stem of a spray pump container or an aerosol container, a measure of this kind is particularly useful because a relatively large amount of turbulence occurs in them and a corresponding noise generation consequently occurs.

If the spray conduit is encompassed by several layers of sound absorbing material, in particular selectively sound absorbing material, and includes at least one layer of a foamed or unfoamed material, in particular a thermoplastic elastomer (TPE) or a thermoplastic polyurethane, then an existing noise produced by the product discharge can be effectively damped or can be damped selectively. Very favorable results can be achieved with TPE plastics, such as Evoprene®, Santoprene®, Vyram®, and Hyrtel®. These plastics can be used to produce relatively pleasant sounds for hair spray and hair foam. Hydrocerol® is suitable as a foaming agent for the TPE plastic.

When there are several layers of sound absorbing material, several layer combinations are suitable for laying an inner layer against another layer. The inner layer adjoins the product dispensing conduit, e.g. the spray conduit or the foam circuit. The additional layer rests directly against the outside of the inner layer. Favorable acoustic results are achieved with the following inner layer/other layer pairings: 0.5 to 1 mm unfoamed material/1 to 5 mm foam; 1 mm unfoamed/1 to 3 unfoamed; 0.5 to 5 mm foam/1 to 3 mm unfoamed; 1 mm unfoamed PP (polypropylene)/5 mm foam; 1 mm unfoamed PP/1 mm unfoamed, as well as with analogous combinations of analogous materials. If a number of frequency ranges are to be influenced, then a number of layers with corresponding properties can be combined with one another.

Favorable results are also achieved if the outer layer is sealed in relation to the outside by means of a film. This then corresponds to a closed-cell foam. The function of the film can also be performed by a film-like, smooth, and unfoamed boundary layer produced on a mold wall. In TPU foam parts, boundary layers are produced against the mold wall automatically during forming and are between 0.2 and 1.0 mm thick.

If the noise damper is a spiral disposed around a spray conduit, then this damper produces a selective, pleasant change in the spraying sound. Suitable materials for the spiral are those, which have a relatively high mechanical inherent loss factor and a relatively low flexural strength, e.g. corrugated paper and tissue paper. These materials are also very inexpensive.

If a button on a cap that can be slid onto the container is provided as a discharge device, the button acts mechanically on the wall of the spray conduit, and the wall acts mechanically on a stem of the container, then when the button is depressed to dispense the product, the wall and the stem are also depressed so that the container valve disposed underneath the stem opens and the product flows out. The valve can be an aerosol valve. However, it can also be part of a spray pump so that depressing the button produces a spray burst.

If this material of the spray conduit is harder or softer than the material of a sounding rib, then a sound can be changed solely by means of this difference in hardness.

If a stiffening rib is provided on the spray conduit, then the oscillation frequency of the spray conduit is decreased as a result.

The harder and more rigid the spray conduit is designed to be, the more difficult it can be to set it into oscillation by means of mechanical excitation. It is immaterial whether the excitation is permanent or singular. The stiffening by means of additional ribs also produces a greater component surface area. If the surface area of a component is greater, then the oscillation energy is distributed over this area. The overall oscillatory area is reduced by stiffening and the frequency of the oscillation is increased. Consequently, the sound pressure level of a component with this increased surface area is less than one without the stiffening rib. Furthermore, a stiffening rib also represents a reflector against which oscillations are reflected.

Relatively hard stiffening ribs are used to generate sound in the frequency range from approx. 4 to 15 KHZ. By contrast, relatively soft stiffening ribs are used for sound emissions in the frequency range from 1 to approx. 4 KHZ. Consequently, a sounding rib, which is comprised of a material of a different hardness compared to the hardness of the spray conduit wall is used to emit amplified sound in a different frequency range in order to thus change the sound when the product is being dispensed. A normally hard wall of the spray conduit in connection with relatively soft sounding ribs or stiffening ribs provided on the spray conduit therefore produces a sound in which the deeper tones are amplified in comparison to a conventional spray conduit noise. A sound of this kind seems "richer".

If the acoustic rib is connected to the inner surface of a cap that can be slid onto the container, in particular is injection molded onto it, then a different sound can be produced than if the acoustic rib does not have this connection. The sonic frequencies emitted by the spray conduit or any component of the container cause resonance oscillations of the acoustic rib and because of the connection, the acoustic rib deflects the cap at the connection, causing it to execute an analogous oscillation. If the acoustic rib is embodied in a closed meandering form and is only connected to the cap, then the acoustic rib defines a resonance chamber, which particularly absorbs sound waves of the wall of the flow conduit. Certain frequencies are damped in accordance with the dimensions of the sinuous acoustic rib. This produces a particular sound.

To the human ear, frequencies around 4 KHZ are relatively unpleasant. These frequencies can be significantly reduced in a spray jet if, according to a preferred embodiment, the container is an aerosol container or a spray pump container, a spray conduit leading to a nozzle is provided on the container, and either the spray conduit has a conduit insert extending inside it or the spray conduit is comprised of a number of conduit arms that in particular extend parallel to one another. The discharged product consequently flows through relatively narrow conduit parts or conduit arms in order to travel through the flow conduit to the nozzle. As a result, the flow is laminar. The flow noise is selectively damped, namely in the vicinity of 4 KHZ. The modified flow conduit, however, also functions as a sound generator, namely for frequencies that are higher than 4 KHZ. These are amplified. Therefore a higher tone is produced.

Sufficiently deep frequencies are also positively accepted by consumers, e.g. in an aerosol container with a foaming device. A positive product discharge sound is achieved if, according to another preferred embodiment, the container is an aerosol container or a spray pump container, a spray conduit leading to a nozzle is provided on the container, and the spray conduit has an extension that functions as a sound generator for one frequency range and as a noise damper for a higher frequency range.

If the container is an aerosol container or a spray pump container, a spray conduit leading to a nozzle is provided in the container, and the spray conduit is encompassed by a honeycomb formation that has a number of honeycombs and, in the direction oriented away from the spray conduit, the honeycombs are in particular aligned radial to the spray conduit, then a selective alteration of the spray conduit sound occurs in the spray conduit. The honeycomb structure can, for example, be rectangular, hexagonal, or round. The honeycombs are open at their ends and are contiguous with one another. The acoustic oscillations that emanate from the spray conduit heterodyne with one another in the honeycombs and in the honeycomb walls. Consequently, the energy and loudness of the sound waves are reduced. The honeycombs can be comprised of cellulose material. Nomex® honeycombs are particularly suitable for this purpose. Their relatively rigid material increases the frequency of the spray conduit sound.

If a sound chip is provided as a sound generator, then it can generate a sound that is favorable for a product discharge. This sound can also be one whose frequency spectrum, when added to the frequency spectrum of the technically induced discharge noise, produces the frequency spectrum and therefore the tone of a desired sound.

If the sound chip is programmable, then one or more programmed sounds can be input to the sound chip, which are then available for acoustic output. Several programs that can be selected can be called up through corresponding use of the discharge device. For example, two actuating buttons, which can start two different programs, can be provided as the device. If the selection depends on the position of the device, then in one position, the one program can be called up and in the other position, the other program can be called up. If a low or higher spray rate is produced depending on the actuating distance of a button or actuating knob, then each spray rate can be associated with a correspondingly pleasant, programmed spray sound of the sound chip. The same is true for two separate buttons or actuating knobs on a container for producing a fine or powerful spray. The sound chip can also be used to amplify intrinsically pleasant sounds of the container by causing them to heterodyne with an identical frequency spectrum.

If the sound chip contains at least one speech program, in particular an advice program, then while the product is being dispensed, advice can be offered to the customer with regard to the product being used. Advice of this kind is particularly appropriate when the use of the product is complicated. In this connection, each time the discharge device is actuated, a piece of advisory information is output so that the use is supported by a number of individual pieces of information.

If the container is an aerosol container or a spray pump container, in a preferred embodiment a spray conduit leading to a nozzle is provided in the container, and the spray conduit has a number of individual conduits that function as a sound generator for one frequency range and as a noise damper for another frequency range, then this multiplicity of conduits produces a relatively favorable dispensing of the product. Certain turbulences that occur in a single spray conduit and frequencies that correspond to them are attenuated, which achieves a selective noise damping for this frequency range. Sounds that are typical for a multiplicity of relatively narrow individual conduits are amplified. Consequently, this produces an altered, relatively pleasant sound when the product disposed in the container is dispensed.

If the container is an aerosol container or a spray pump container, in a preferred embodiment a spray conduit leading to a nozzle is provided in the container, and the spray conduit has a labium that functions as a sound generator for one frequency range and as a noise damper for another frequency range, then an altered, relatively pleasant sound can be generated when the product disposed in the container is dispensed.

A selective noise damping or a selective alteration of the spray noise can be achieved through adaptation of heterodyne frequencies. Individual regions of the frequency spectrum can be singled out and obliterated or influenced by one or more sound sources.

This can be achieved by means of a vibrating inner wall (labium) directly in the spray conduit. The spray noise can be influenced by the size and material of the oscillating wall. The required mechanical energy is supplied in the same way as with a "labium" (specialized term denoting an oscillation exciter in wind instruments), which is set into oscillation by an aerosol flowing past it or in the same way as with an "overblow conduit", which has a separation edge at its end. Stiffening is provided by the inner wall itself. Narrower conduits can also achieve an increase in the frequency.

As in an organ pipe or a recorder, the aerosol flow strikes the very sharp edge of the labium. Intense eddies are thereby produced, which excite the labium to oscillate. Consequently, a certain note is produced. This note can be changed by varying the length of the double tube that encompasses the labium (short length produces a higher note, long length, a lower note).

Since the double tube is also better at absorbing the oscillations that occur, the following phenomena occur: noise reduction, frequency alteration, and reduction of the flow resistance and therefore of the turbulence that occurs, which leads to a further noise reduction.

If the container is an aerosol container and a valve plate of the aerosol container is provided with valve plate insulation as the noise damper, then a pleasant discharge sound for the aerosol container can be achieved.

Valve plates are primarily made of aluminum. A layer of a sound absorbing material, in particular polyurethane lacquer or polyurethane foam applied to the valve plate is suitable for insulating the valve plate.

The following foamed TPE plastics are particularly suited for insulating the valve plate: Evoprene®, Santoprene®, Vyram®, and Hyrtel®. The foaming agent Hydrocerol® is suitable for these plastics.

Suitable composites and composite materials are characterized in that they appropriately combine the sometimes conflicting properties of individual components, even for extreme intended uses. A composite, which in addition to minimizing the oscillation transmission, also has high oscillation-absorbing properties in a broad frequency range, changes the oscillation emission to an extreme degree. This large surface area composite, which is highly effective acoustically, should have a lower mass than conventional materials while simultaneously having good mechanical properties.

Chief among these properties is the greatest possible damping and insulation of mechanical oscillations of the aerosol spray system. Two layers that behave in physically different ways are combined into one composite.

A high degree of oscillation damping (high oscillation absorption) is achieved with porous, i.e. specially foamed and/or elastomer materials, which must have an opened-pored structure oriented toward the oscillation source (pore size approx. 0.2 mm). This function is performed, for example, by thermoplastic foam, which is produced through injection molding and simultaneous foaming of the above-mentioned materials, and has a high degree of porosity (up to 95%).

As a variation, it is also conceivable for the outer layer to be additionally sealed toward the outside by a film. This then corresponds to a closed-celled foam.

In order for the absorber to be able to dissipate a large amount of oscillation energy, the oscillation must first penetrate into the absorber in a reflection-free manner. This is achieved with an open-pored thermoplastic elastomer foam or an easily excitable material. As it transitions into the absorber, the oscillation resistance should not change very much at the boundary surface in order to minimize oscillation reflection. By means of a gradually increasing inner friction resistance of the absorber, due to its numerous narrow conduits, energy is withdrawn from the back-and-forth flow of air in the form of heat and is transmitted to the skeletal material of the absorber. As a result, the amplitude of the oscillation pressure decreases. The oscillation damped by the absorber strikes the insulating layer, where on the one hand, it is reflected back into the absorber and on the other hand, it is converted into a structure-borne oscillation. In order to minimize the radiation of oscillation into the space to be protected, the flexural wave in the insulation material is damped to the greatest extent possible. A high mechanical inherent loss factor and a low flexural strength facilitate the damping of flexural waves. These mechanical properties can be achieved with thermoplastic elastomers. The more complete the oscillation absorption of the incident and reflected oscillation is, the less oscillation energy travels into the insulation layer. The damping properties of the elastomer insulation layer further minimize the oscillation radiation into the space to be protected. The lower the density of the damping material (foam or lacquer), the higher the frequency that is influenced.

If the container is an aerosol container with an insert on the outlet end of a spray conduit, where the insert includes a nozzle, and as a noise damper, the insert is either comprised of an elastic plastic or is attached to the spray conduit by means of an elastic adhesive, then a pleasant sound is thus produced during a spraying process. The elastic material in the vicinity of the nozzle absorbs unpleasant frequencies.

The insert is excited causing it to oscillate by the expansion of the aerosol that takes place at the insert. An elastic insert hardly transmits any of this oscillation to the flow conduit.

This function can also be performed by a commercially available insert if this insert is glued into the flow conduit with an elastic adhesive. However, the layer thickness of the adhesive material must be great enough so that hardly any oscillations are transmitted. In general, a wall thickness of approx. 4 mm for the adhesive can serve as a starting point.

Pulsating pressure fluctuations occur in the flow conduit due to the partial expansion of the aerosol in the flow conduit. An elastic insert or an elastic adhesive does not transmit these pressure fluctuations.

If a sound generator is provided in the form of a resonance surface inside a cap of the container, then when excited, this resonance surface produces a sound that corresponds to its dimensions. The resonance surface can be a sounding board that divides the cap into two spaces. The resonance surface can contain one or more openings. Both the position and the material selection influence the sound. It is also possible to provide more than two spaces or to provide only dividing walls in order to separate spatial regions. Between one resonance surface and the inner wall of the cap, it is also possible to provide a silicone seal in order to provide resonance noise from being transmitted to the cap. However, if cap resonance is sought in order to produce a desired sound, then instead of a silicone seal, it is necessary to provide the best possible rigid contact between the resonance surface and the inner wall of the cap, e.g. by means of a plastic welding.

If the container is an aerosol container, which has a valve, a valve plate, a valve housing, and a stem and if an acoustic barrier layer is provided as a noise damper between the valve and the valve plate, then this achieves an acoustic decoupling of the valve as a noise source from the valve plate as a resonance body. This decoupling prevents the valve plate and the components connected to the valve plate, e.g. the container casing, from resonating with the valve. A measure of this kind is very effective since it acts directly on the noise source of the valve. The valve itself can remain unchanged. A barrier layer can be suitably comprised of a very elastic plastic, such as Evoprene®, whose thickness is preferably between 0.5 and 8 mm.

If a part of the barrier layer is provided as a seal between the valve housing and the stem, then this part fulfills the function, which is otherwise performed by a separate seal, of producing a seal between the valve housing and the stem. The use of this part is less expensive than the use of a separate seal and also acoustically decouples the valve housing from the actual valve.

If the container is an aerosol container or a spray pump container, a button on a cap that can be slid onto the container is provided as a discharge device, and an acoustic seal is provided between the button and the cap, then this produces a noise damping by means of an acoustic sealing of the cap. The seal can be produced by two sealing lips, where the one sealing lip is provided on the cap and the other sealing lip is provided on the button, or the seal is produced by means of an elastic connection between the button and the edge region of the cap adjoining the edge region of the button.

In the prior art, it is customary in a cap to actuate the valve stem by means of a button in order to dispense the product. The known buttons, however, also have a more or less large gap in relation to the cap encompassing them. If this gap is then closed, this causes the oscillating air mass in the cap and the oscillation of the cap to change. This thereby produces an altered spray noise. However, the cap must still remain mobile.

There are a number of possibilities for achieving this, for example:

Possibility 1:

The actuator button is connected to the spray cap by means of a very flexible plastic through the use of the two-component injection molding method. The spray cap is thus comprised of one piece and has no gap between the button and the spray cap. An extremely flexible plastic takes the place of this gap.

Possibility 2:

Tapering sealing lips that curve downward are affixed to the transition surfaces between the cap and the button, e.g. through the use of the two-component injection molding method. When they are not actuated, the two sealing lips are situated next to each other and seal completely. If the button is depressed, then the sealing lip of the button slides downward and the valve opens. At the same time, during the downward travel, more space is produced for the tip of the button sealing lip, which strives to move outward. As a result, the gap between the cap and the button is always closed and the inner space of the cap is acoustically sealed.

In a preferred embodiment a perforated disk is inserted into a valve stem and provides a sound generator for one frequency range and a noise damper for another frequency range. This perforated disk has a number of conduits and is preferably snapped into the stem by means of a detent element. This stabilizes the flow and produces a local laminar flow. Both of these results produce sound amplification in the one frequency range and attenuation in the other frequency range. On the whole an acoustic change occurs, which is found to be pleasant.

If the perforated disk has the conduits on only one side and a cover, which is preferably semicircular and partially covers the perforated disk, and if the cover can rotate in relation to the perforated disk by means of a tubular piece, which is inserted into the stem, which preferably has a cover rotation stop, and is connected to a product dispensing opening of the container, then by rotating the part that contains the product dispensing opening, the consumer himself can determine whether he would like to have the product discharge behavior and the attendant sound that are produced with a certain rotation situation. Thus the user can choose, for example, between using the conduits and using an opening contained in the other half of the perforated disk. The rotation stop serves as an orienting mechanism for a particular rotation position of the cover in relation to the perforated disk.

If a sounding lip inserted into a flow conduit of an aerosol container is provided as a sound generator and is connected to the lower part of a valve housing, then a particular tone can be generated by dispensing the product. The sounding lip is set into an oscillation by the outflowing product. Because it is connected to the valve housing, the sounding lip can easily be produced together with the valve housing. In the proposed disposition of the sounding lip on the bottom part of the valve housing, the product is fluid so that adhesion is not possible and therefore the operation of the sounding lip is not impaired there. A spray head of the aerosol container, which is depressed to open a valve, serves as a discharge device. The product flows around the sounding lip and out through the valve, producing a pleasant sound against the sounding lip while the product is being dispensed.

The sounding lip can be aligned in the direction of the flow conduit. This provides a relatively large flow cross section for the product being discharged so that almost no influence is exerted on the discharge. By contrast, if two sounding lips are provided, which are aligned perpendicular to the direction of the flow conduit and are aligned in relation to each other in such a way that a gap is formed between them, then a relatively intense sound can be generated. In this connection, the sounding lips can also overlap, which can produce an even greater sound intensity.

When dispensing the product from a spray pump container or an aerosol container, a very special whistling tone can be produced if, analogous to the foregoing embodiment, an opening of a separating element is provided upstream of the sounding lip and one edge of the sounding lip forms a labial whistle with the opening. This whistle is embodied so that the edge is disposed relatively close to the opening. The frequency of the tone produced can be changed by altering the gap width of the opening or the distance of the edge from the opening. The tone is adjusted so as to make it pleasant for the user when dispensing the product.

If a number of grooves extending in the flow direction and adjoining the flow conduit are provided as a noise damper and as a sound generator, which grooves are preferably comprised of recesses in an attachment of a valve housing of a valve, then the turbulence in this region of the flow conduit can be reduced. Eliminating this turbulence damps the frequencies that are produced by this turbulence of the product being discharged. At the same time, the grooves generate a different tone. This frequency change is found to be relatively pleasant. The corresponding sound is influenced by the length, width, and depth of the grooves, as well as by the number of grooves.

If a funnel-shaped speaker is provided both as a sound generator and as a noise damper, which speaker adjoins the product dispensing opening of the container embodied in the form of a nozzle and has a diameter that increases as it extends away from the nozzle, then in the same way as in a megaphone, the sound while dispensing the product is altered and simultaneously amplified. The spray cone coming out of the nozzle has a sufficient amount of clearance in the funnel.

If a sounding rib is provided as a sound generator, which is connected to a top that is slid onto a stem of a container filled with aerosol and rests against a rim of the container, then a sound can be produced, which depends on the width and the length of the sounding rib. The vibrations of the top are transmitted to the sounding rib, which transmits these vibrations to the edge at its end. The sounding rib produces a pleasant sound. If the container is also provided with a tear-off ring, which engages underneath the rim and is connected to the sounding rib by means of a weakened line, then the top can be attached to the container very securely at first. Before it is used, the tear-off ring is removed in order to thus release the sounding rib.

If a flow loop embodied as a conduit in a valve body of a valve of the container is provided as a sound generator, then an additional sound is generated directly in the valve. This sound is relatively intense since the valve is one of the loudest noise generators, particularly in an aerosol container. A relatively small portion of the product being dispensed flows through the conduit.

If the container is an aerosol container, which has an ascending tube leading to a valve, in which the ascending tube has an extension that functions as a sound generator and the extension adjoins the bottom wall or side wall of the container, then on the one hand, the flow sound of the aerosol in the ascending tube is amplified in the extension. On the other hand, this amplified sound is transmitted to a container wall so that the container wall serves as a resonator. The sound generated consequently depends on the dimensions of the walls. A relatively pleasant sound is produced, while the product is being dispensed, particularly in aluminum containers.

If the container is an aerosol container whose side wall or bottom wall is provided with a sound generator in the form of an alternating wall thickness that is sometimes thicker and sometimes thinner, then this wall produces a different acoustic pattern when the product is being dispensed. An aerosol discharge sound that is found to be pleasant can be produced, depending on the intensity difference and the dimensions of the greater wall thickness.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
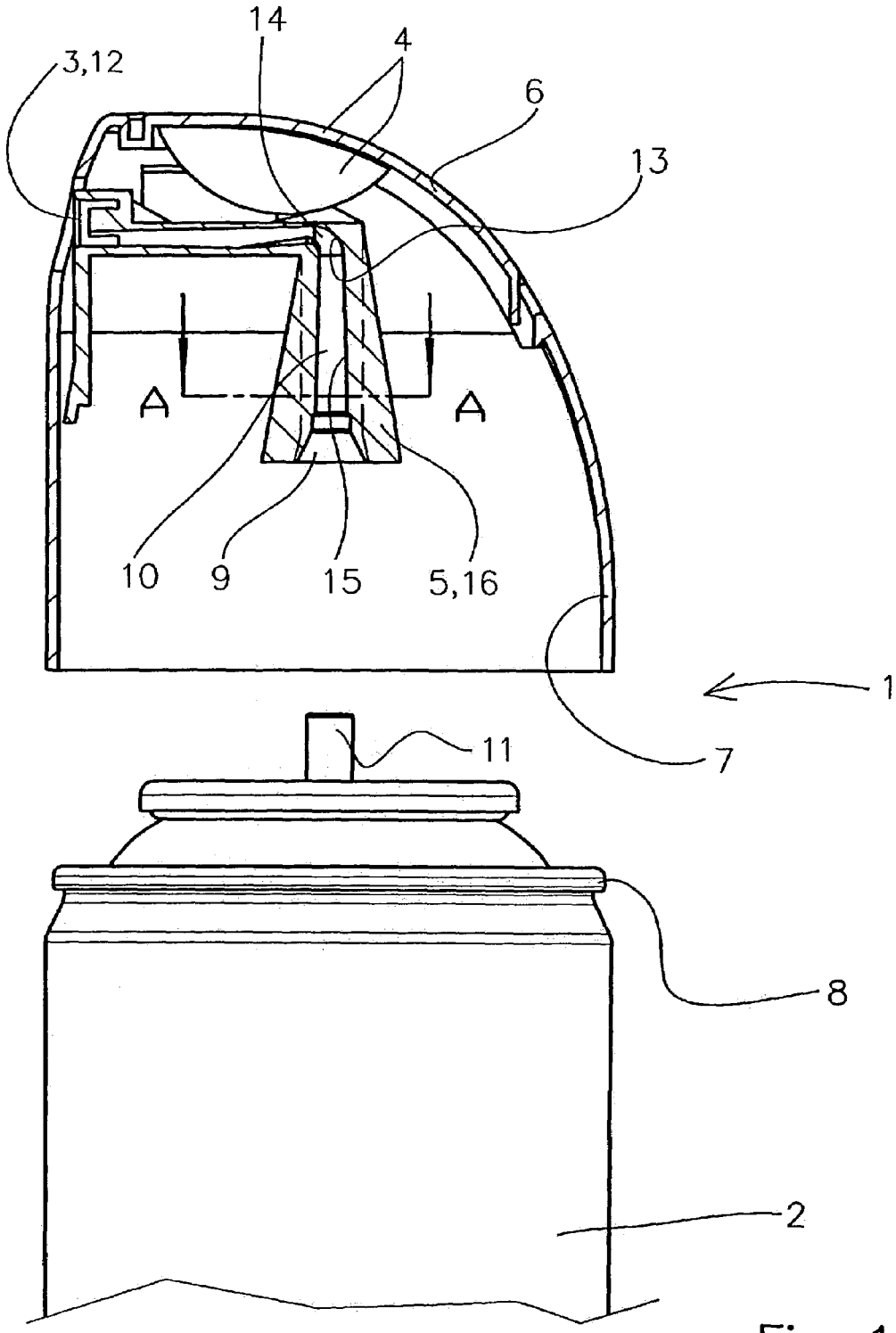
FIG. 1 is a partially vertical cross-sectional, partially side view of an aerosol container according to the invention with a cap in which a spray conduit is provided with sounding ribs for sound generation.
Figure 2:
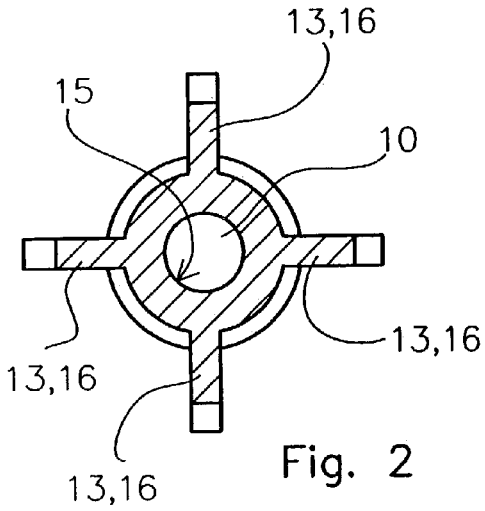
FIG. 2 is a cross-sectional view taken along the line A-A in FIG. 1 through the spray conduit together with the four sounding ribs.

A first embodiment of a container 1 according to the invention includes a reservoir 2, a product dispensing opening 3, and a device 4 for discharging the product contained in the reservoir 2 out through the product dispensing opening 3, a sound generator 5 and a noise damper 13 (FIGS. 1 and 2). The sound generator 5 and the noise damper 13 are functionally connected to the discharge device 4 in order to generate a desired sound when a product discharge occurs or while the product is being dispensed.

A button 6 in a cap 7 of the container 1 serves as part of the discharge device 4. The cap 7 can be slid onto a rim 8 of the container 1. A recess 9 at the bottom end of a spray conduit 10 receives a stem 11 of the container 1. The container 1 is an aerosol container. The spray conduit 10 that leads to a nozzle 12 is provided in the cap 7 of the container. As a noise damper 13, or more clearly stated, as a technique for preventing an excessive noise generation, the spray conduit 10, in particular in a curved section 14 of the spray conduit 10, has a mathematically continuous surface on its inner wall 15.

The spray conduit 10 is provided with four sounding ribs 16 extending radially out from the spray conduit 10. The sounding ribs 16 form respective 90 degree angles in relation to one another. If the button 6 is actuated, then the spray conduit 10 and the stem 11 are pressed downward and a valve (not shown in FIGS. 1 and 2) in the container 1 is actuated. The aerosol emerging through the stem 11 flows through the spray conduit 10 and is sprayed out through the nozzle 12. Through the action of the noise damper 13 and the sound generator 5, a sound is produced when the device 4 is actuated that is relatively quiet and is also found to be very pleasant due to the resonances in the cap 7.

Figure 3:
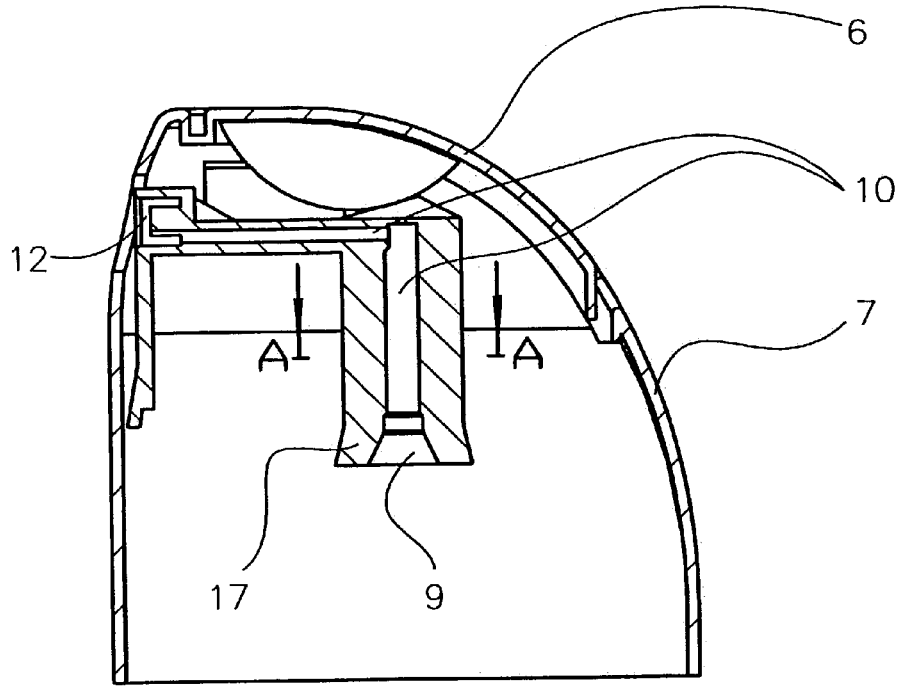
FIG. 3 is a vertical cross-sectional view through a cap for an aerosol container, in which a spray conduit leading to a nozzle is provided and encompassed by a sound absorbing material.
Figure 4:
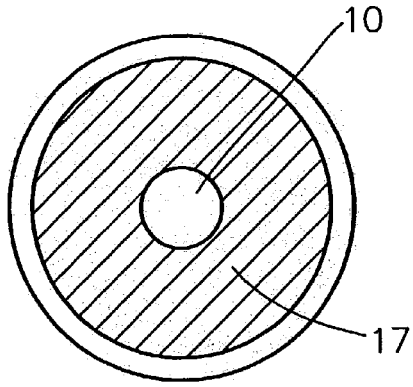
FIG. 4 shows a section along the line A-A in FIG. 3 through the spray conduit and the sound absorbing material.

In the exemplary embodiment in FIGS. 3 and 4, a cap 7 is provided to be slid onto a container that contains an aerosol. The cap 7 has a spray conduit 10, which is designed to receive a stem of the container in a recess 9. The spray conduit 10 is encompassed by a foamed material 17 and is therefore selectively sound insulated. The material 17 is comprised of a thermoplastic elastomer based on polypropylene. The spray conduit 10 can be pivoted downward by means of a button 6 so that it opens a valve of the container disposed on the stem and the product is discharged from the nozzle 12.

Figure 5:
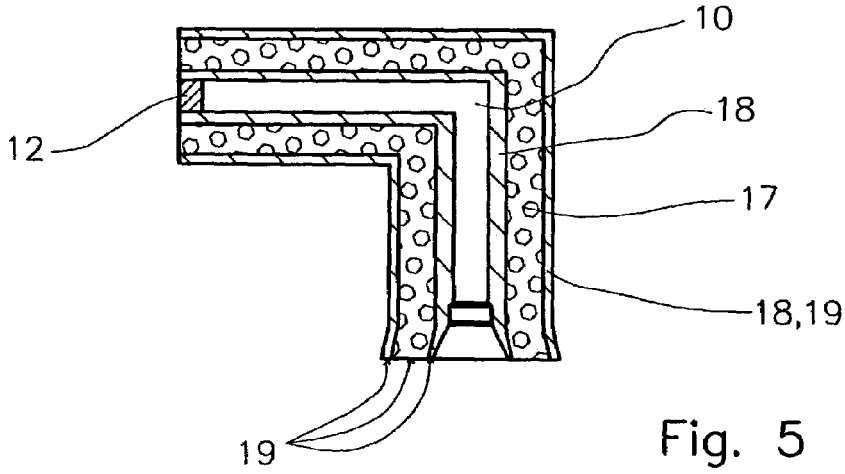
FIG. 5 shows a vertical section through a spray conduit, which leads to a nozzle and is encompassed by a foamed material, and has a film on the outside as a boundary layer.

In the exemplary embodiment in FIG. 5, a spray conduit 10 provided with a nozzle 12 is encompassed with three layers 19 of a selectively sound absorbing material. The inner layer 19 adjoining the spray conduit 10 is comprised of an unfoamed material 18. This is adjoined by a foamed material 17. The latter is encompassed on the outside by an unfoamed material 18, a film 19. All of the materials 17, 18 are comprised of plastic. The selective sound absorption is improved by means of the layer transitions. In particular, unpleasant frequencies in the vicinity of 1 KHZ and 5 KHZ are damped in this way. The material 17, 18 can be polypropylene.

Figure 7:
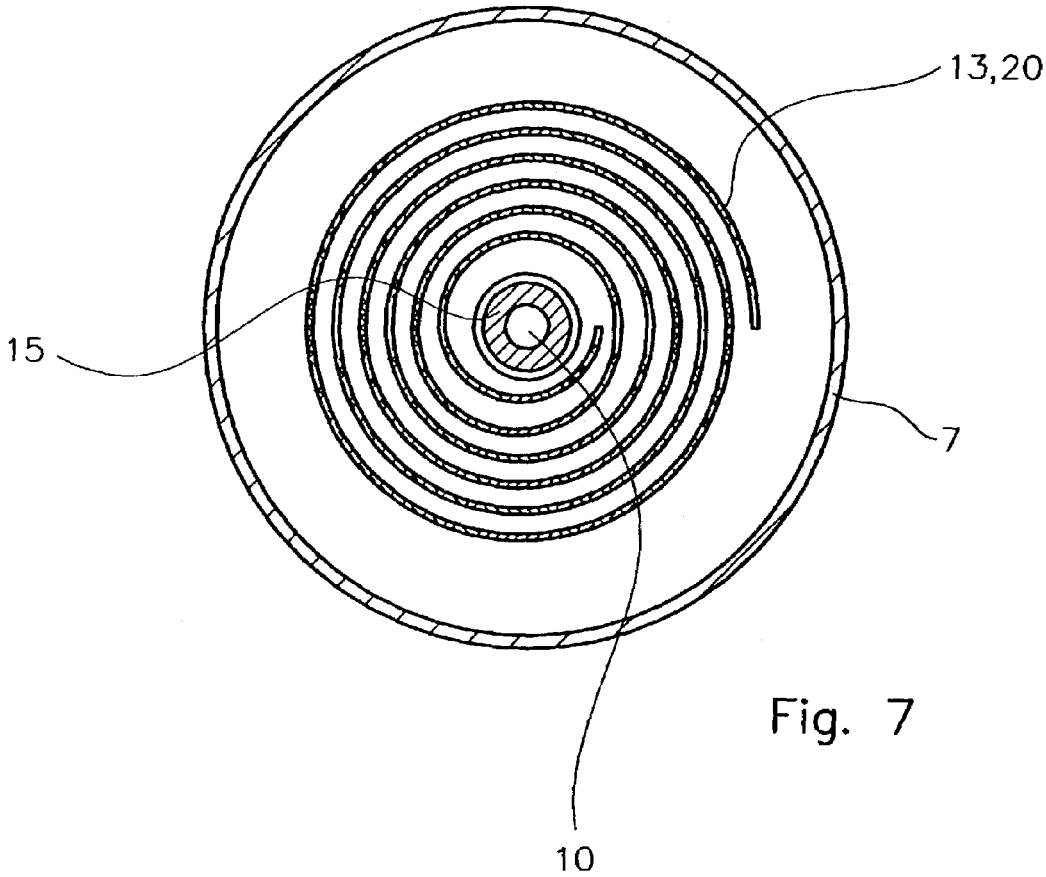
FIG. 7 is a cross-sectional view taken along the line A-A in FIG. 6 through the cap and spiral shown in FIG. 6.
Figure 6:
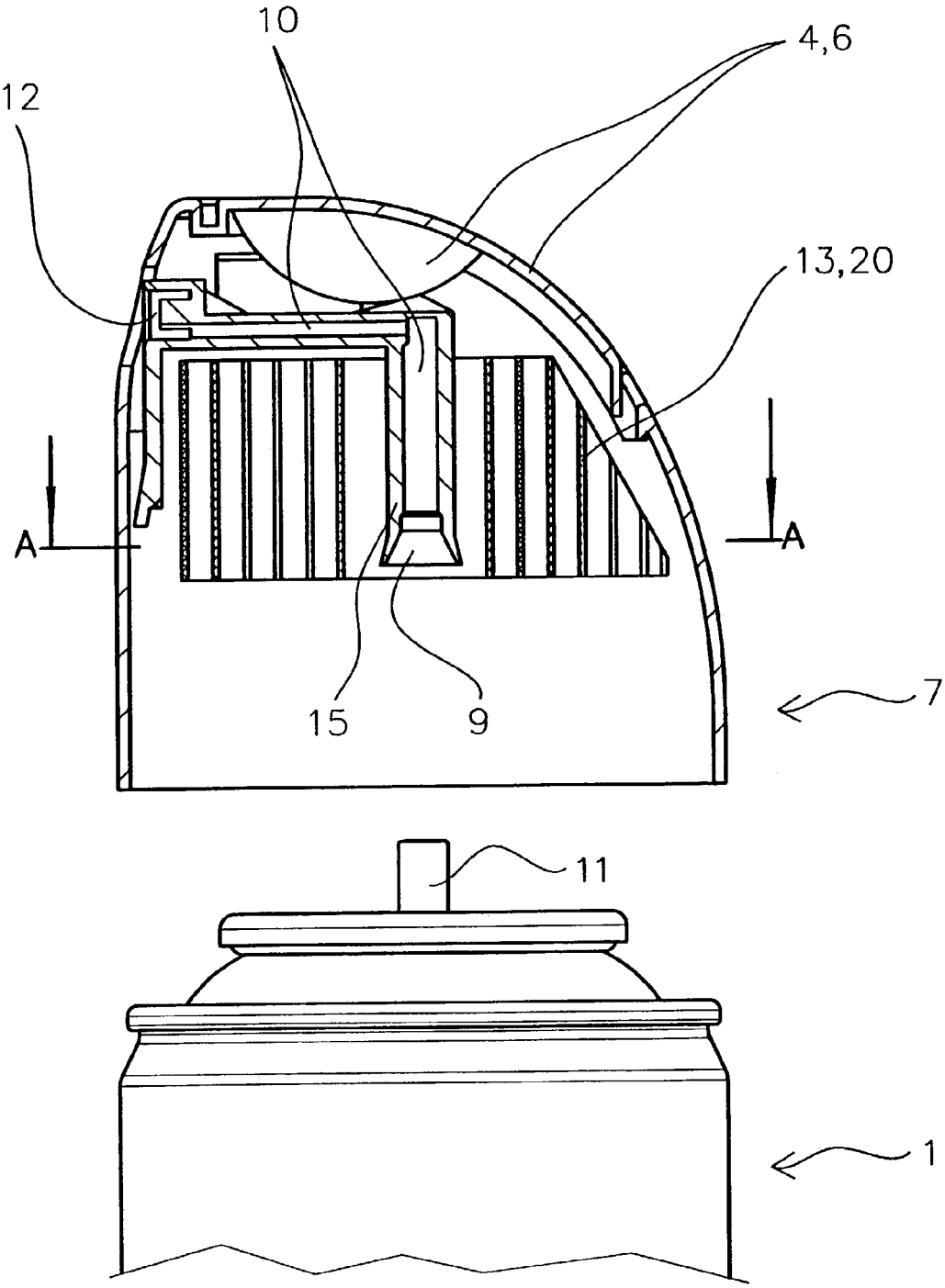
FIG. 6 is a partially vertical cross-sectional, partially side view of an aerosol container according to the invention with a cap, in which a spray conduit leading to a nozzle is provided with a spiral.

In the exemplary embodiment in FIGS. 6 and 7, a button 6 of a cap 7 that can be slid onto a container 1 is provided as part of the discharge device 4. The button 6 acts mechanically on the wall 15 of the spray conduit 10. The wall 15 in turn acts mechanically on a stem 11 of the container 1. When the button 6 is depressed, a valve (not shown) disposed underneath the stem 11 is opened so that the product is sprayed out through the spray conduit 10 and a nozzle 12. A spiral 20 that is disposed around the spray conduit is provided as a noise damper 13. The spiral 20 is comprised of corrugated paper. The spiral 20 damps the spray noise selectively so that it is found to be comparatively pleasant.

Figure 8:
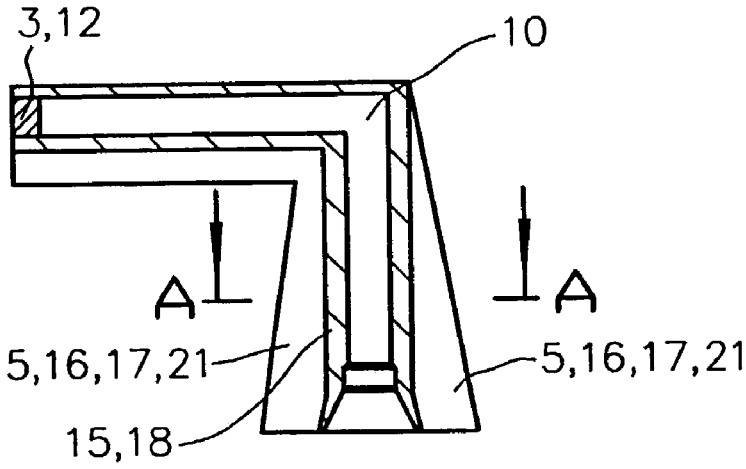
FIG. 8 shows a vertical section through a spray conduit of an aerosol container, whose wall has sounding ribs for sound generation.
Figure 9:
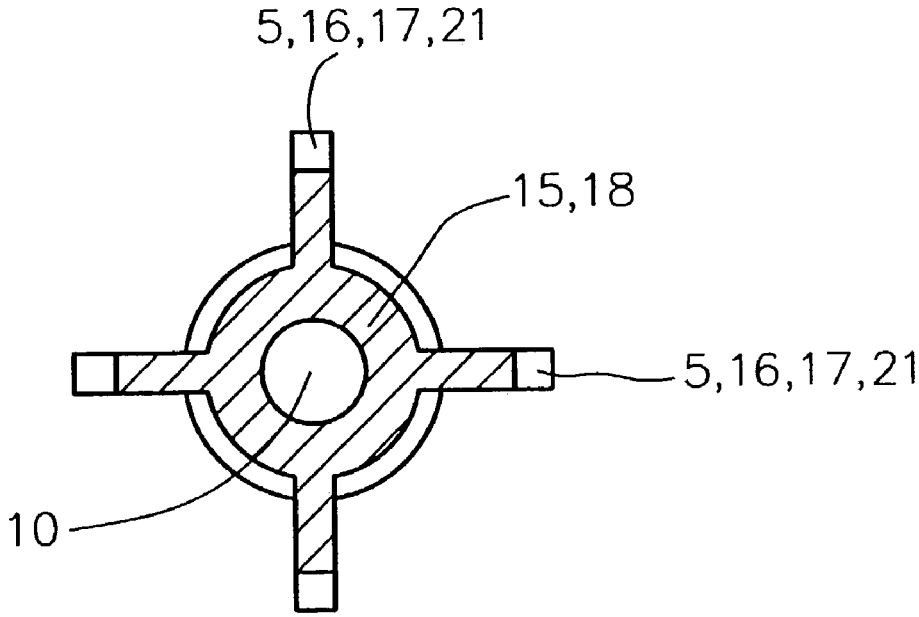
FIG. 9 shows a section along the line A-A in FIG. 8 through the sounding ribs of FIG. 8.

In the exemplary embodiment according to FIGS. 8 and 9, a spray conduit 10 is used to dispense the product from an aerosol container. The spraying process is started by exerting manual pressure on a button 6 of the container. A nozzle 12 provides a product dispensing opening 3. Four ribs are provided on the spray conduit 10 as sound generators 5, which simultaneously serve both as sounding ribs 16 and as stiffening ribs 21. The wall 15 of the spray conduit 10 is thus stiffened. The wall 15 is comprised of a relatively hard unfoamed material 18, whereas the ribs are comprised of a relatively soft foamed material 17. The material is polypropylene. The ribs amplify the deeper tones of the product discharge sound, which is found to be relatively pleasant.

Figure 10:
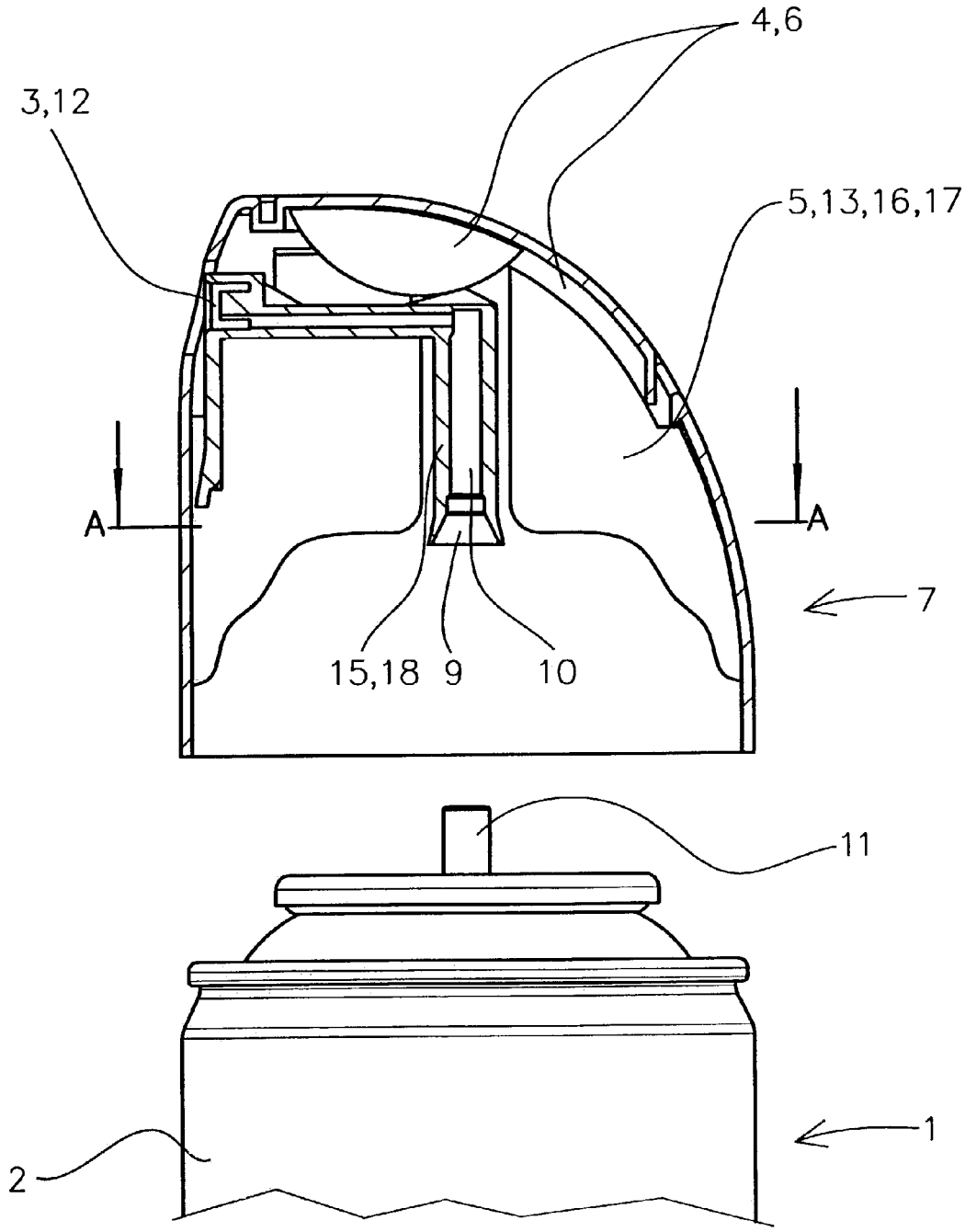
FIG. 10 is a partially vertical cross-sectional, partially side view of an aerosol container with a cap, in which a spray conduit leading to a nozzle is provided with a meander-shaped sounding rib.
Figure 11:
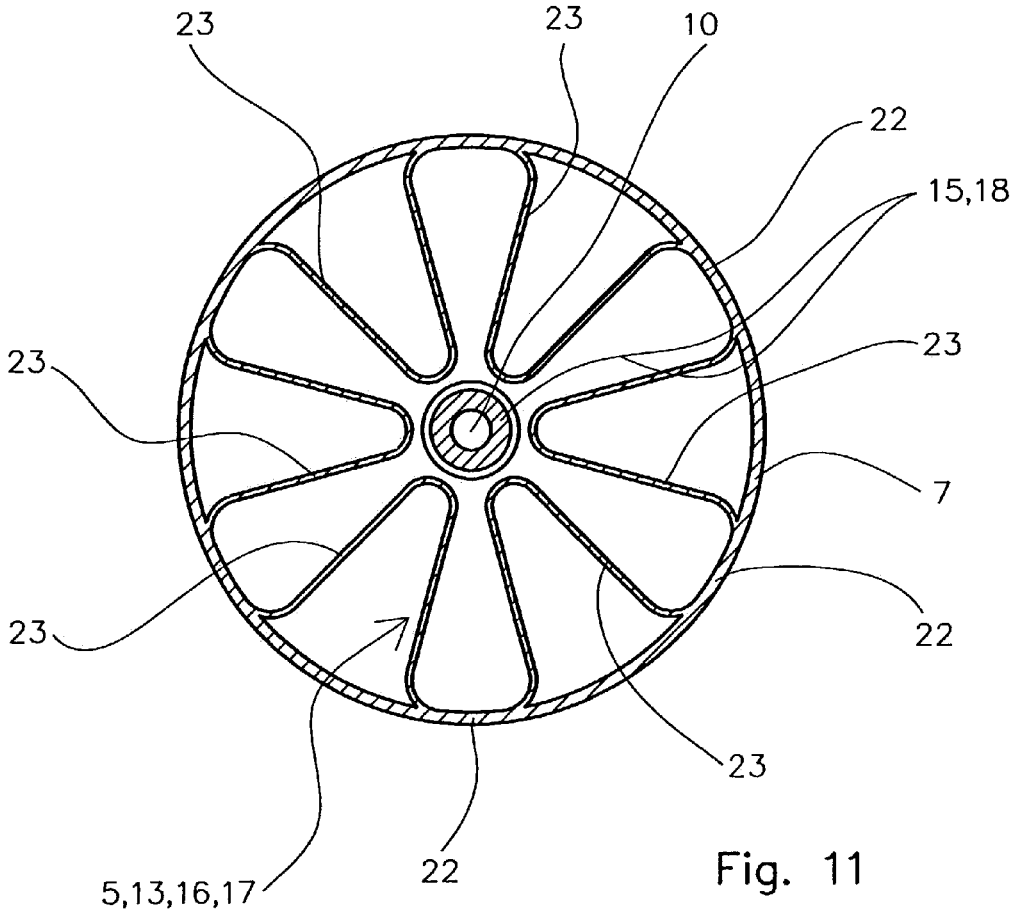
FIG. 11 shows a section along line A-A in FIG. 10 through the cap shown in FIG. 10.

In the exemplary embodiment of FIGS. 10 and 11, a spray conduit 10 is used to dispense the product from an aerosol container. The spraying process is started by manually pressing an actuating button 7 of the container 1. A nozzle 12 provides a product dispensing opening 3. A meander-shaped rib, which serves as a sounding rib 16 and as a resonator, is provided on the spray conduit 10 as both a sound generator 5 and a selective noise damper 13. The wall 15 of the spray conduit 10 is comprised of a relatively hard, unfoamed material 18, whereas the ribs are comprised of a relatively soft unfoamed material 17. The material is polypropylene. In accordance with their dimensions, the ribs amplify some tones of the product dispensing sound, which is therefore found to be relatively pleasant. The cap 7 of the container 1 also contributes to the acoustic pattern because the connections 22 cause the sound oscillations of the sounding ribs 16 to be transmitted to the cap 7. The sound is determined by half the length of the part 23 of the sounding rib 16 disposed between two adjacent connections.

Figure 13:
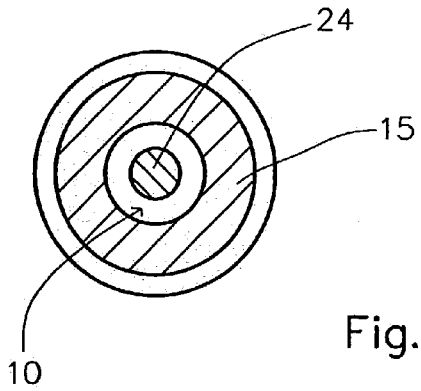
FIG. 13 shows a section taken along the line A-A in FIG. 12 through the spray conduit in FIG. 12.
Figure 12:
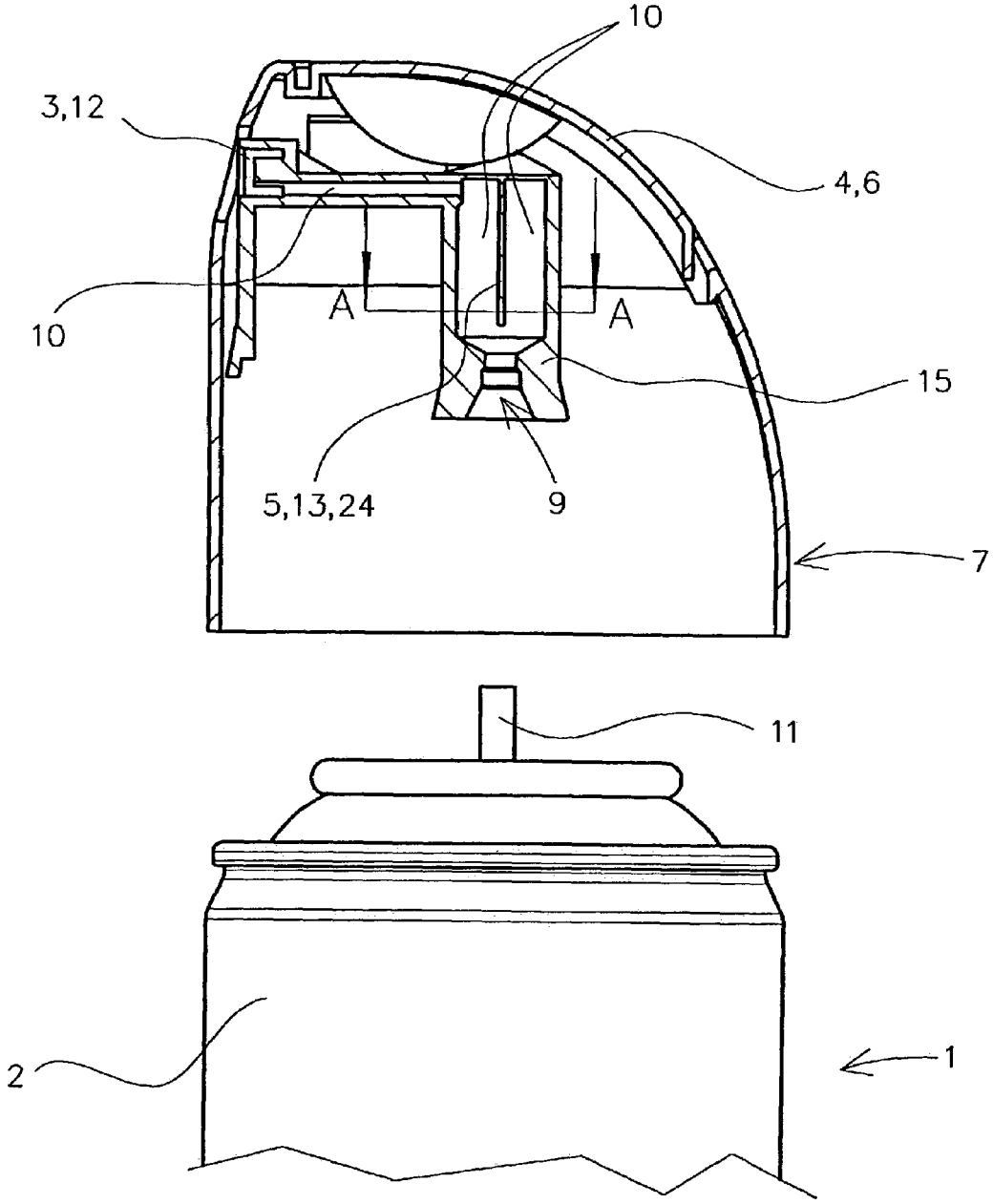
FIG. 12 is a partially vertical cross-sectional, partially side view of an aerosol container with a cap, in which a spray conduit leading to a nozzle is provided with a conduit insert.
Figure 14:
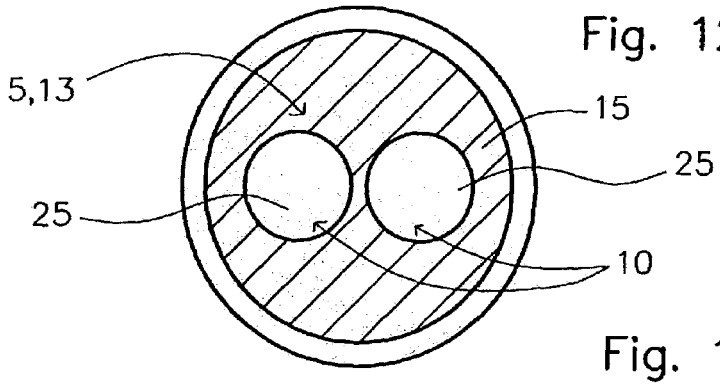
FIG. 14 shows a section through a spray conduit similar to that shown in FIG. 13, but with two separate conduit arms.

In the exemplary embodiment of FIGS. 12 and 13, the spray conduit 10 is provided with a conduit insert 24 extending inside the spray conduit. If the button 6, as part of the discharge device 4, is depressed, then the wall 15 of the spray conduit 10 in the recess 9 presses with its wall 15 against the stem 11. The product that then flows out of the reservoir 2 travels along the conduit insert 24 to the product dispensing opening 3. Since the conduit insert 24 narrows the flow conduit 10, the flow acts in a laminar fashion and a frequency increase occurs in the acoustic pattern of the product dispensing noise. For frequencies around 4 KHZ, the conduit insert 24 acts as a noise damper 13, but for higher frequencies, it acts as a sound generator 5. In the exemplary embodiment of FIG. 14, this is also true. In this instance, the spray conduit 10 is comprised of two parallel conduit arms 25. The two relatively small cross sections of the conduit arms 25 reduce turbulences that emit frequencies around 4 KHZ.

Figure 15:
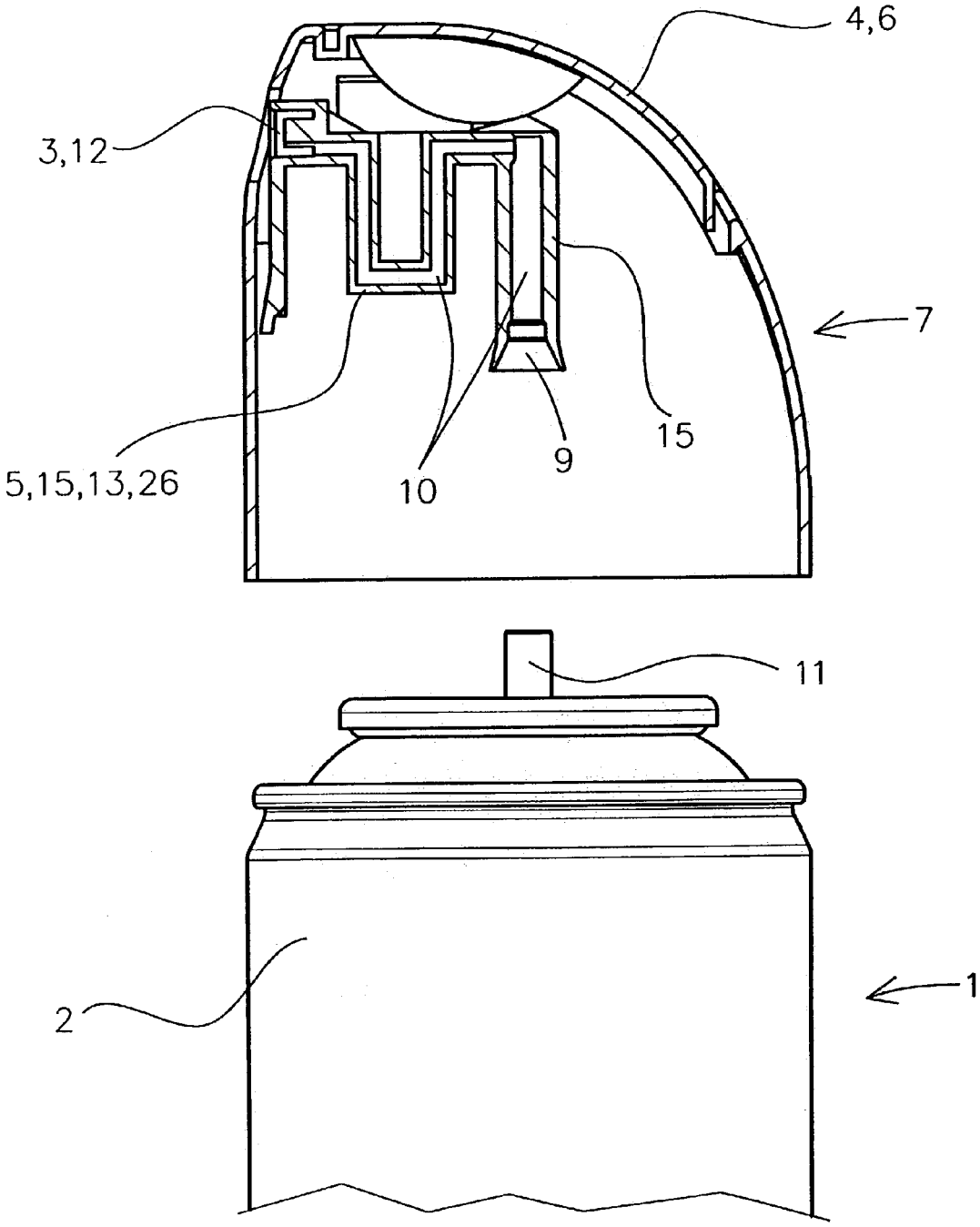
FIG. 15 is a partially vertical cross-sectional, partially side view of an aerosol container with a cap, in which a spray conduit leading to a nozzle and an extension for the spray conduit are provided.

In the exemplary embodiment of FIG. 15, a button 6 of a cap 7 that can be slid onto a container 1 is provided as part of the discharge device 4. The button 6 acts mechanically on the wall 15 of the spray conduit 10. The wall 15 in turn acts mechanically on a stem 11 of the container 1. When the button 6 is depressed, a valve (not shown) disposed underneath the stem 11 is opened so that the product is sprayed out through the spray conduit 10 and a nozzle 12. An extension 26 for the spray conduit 10 functions as a noise damper 13 for higher frequencies and as a sound generator 5 for lower frequencies. The wall 15 of the spray conduit 10, together with the extension 26, is relatively long, which is why low frequencies with correspondingly long wavelengths are preferable. A frequency shift occurs, compared to a spray conduit 10 of normal length, i.e. without an extension 26. Analogously, a shortening of the spray conduit 10 could achieve a frequency shift toward higher frequencies.

Figure 16:
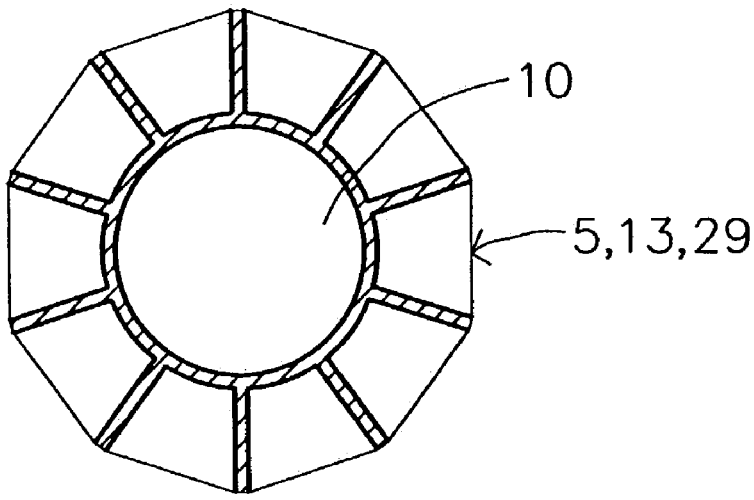
FIG. 16 shows a section through a spray conduit, which is encompassed by a honeycomb formation.
Figure 17:
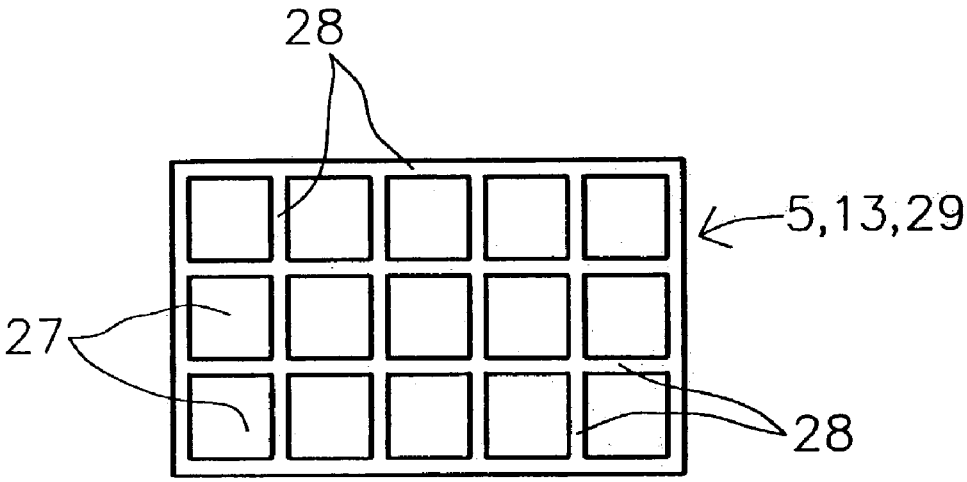
FIG. 17 shows a side view of a honeycomb formation with a number of rectangular honeycombs.

In the exemplary embodiment of FIGS. 16 and 17, the spray conduit 10 is encompassed by a honeycomb formation 29, which has a number of honeycombs 27; in the direction oriented away from the spray conduit 10, the honeycombs 27 are aligned radially in relation to the spray conduit 10. The honeycomb structure is rectangular. The honeycombs 27 are open and increase the frequencies of the spray conduit noise due to the relatively high rigidity of the honeycomb walls 28. Consequently, the honeycomb formation 29 acts as a sound generator 5 for higher frequencies and as a noise damper 13 for lower frequencies.

Figure 18:
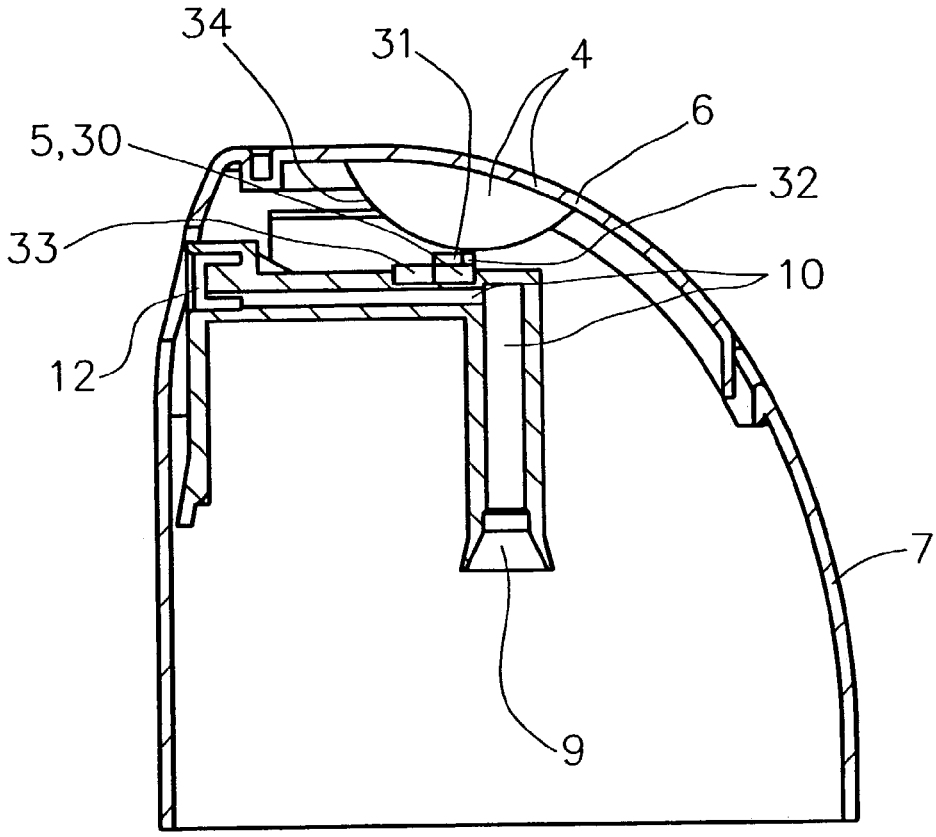
FIG. 18 is a side cross-sectional view through a cap for an aerosol container, in which a spray conduit leading to a nozzle is provided with a button, two switch elements, a sound chip, and a battery.

In the exemplary embodiment of FIG. 18, a button 6 in a cap 7 for a container is provided as part of the discharge device 4. The cap 7 can be slid onto an upper rim of the container 1. A recess 9 at the lower end of a spray conduit 10 receives a stem of the container 1. The container 1 is an aerosol container. The spray conduit 10 leading to a nozzle is provided in the cap 7. Two switch elements 31, 32 are attached to the spray conduit 10. In the initial position of the button 6 shown in FIG. 18, a rounded element 24 of the button 6 is disposed above the one switch element 31. If the button 6 is pressed down a little, then only the switch element 31 is actuated, as a result of which a particular programmed sound is generated by a sound chip 30. The sound chip 30 is supplied with current from a battery 33. With further depression of the button 6, the rounded element 34 travels off the switch element 31 and onto the second switch element 32, as a result of which the first sound is switched off and the second sound is switched on. Instead of the second sound, a piece of product information can also be triggered, which plays after the first sound is switched off.

Figure 20:
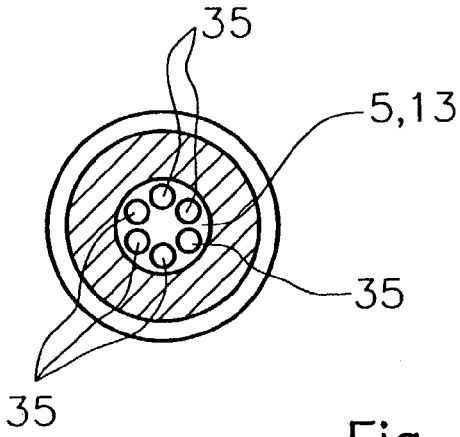
FIG. 20 shows a section along the line A-A in FIG. 19 through the spray conduit in FIG. 19.
Figure 19:
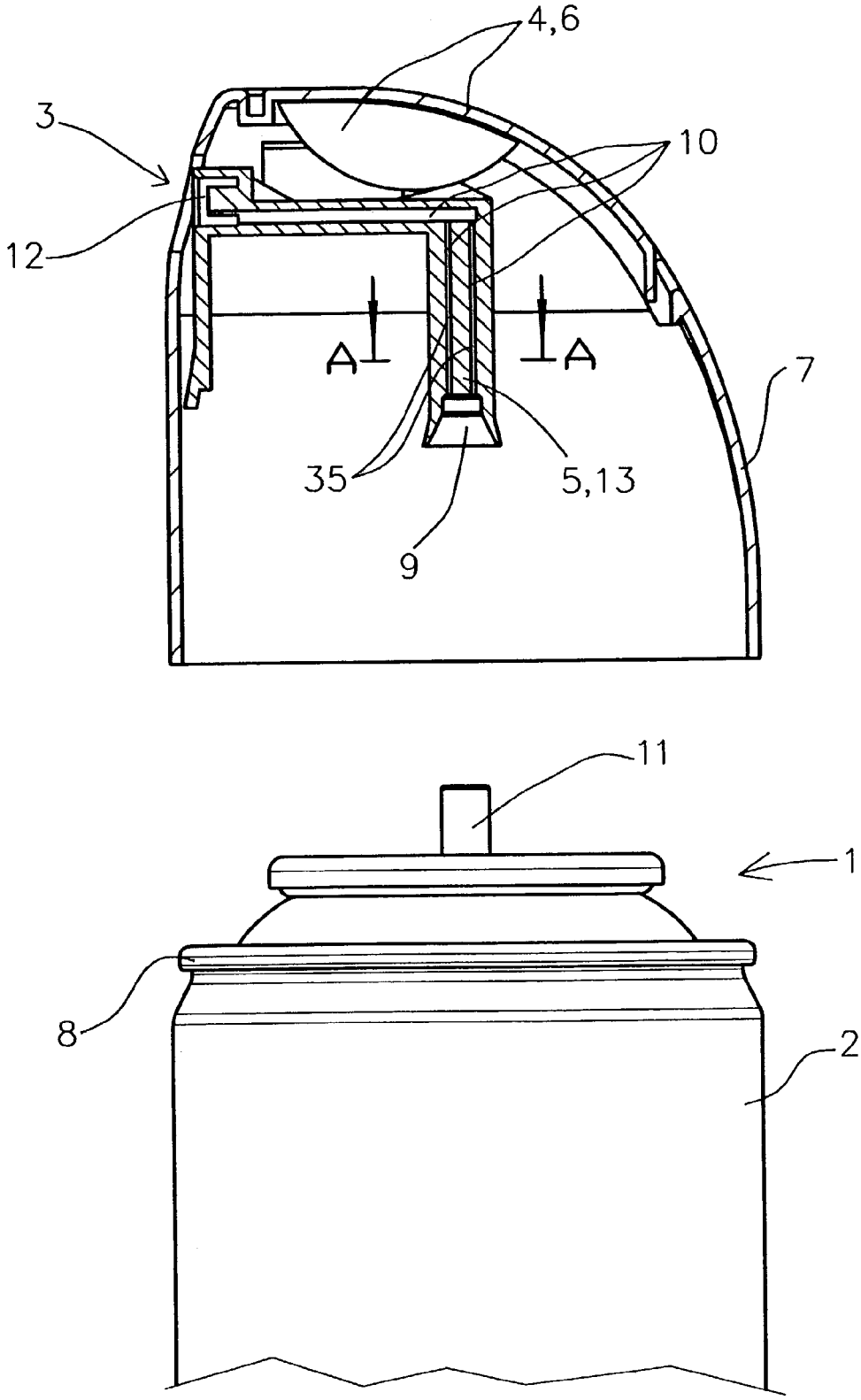
FIG. 19 is a partially vertical cross-sectional, partially side view through an aerosol container with a cap, in which a spray conduit leading to a nozzle comprises a number of individual conduits.

In a container 1 with a reservoir 2, a product dispensing opening 3, and a discharge device 4 for dispensing the product contained in the reservoir 2 out of the product dispensing opening 3, a sound generator 5 and a noise damper 13 are provided on the container 1 (FIGS. 19, 20). The sound generator 5 and the noise damper 13 are functionally connected to the device 4 in order to generate a desired sound for a product discharge while the product is being dispensed.

A button 6 in a cap 7 of the container 1 serves as part of the discharge device 4. The cap 7 can be slid onto a rim 8 of the container 1. The cap 7 can be slid onto a rim 8 of a container 1. A recess 9 at the bottom end of a spray conduit 10 receives a stem 11 of the container 1. The container 1 is an aerosol container. The spray conduit leading to a nozzle 12 is provided in the cap 7 of the container. A large number of individual conduits 35 are provided as a noise damper 13 and a sound generator 5.

This decreases certain turbulences and corresponding frequencies that occur in a single spray conduit, as a result of which a selective noise damping is achieved for this frequency range. Consequently, the individual conduits 35 function as a noise damper 13. Sounds that are typical for a large number of individual conduits 35 are amplified. In this connection, the individual conduits 35 function as a noise damper 13. Consequently an altered, relatively pleasant sound is generated when the product in the container 1 is dispensed.

A known spray conduit has a diameter of 2 mm with a length of 20 mm, which results in a cross sectional surface area of 3.141 $mm^2$. However, if six individual conduits 35 (FIG. 20) are combined into a bundle in which each individual conduit 35 has a diameter of 0.8 mm, then this results in a combined flow cross sectiona of 3.141 $mm^2$. Since the tubular bundle is also better able to absorb the oscillations that occur, the following effects are produced: noise reduction, frequency change, and reduction of the flow resistance and therefore of the eddies that occur, which results in a further noise reduction.

Figure 21:
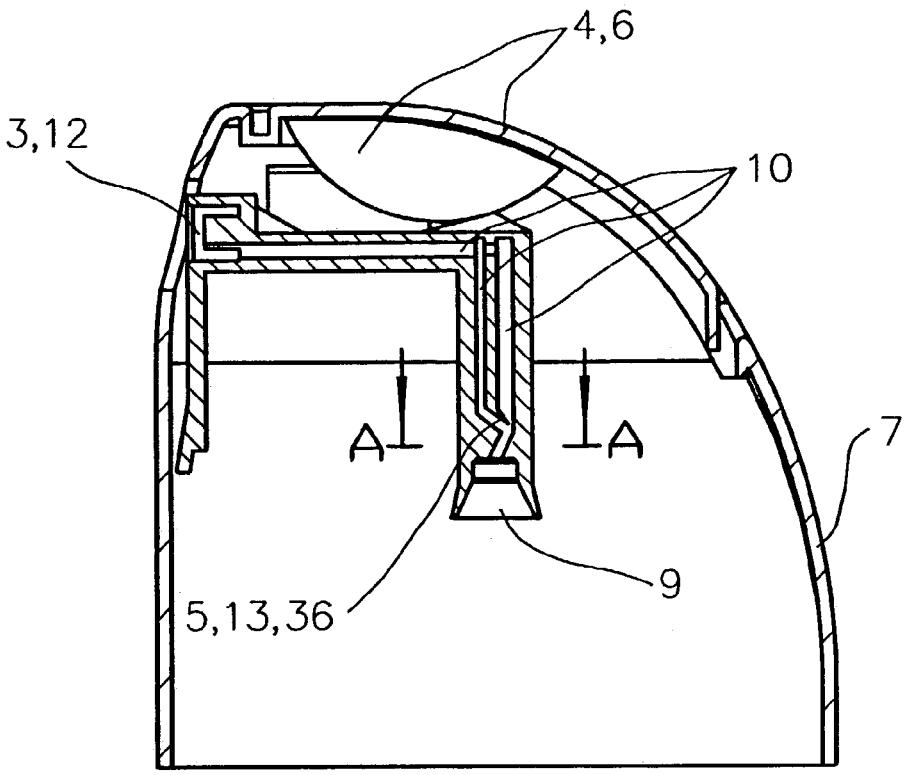
FIG. 21 is a partially vertical cross-sectional, partially side view of an aerosol container with a cap, in which a spray conduit leading to a nozzle is provided with a labium inside the spray conduit.
Figure 21:
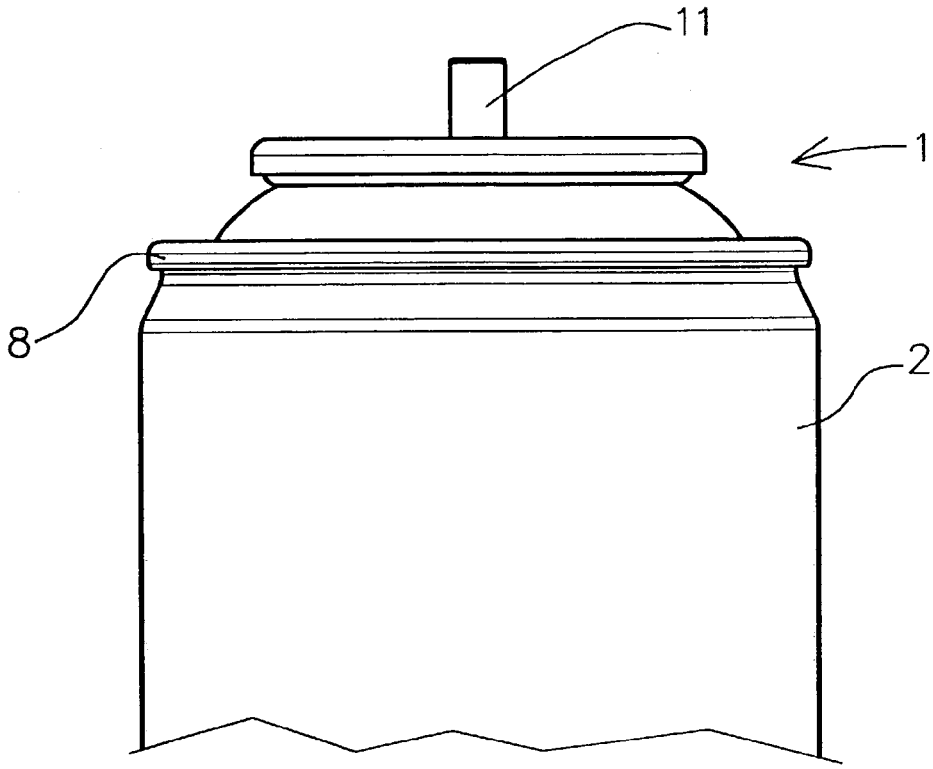
Figure 22:
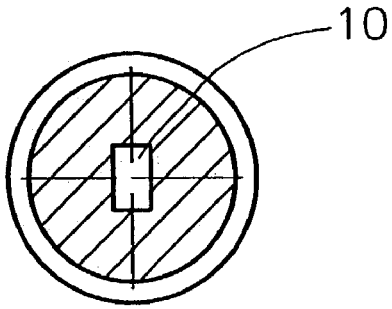
FIG. 22 shows a section along the line A-A in FIG. 21 through the spray conduit in FIG. 21.
Figure 23:
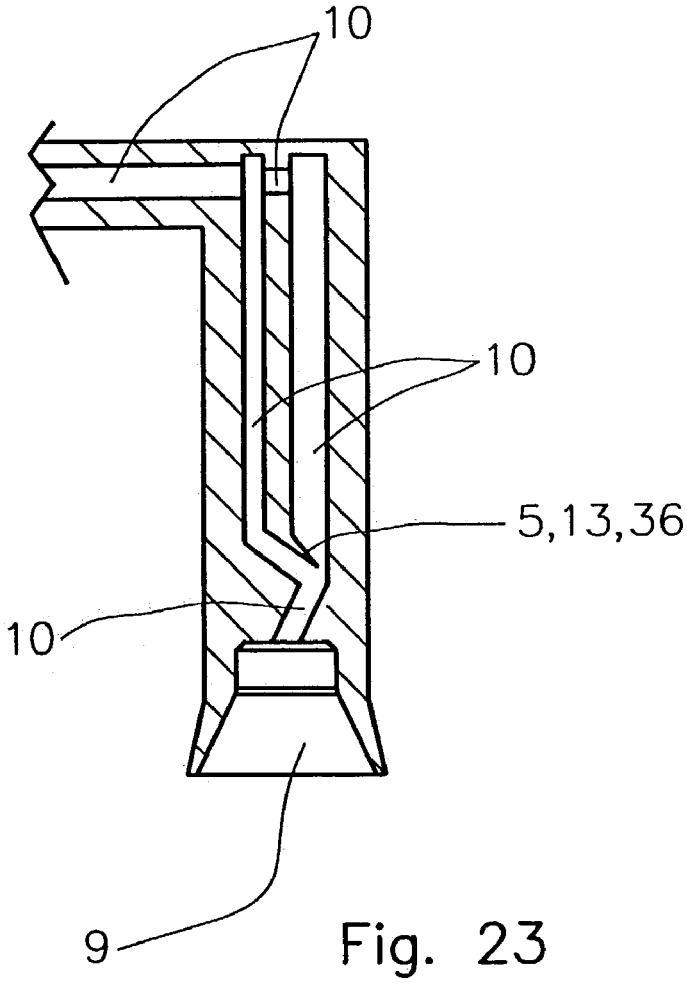
FIG. 23 is a detailed cutaway cross-sectional view through the spray conduit in the cap shown in FIG. 21 with the labium.

In another exemplary embodiment (FIGS. 21, 22, 23), in a container 1 with a reservoir 2, a product dispensing opening 3, and a discharge device 4 for discharging the product contained in the reservoir 2 out through the product dispensing opening 3, a sound generator 5 and a noise damper 13 are provided on the container 1. The sound generator 5 and the noise damper 13 are functionally connected to the device 4 in order to generate a desired sound for a product discharge while the product is being dispensed.

A button 6 in a cap 7 of the container 1 serves as part of the discharge device 4. The cap 7 can be slid onto a rim 8 of the container 1. A recess 9 at the bottom end of the spray conduit 10 receives a stem 11 of the container 1. The container 1 is an aerosol container. A spray conduit leading to a nozzle 12 is provided in the cap 7 of the container. A labium 36 in the spray conduit 10 is provided as a noise damper 13 and a sound generator 5. The labium 36 is a sound generator 5 and functions together with the vertically aligned part of the spray conduit 10 in a fashion similar to an organ pipe when the aerosol from the container 1 flows past it. It simultaneously functions as a noise damper 13 since its presence causes other frequencies that are otherwise present to be suppressed or prevented.

Figure 24:
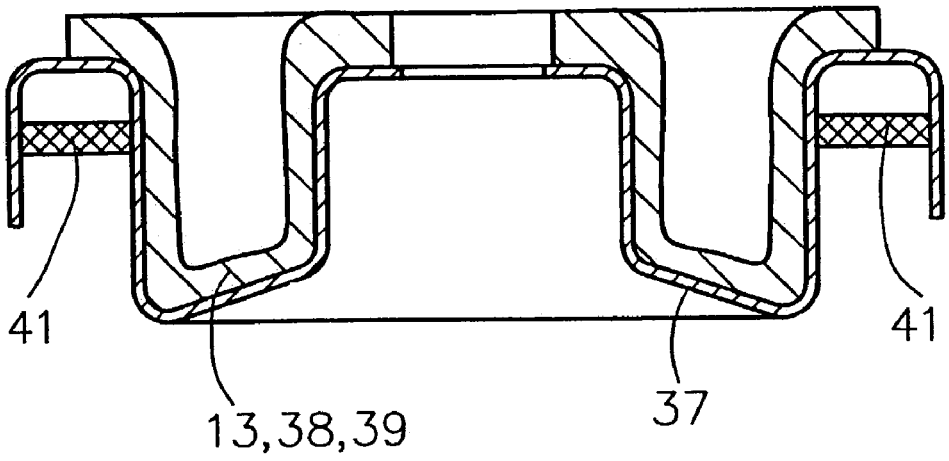
FIG. 24 shows a vertical section through a valve plate of an aerosol container in which a polyurethane lacquer is applied to the valve plate as a noise damper.
Figure 25:
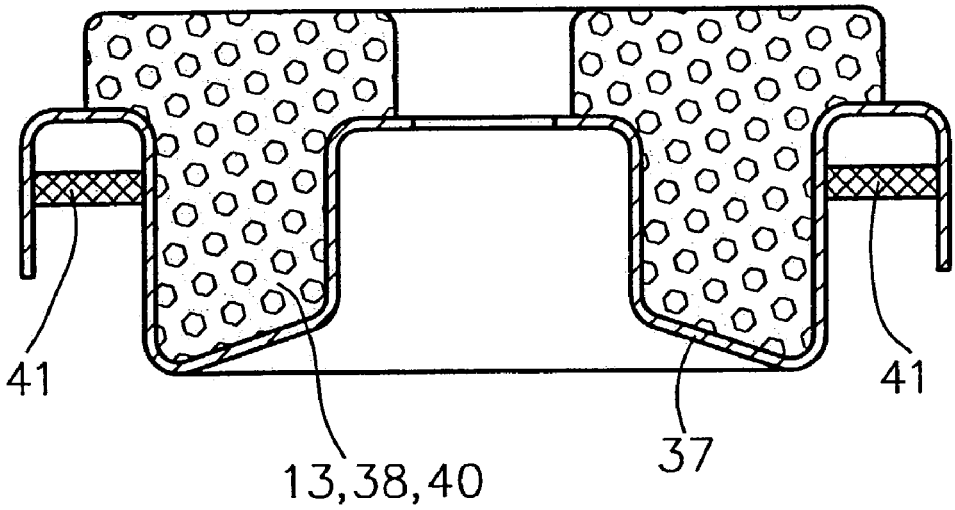
FIG. 25 shows a vertical section through a valve plate analogous to FIG. 24, but with a polyurethane foam as the noise damper.

In the exemplary embodiment of FIGS. 24 and 25, a valve plate insulation 38 is provided as a noise damper 13 on a valve plate 37 of an aerosol container. The valve plate insulation 38 is a layer of a sound absorbing material that is applied to the valve plate 37. In the one instance, this material is a polyurethane lacquer 39 (FIG. 24) and in the other instance, it is a polyurethane foam 40 (FIG. 25).

The valve plate 37 is sealed in relation to an upper rim of an aerosol container by means of a circumferential seal 41. When the product is being dispensed from the aerosol container, e.g. by manual actuation of a spray head, the frequencies emitted by the valve plate 37 are damped by the valve plate insulation 38. In this manner, for example, a relatively pleasant spraying sound is achieved. A foam dispensing sound can also be altered in an analogous manner. The aerosol container then has a foam generator at its product dispensing opening.

Figure 26:
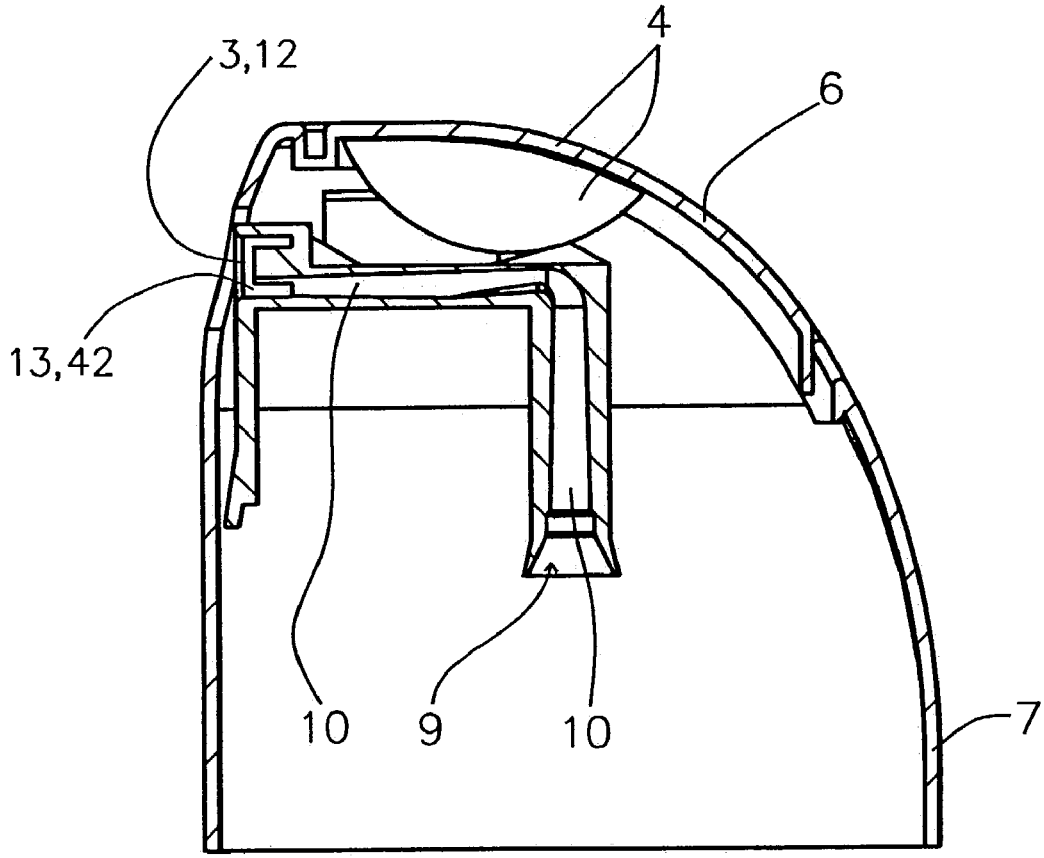
FIG. 26 is a side cross-sectional view through a cap for an aerosol container, in which an elastic plastic insert containing the nozzle and acting as a noise damper and a spray conduit leading to the nozzle are provided.

A product dispensing opening 3 and a device 4 for discharging the product from the product dispensing opening 3 are provided in a cap 7 for a container (FIG. 26). A noise damper 13 is functionally connected to the discharge device 4 in order to generate a desired sound for a product discharge while the product is being dispensed.

A button 6 in a cap 7 of the container serves as part of the discharge device 4. The cap 7 can be slid onto a rim of the container. A recess 9 at the bottom end of a spray conduit 10 receives a stem of the container. The container is an aerosol container. The spray conduit 10 leading to a nozzle 12 is provided in the cap 7 of the container. As a noise damper 13, or more clearly stated, as a technique for preventing an excessive noise generation, the outlet end of the spray conduit 10 is provided with an insert 42, which contains the nozzle 12, is comprised of an elastic plastic, and therefore functions as a noise damper 13.

The emerging aerosol flows through the spray conduit 10 and is sprayed out 40 through the nozzle 12. The action of the noise damper 13 generates a sound that is relatively quiet and, due to the selective damping in the plastic, is also found to be very pleasant when the device 4 is actuated.

Figure 27:
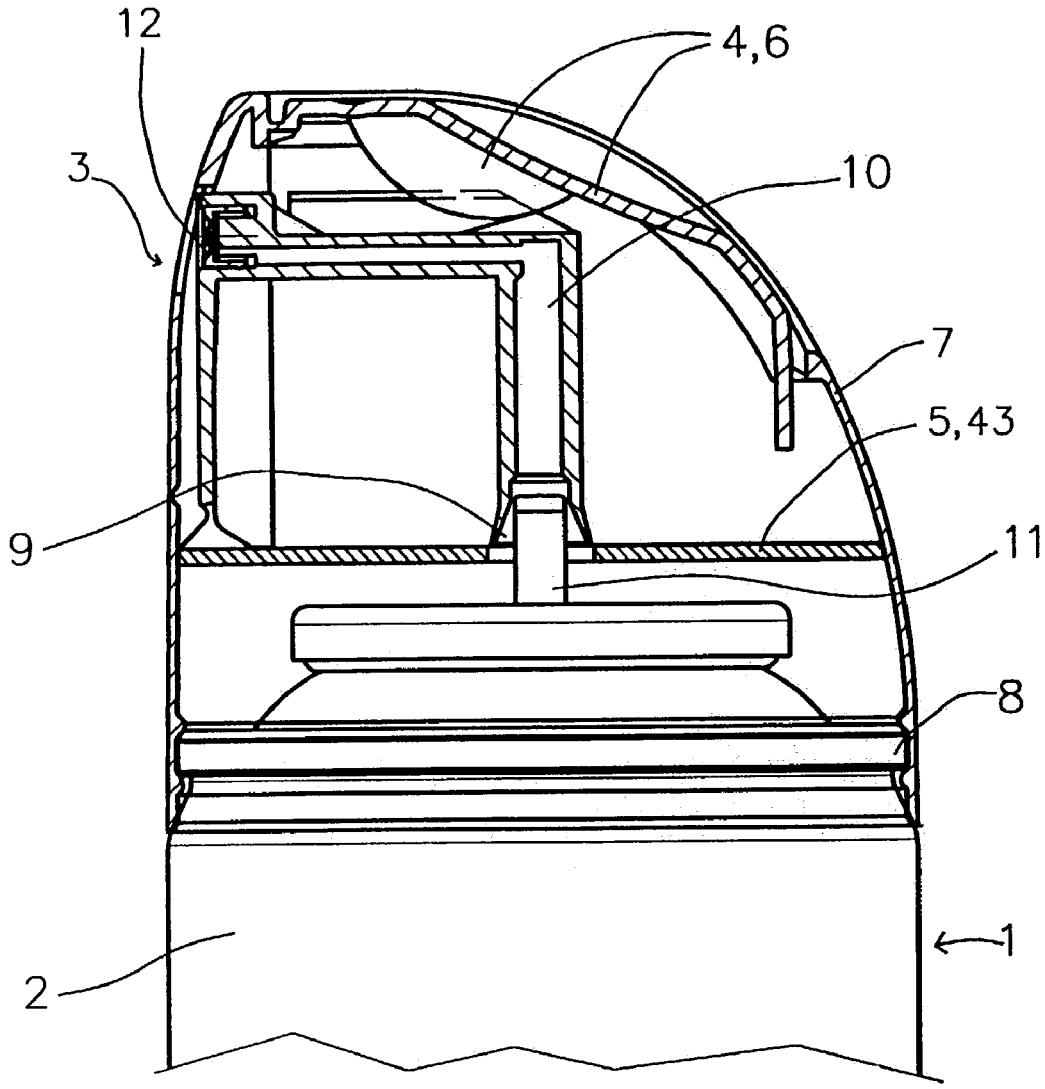
FIG. 27 is a side cross-sectional view through a cap for an aerosol container, in which a spray conduit leading to a nozzle is provided, and with a disk-shaped resonance surface.

In the exemplary embodiment of FIG. 27, in a container 1 with a reservoir 2, a product dispensing opening 3, and a device 4 for discharging the product contained in the reservoir 2 out through the product dispensing opening 3, a sound generator 5 is provided. The sound generator 5 is functionally connected to the device 4 in order to generate a desired sound for a product discharge while the product is being dispensed.

A button 6 in a cap 7 of the container 1 serves as part of the discharge device 4. The cap 7 can be slid onto a rim 8 of the container 1. A recess 9 at the bottom end of a spray conduit 10 receives a stem 11 of the container 1. The container 1 is an aerosol container. The spray conduit 10 leading to a nozzle 12 is provided in the cap 7 of the container.

A horizontal, disk-shaped resonance surface 43 that extends radially away from the spray conduit 10 is provided on the spray conduit 10 as a sound generator 5. If the button 6 is actuated, then the spray conduit 10 is pressed downward with the stem 11 and a valve (not shown) in the container 1 is actuated. The aerosol emerging through the stem 11 flows through the spray conduit 10 and is sprayed out the nozzle 12. The action of the sound generator 5 when the device 4 is actuated produces a sound that is found to be very pleasant, which is predetermined by the resonances of the resonance surface 43. The resonance surface 43 is rigidly connected to the inner wall of the cap 7. The resonance surface 43 is a disk made of plastic.

Figure 28:
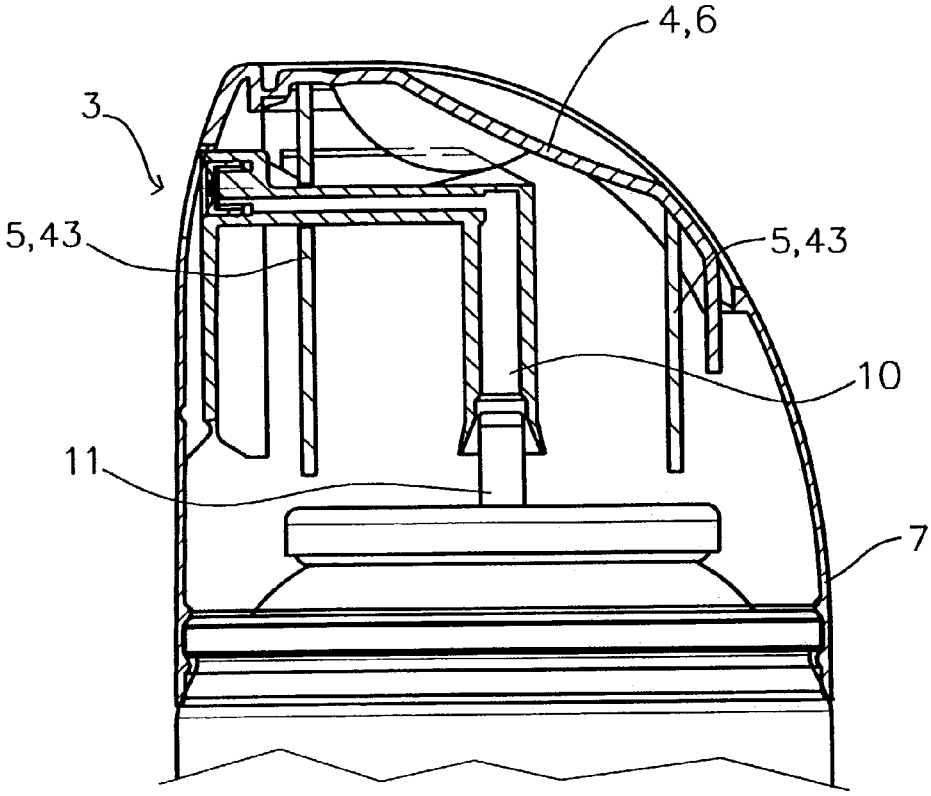
FIG. 28 is a side cross-sectional view through a cap that is similar to the cap shown in FIG. 27, but with two vertically aligned resonance surfaces.
Figure 29:
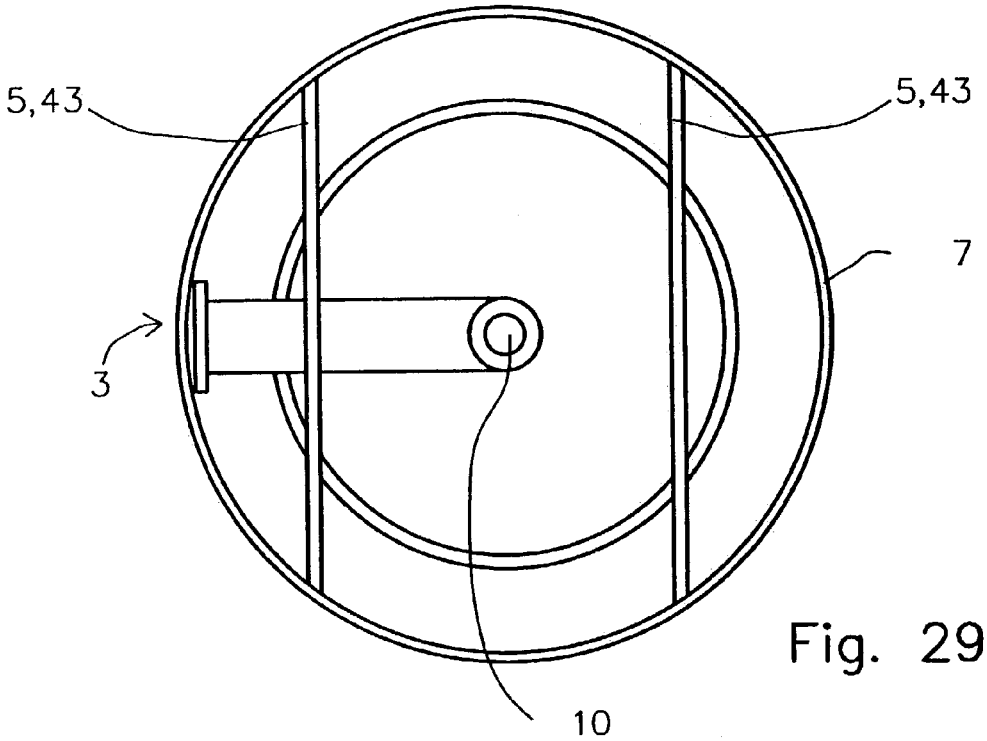
FIG. 29 shows a bottom view of the cap from FIG. 28.
Figure 30:
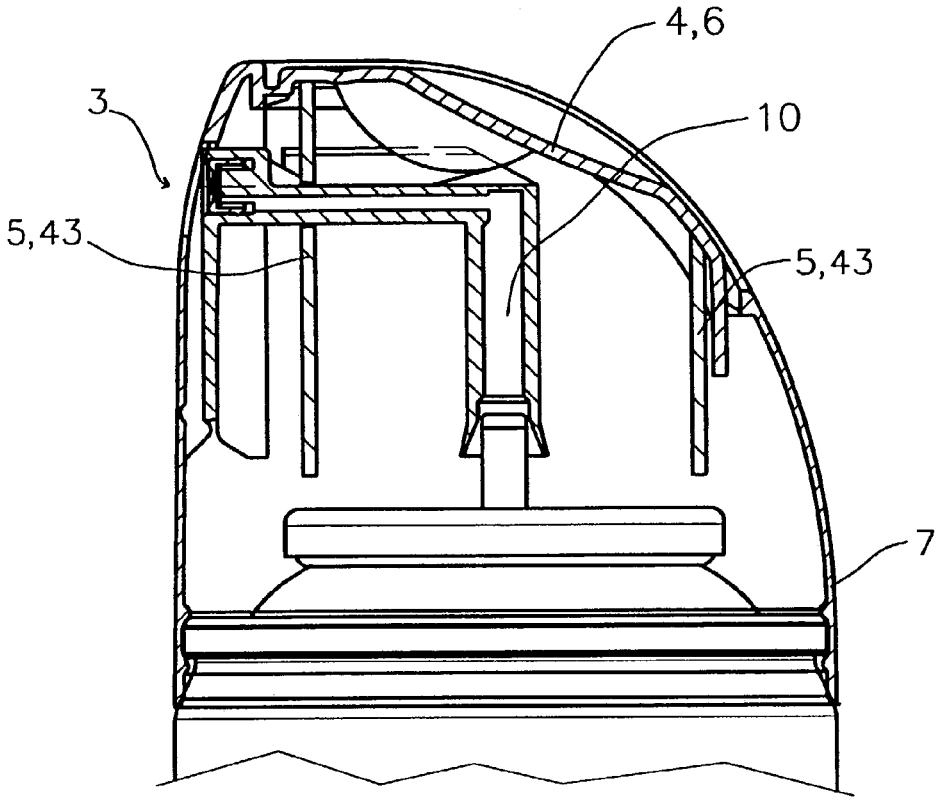
FIG. 30 is a side cross-sectional view through a cap for an aerosol container according to the invention which is similar to the cap shown in FIG. 27, but with a circumferential resonance surface.
Figure 31:
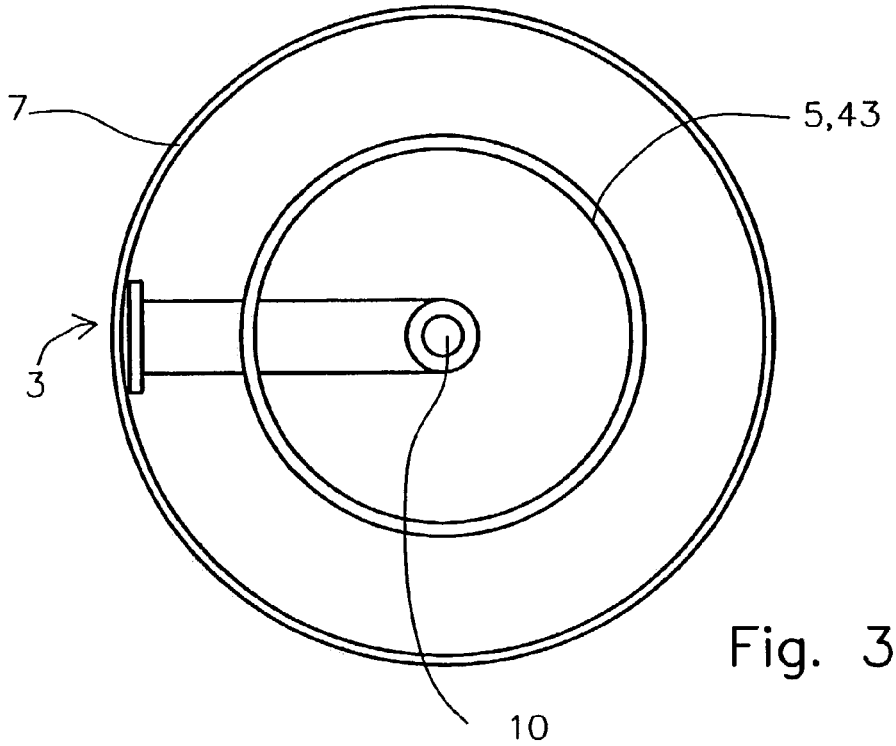
FIG. 31 shows a bottom side view of the cap from FIG. 30.

In the exemplary embodiment of FIGS. 28 and 29, as well as in the exemplary embodiment of the FIGS. 30 and 31, a technique for sound alteration is used that corresponds to the exemplary embodiment of FIG. 27. In the exemplary embodiment of FIGS. 28 and 29, two parallel vertical resonance surfaces 43 are provided inside a cap 7, whereas in the exemplary embodiment of FIGS. 30 and 31, an annular, circumferential resonance surface 43 is provided in a cap 7. Depending on the arrangement in the cap 7, the number of resonance surfaces 43, the material selection, the surface area dimensions, and a possibly existing connection to the cap 7, a corresponding sound can be produced when dispensing the product.

Figure 32:
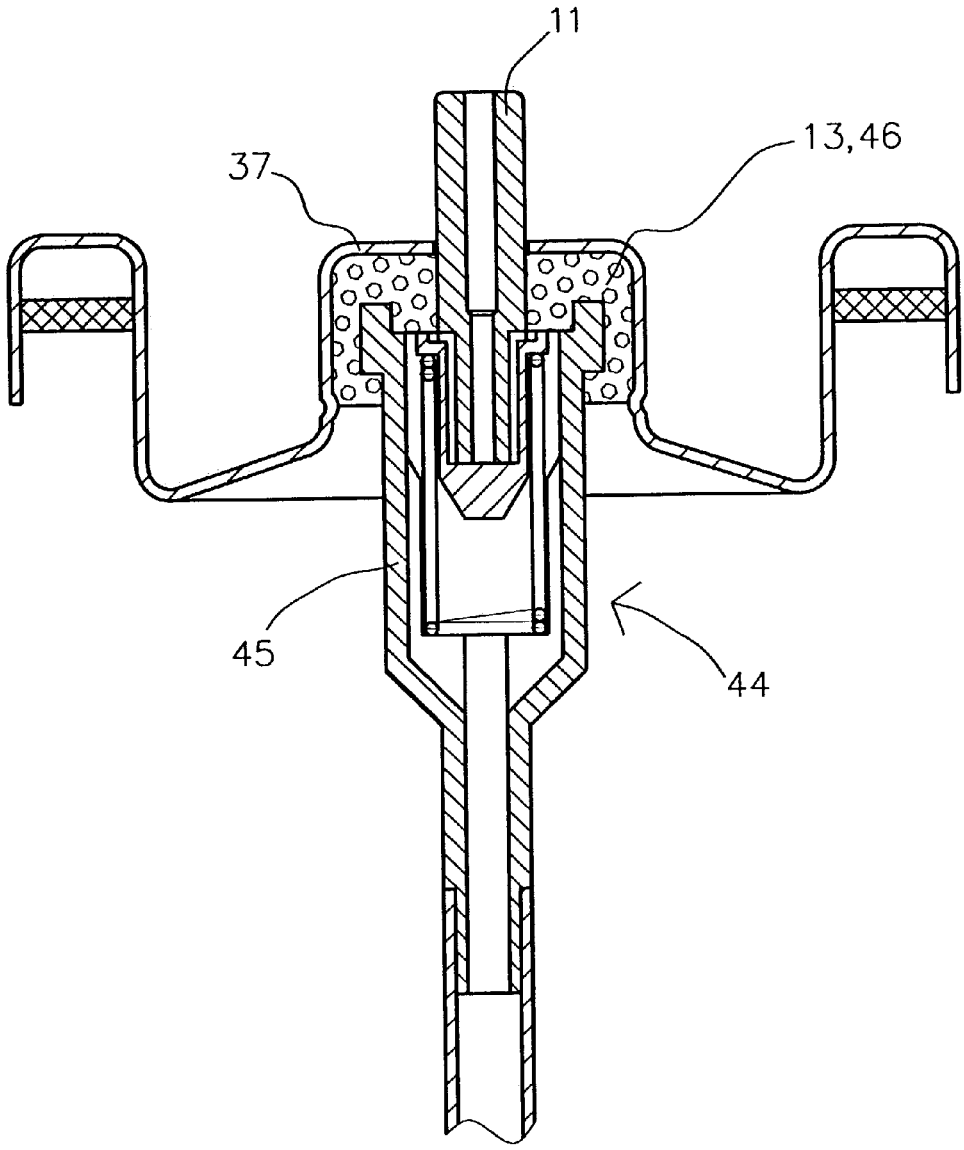
FIG. 32 shows a vertical section through a valve plate and a valve of an aerosol container, in which an acoustic barrier layer is provided between the valve and the valve plate.

In the exemplary embodiment of FIG. 32, a container (not shown) is an aerosol container, which has a valve 44, a valve plate 37, a valve housing 45, and a stem 11. An acoustic barrier layer 46 is provided as a noise damper 13 between the valve 44 and the valve plate 37. A part of the barrier layer 46 acts as a seal between the valve housing 45 and the stem 11. In this way, the valve plate 37 and the valve housing 45 are acoustically decoupled from the valve 44, which causes a damping of the oscillations that would otherwise be transmitted from the valve 44 to the valve plate 37 and therefore to the container. A product discharge is quieter and more pleasant sounding.

Figure 33:
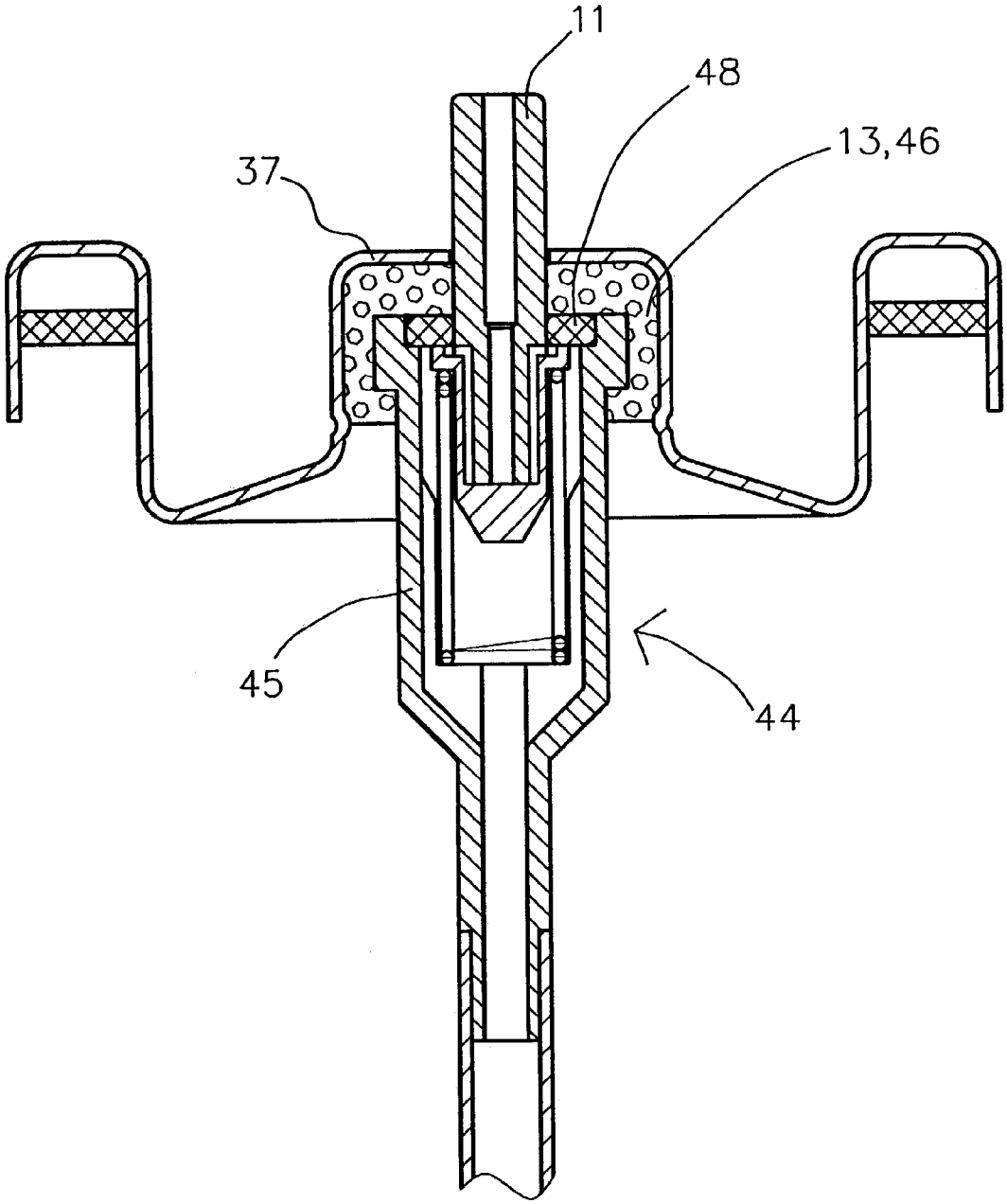
FIG. 33 shows a vertical section through a valve plate and a valve that is similar to that shown in FIG. 32, but with a separate seal between the valve housing and the valve plate.

In the exemplary embodiment of FIG. 33, this is analogously the case, but in contrast to the subject of FIG. 32, in this instance, a separate seal 48 is provided between the stem 11 and the valve housing 45 in order to produce an optimal seal there.

Figure 34:
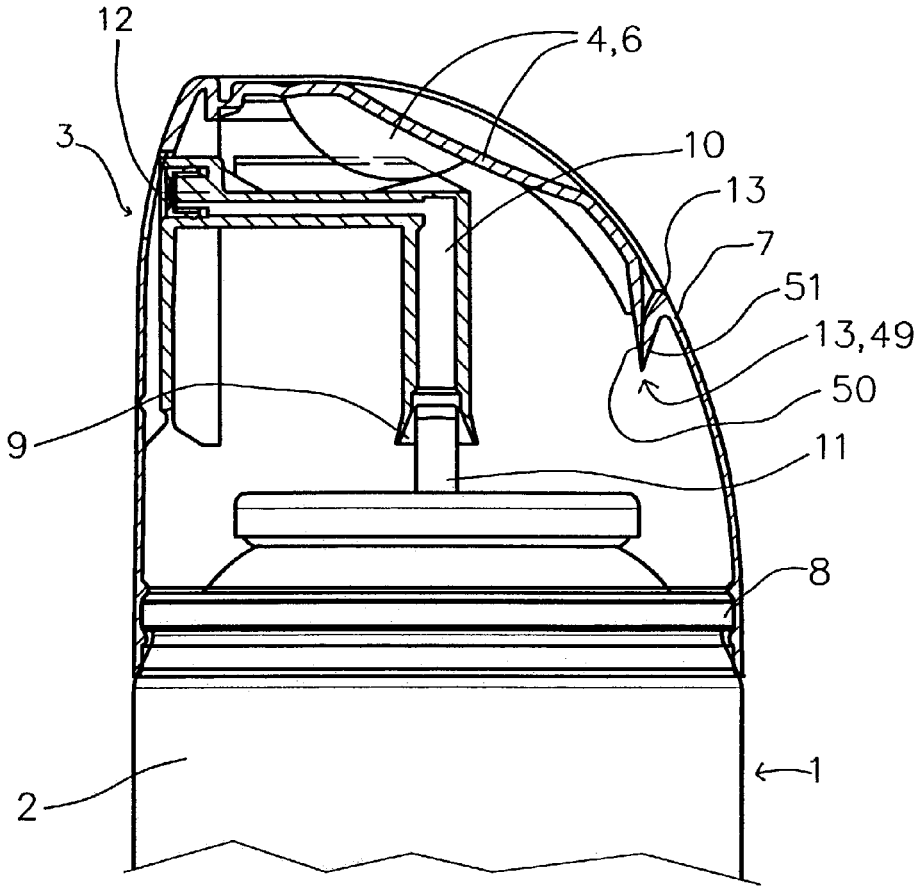
FIG. 34 is a partially vertical cross-sectional, partially side view of an aerosol container with a cap, in which a spray conduit leading to a nozzle is provided, which a button presses against, and with an acoustic seal in the form of sealing lips between the button and the cap.
Figure 35:
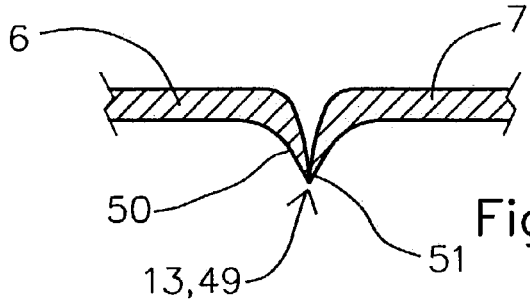
FIG. 35 shows a vertical section through two sealing lips of an acoustic seal when the button is not being activated.
Figure 36:
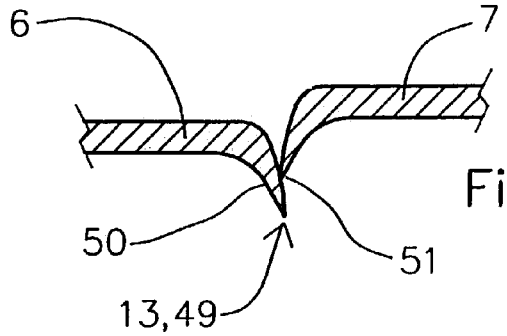
FIG. 36 shows a vertical section through the two sealing lips shown in FIG. 35, but when the button is being activated.

In the exemplary embodiment of FIGS. 34, 35, and 36, in a container 1 with a reservoir 2, a product dispensing opening 3, and a device 4 for discharging the product contained in the reservoir 2 out through the product dispensing opening 3, a noise damper 13 is provided. The noise damper 13 is functionally connected to the device 4 in order to generate a desired sound for a product discharge while the product is being dispensed.

A button 6 in a cap 7 of the container 1 serves as part of the discharge device 4. The cap 7 can be slid onto a rim 8 of the container 1. A recess 9 at the bottom end of a spray conduit 10 receives a stem 11 of the container. The container 1 is an aerosol container. The spray conduit 10 leading to a nozzle 12 is provided in the cap 7 of the container. An acoustic seal 49 between the button 6 and the cap 7 serves as a noise damper 13. Two sealing lips 50, 51 produce the seal 49; one sealing lip 51 is provided on the cap 7 and another sealing lip 50 is provided on the button 6 (FIGS 34 and 35). Even when the button 6 is depressed (FIG. 6), the sealing lips remain in contact with each other and thus seal the interior of the cap 7 in relation to the outside.

Figure 37:
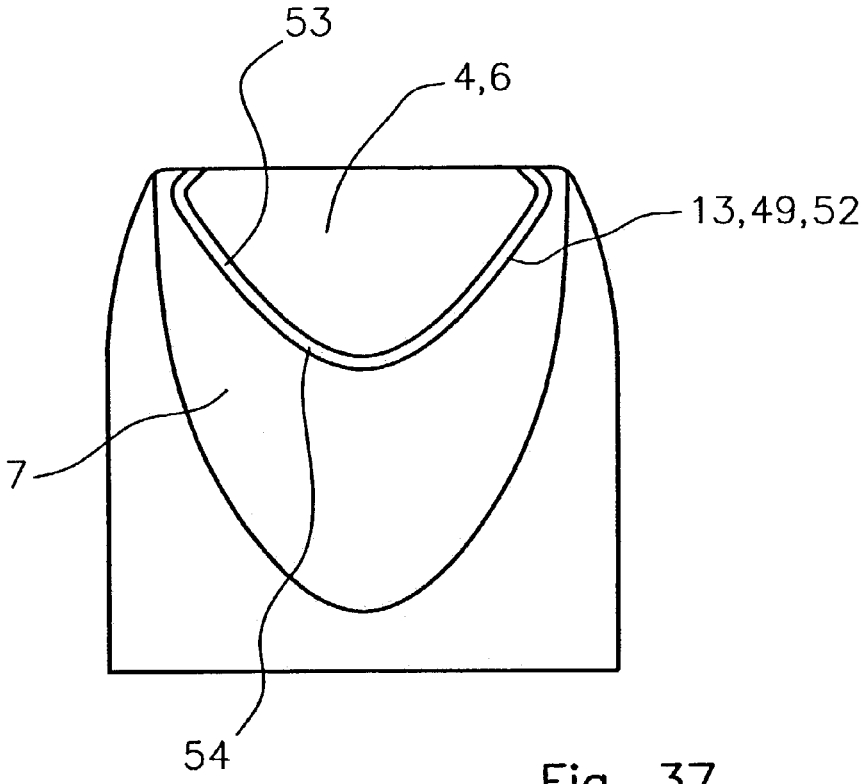
FIG. 37 is side view of a cap for an aerosol container, in which an elastic connection is provided as an acoustic seal between the cap and a button on the cap.
Figure 38:
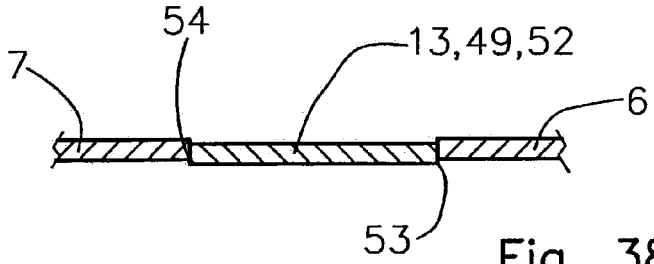
FIG. 38 is a detailed cross-sectional view through the elastic connection shown in FIG. 37 when the button is not being activated.
Figure 39:
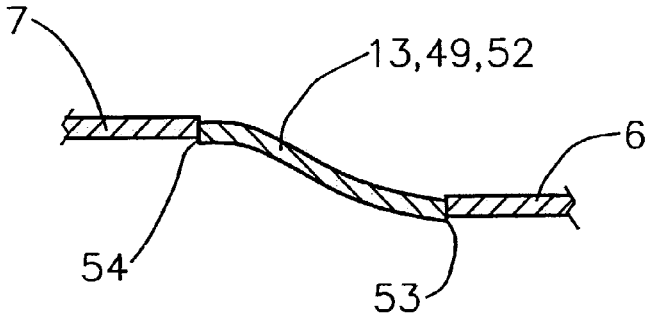
FIG. 39 is a detailed cross-sectional view through the elastic connection shown in FIG. 38, but when the button is being activated.

In the exemplary embodiment of FIGS. 37, 38, and 39, the seal 49 is produced by an elastic connection 52 between the button 6 and the edge region 54 of the cap 7 adjoining the edge 53 of the button 6. The seal is maintained even after the button 6 is depressed (FIG. 39) due to an expansion of the elastic connection 52. If the button 6 is actuated, then a spray conduit is pressed downward along with a stem (not shown) and a valve (not shown) in the container is actuated. The aerosol emerging from the stem flows through the spray conduit and is sprayed out through a nozzle. The action of the noise damper 13 produces a sound that is relatively quiet and, due to the resonances in the cap 7, is also found to be very pleasant when the device 4 is actuated.

Figure 40:
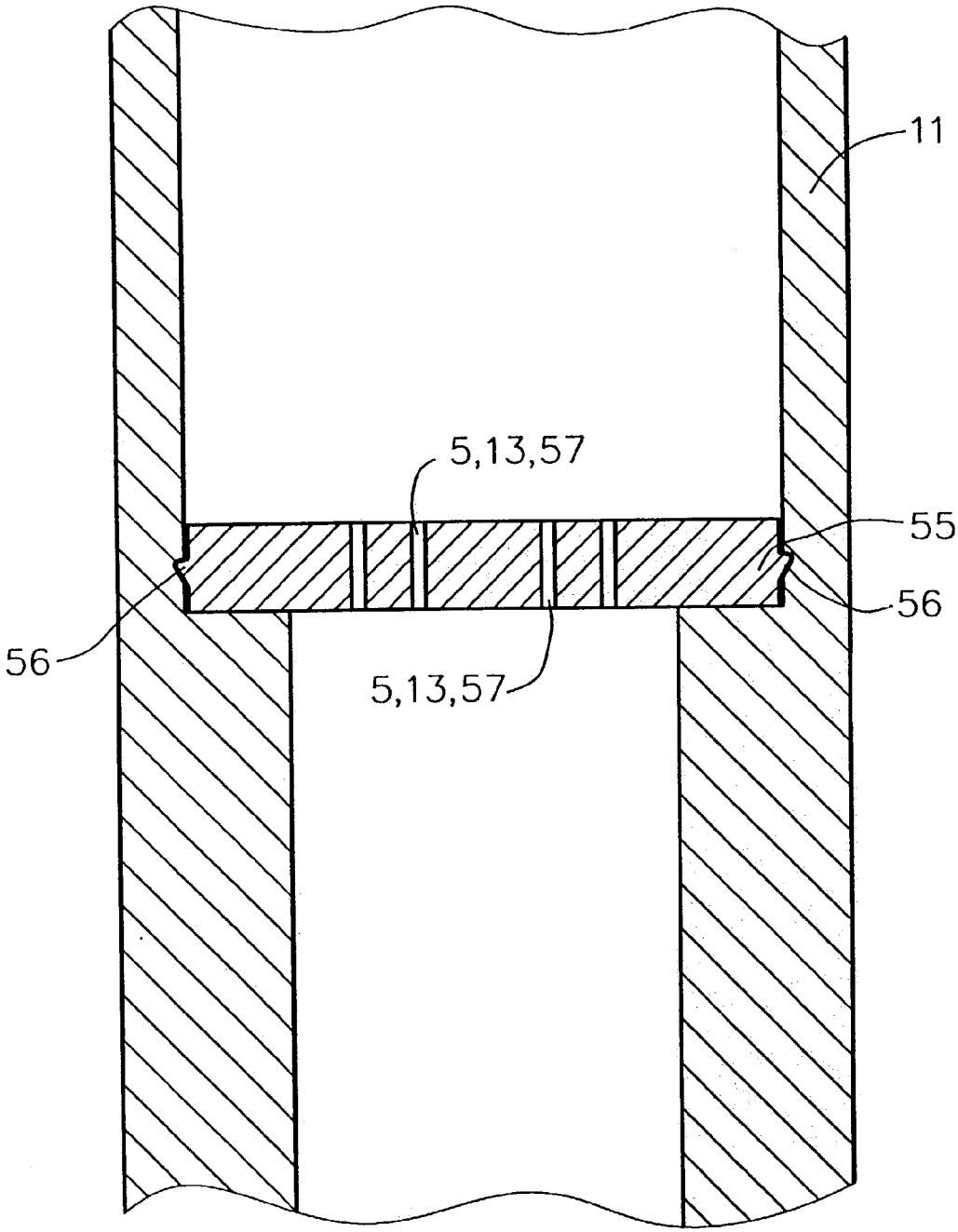
FIG. 40 is a cross-sectional view through a valve stem of an aerosol container in which a perforated disk with conduits is snapped in place by means of a circumferential detent element in order to locally generate a laminar flow in the stem.

In the exemplary embodiment of FIG. 40, a perforated disk 55, which is inserted into a stem 11, is provided as a sound generator 5 for one frequency range and as a noise damper 13 for another frequency range; this perforated disk has a number of conduits 57 and is preferably snapped into the stem by means of a detent element 56. When an aerosol is dispensed, it flows through the conduits 57. A laminar flow takes place in the conduits 57, and is still partially present downstream of the perforated disk 55. This reduction in turbulence results in the fact that individual frequencies are reduced in sound intensity and other frequencies are amplified. By and large, a frequency change is produced, which results in a new sound being produced. This sound is a function of the number and length of the conduits 57 and is generally found to be relatively pleasant.

Figure 41:
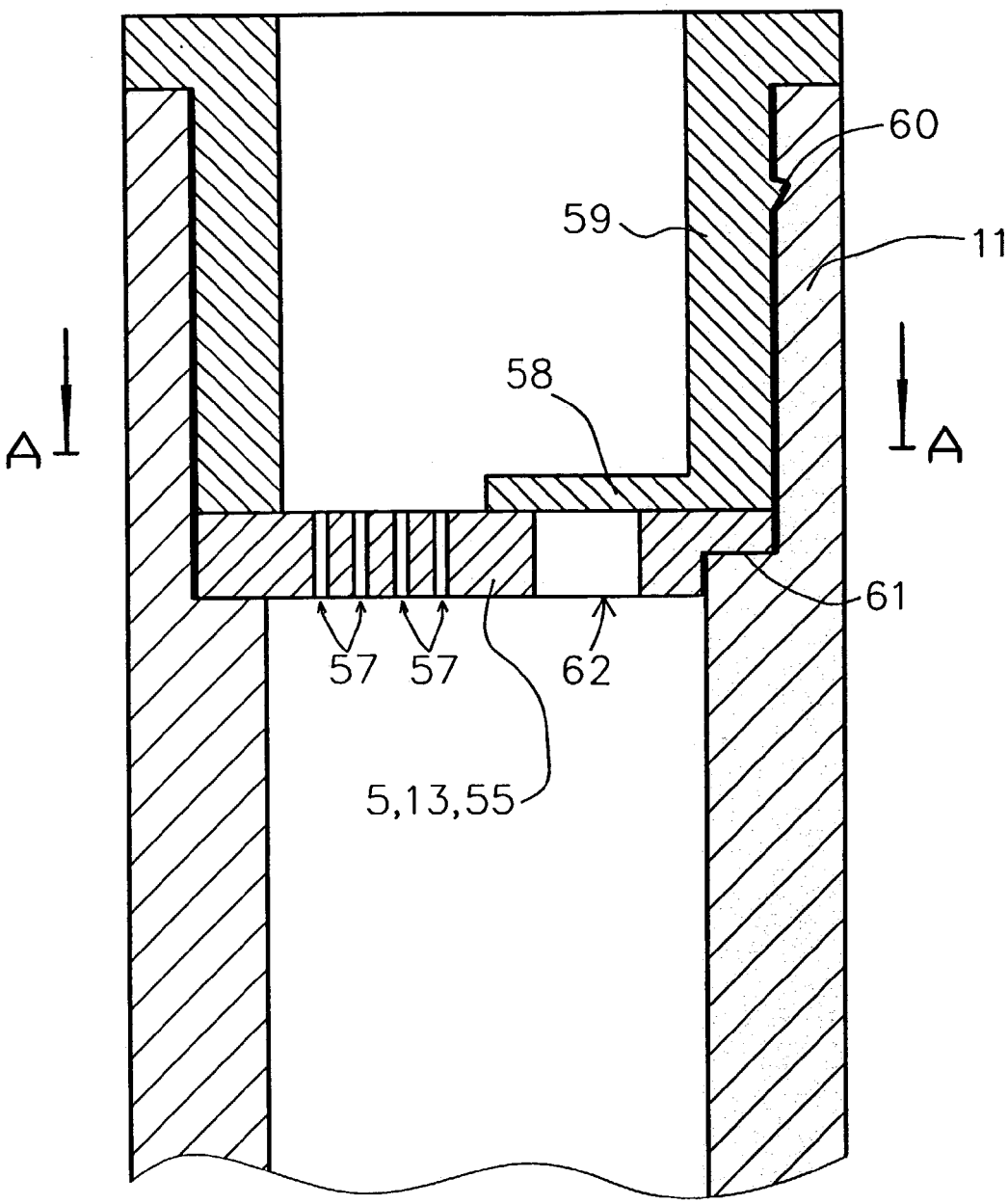
FIG. 41 is a cross-sectional view through a valve stem similar to that shown in FIG. 40, but with a rotationally secured perforated disk, which has a number of conduits in one half and has an opening in another half, with a semi-circular cover, which is connected to a tubular segment inserted into the stem.
Figure 42:
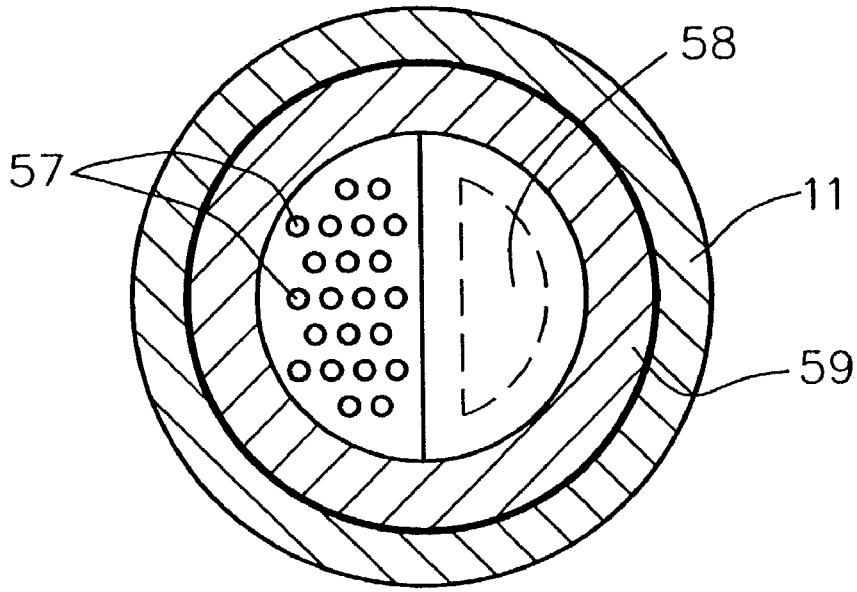
FIG. 42 shows a section along the line A-A in FIG. 41 with the cover covering the opening.
Figure 43:
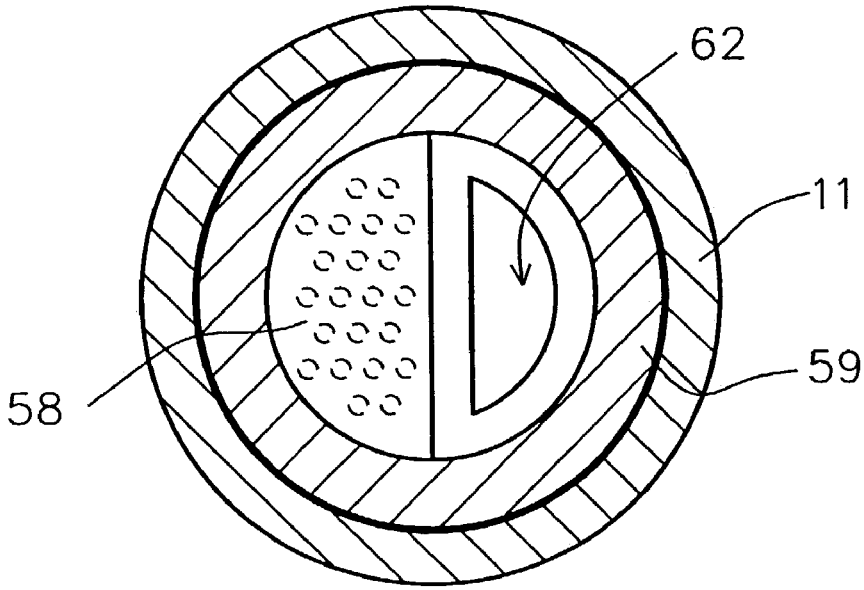
FIG. 43 shows a section along the line A-A in FIG. 41 with the cover rotated by 180 degrees so that the conduits are covered and the opening is unblocked.

In the exemplary embodiment of FIGS. 41 to 43, the perforated disk 55 only has conduits 57 on one half of its disk; a semicircular cover 58 covers the perforated disk 55 that has a reverse-lock 61, and this cover 58 can be rotated in relation to the perforated disk 55 by means of a tubular piece 59, which is inserted into the stem 11, has a stop 60, and is connected to a product dispensing opening, not shown, of the container. In the position that is shown in FIGS. 41 and 42, the cover 58 covers an opening 62 while the conduits 57 are unblocked. An aerosol product consequently flows through the conduits 57 and generates a particular sound, causing the perforated disk 55 to function as a sound generator 5. A different noise, which arises from diverse turbulences, is reduced due to the laminar flow that occurs in the conduits 57. Consequently, the perforated disk 55 also functions as a noise damper 13. By rotating the tubular section 59 by 180 degrees, the cover 58 moves over the conduits 58 (FIG. 43). This unblocks the opening 62. In this rotation position, a different sound is produced when the aerosol flows out, which is connected with a different, more powerful outflow. In a particular rotation position, the stop 60 becomes functional and is correlated with a particular swivel position of a product dispensing opening provided at the upper end of the tubular piece 59 in such a way that the user is informed about a particular outflow behavior depending on the swivel position. Instead of an opening 62, the perforated disk 55 could also have an uninterrupted disk material there. Then the number of conduits 57 that are used would be determined by rotating the tubular piece 59.

Figure 44:
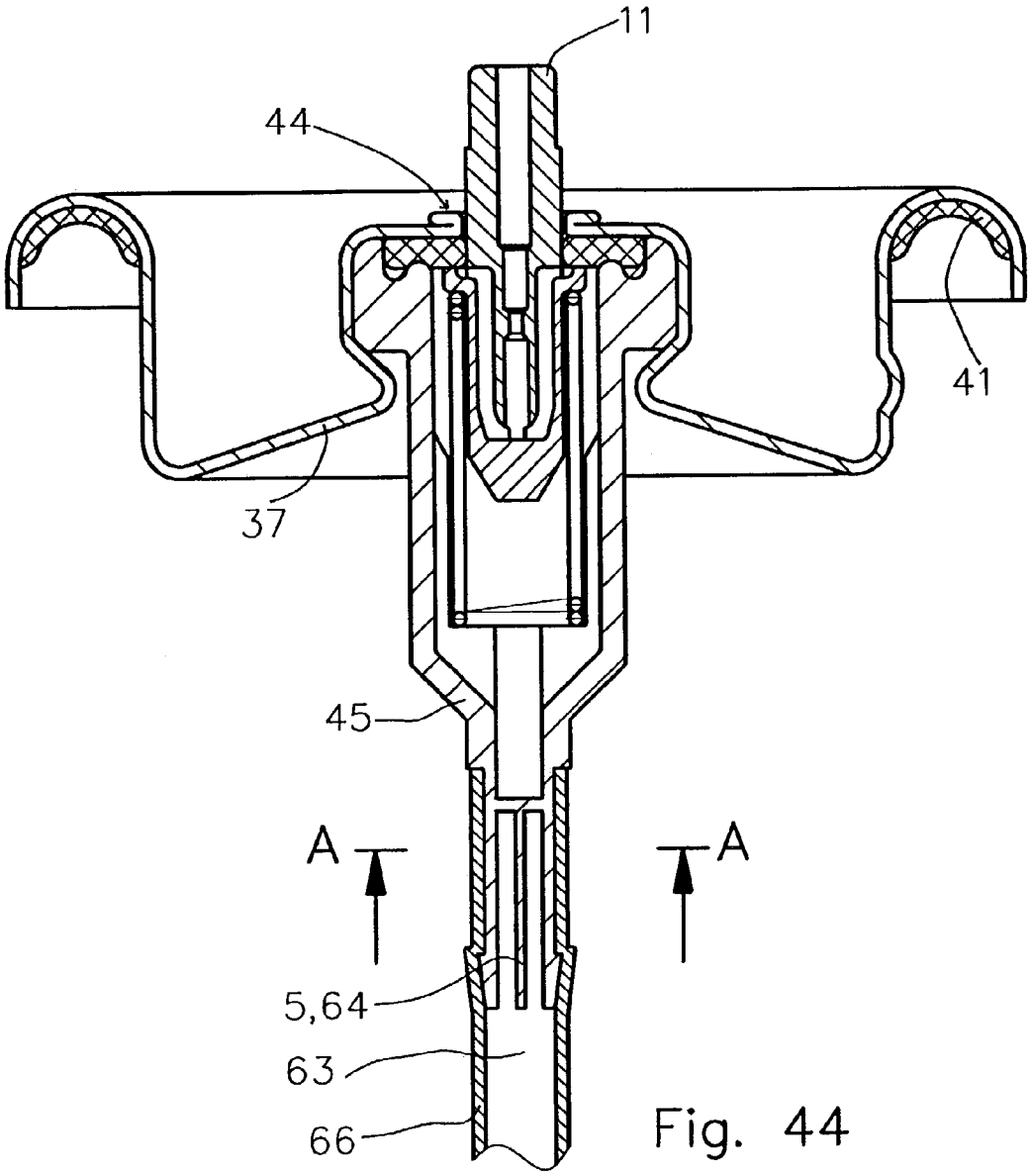
FIG. 44 shows a vertical section through a valve with the valve plate, valve housing, stem, and ascending tube for use in an aerosol container, in which at the lower end of the valve housing, a sounding lip, which is oriented downward in the direction of the flow conduit, is provided in a flow conduit.
Figure 45:
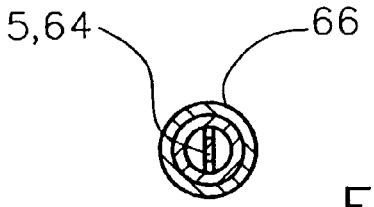
FIG. 45 shows a section along the line A-A in FIG. 44 through the sounding lip of FIG. 44.
Figure 46:
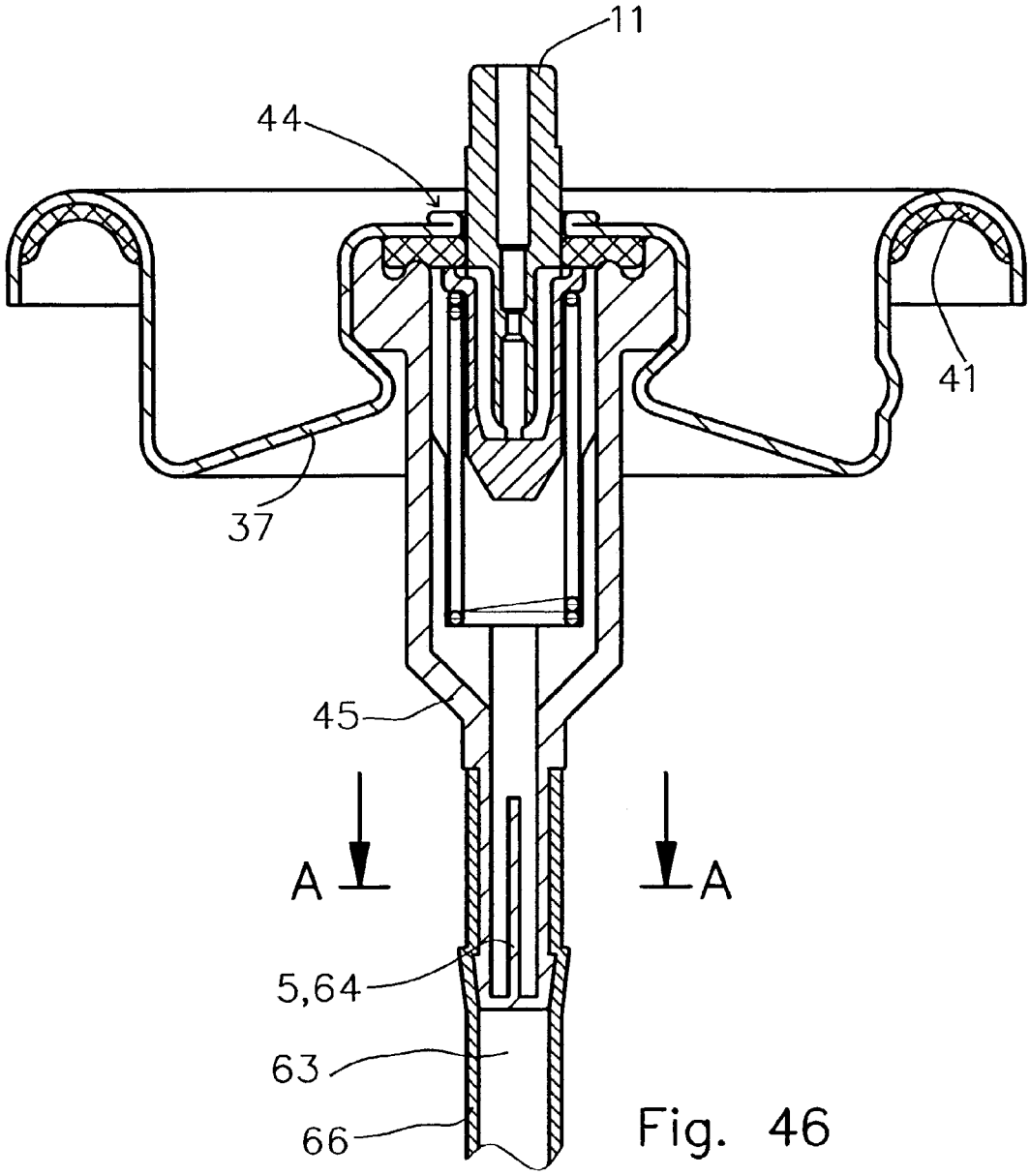
FIG. 46 shows a vertical section through a device similar to that shown in FIG. 44, but with a sounding lip oriented upward.
Figure 47:
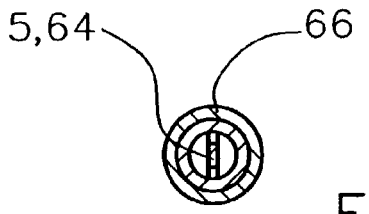
FIG. 47 shows a section taken along the line A-A in FIG. 46 through the sounding lip shown in FIG. 46.

In the exemplary embodiment of FIGS. 44 and 45, a sounding lip 64 inserted into a flow conduit 63 of an aerosol container is provided as a sound generator 5. This sounding lip 64 is of one piece with the lower part of the valve housing 45. Thus a particular tone can be generated by dispensing the product. The sounding lip 64 is set into an oscillation by the outflowing product. Due to the connection to the valve housing 45, the sounding lip 64 can easily be produced along with the valve housing 45. With the proposed disposition of the sounding lip on the bottom part of the valve housing 45, the product is fluid so that an adhesion and therefore a limitation of the function of the sounding lip 64 cannot occur there. A spray head (not shown) of the aerosol container 20 serves as a discharge device and, when pressed downward, causes a valve 44 to open. The product flows around the sounding lip 64 and up through the valve 44 and produces a pleasant sound against the sounding lip 64 while the product is being dispensed. The sounding lip 64 is aligned in the direction of the flow conduit 63. As a result, a relatively large flow cross section is available for the outflowing product so that virtually no influence is exerted on the outflow. The length of the sounding lip 64 is designed for a resonance of a particular frequency and its overtones. Instead of pointing downward, the sounding lip 64 can also point upward (FIGS. 46 and 47).

Figure 48:
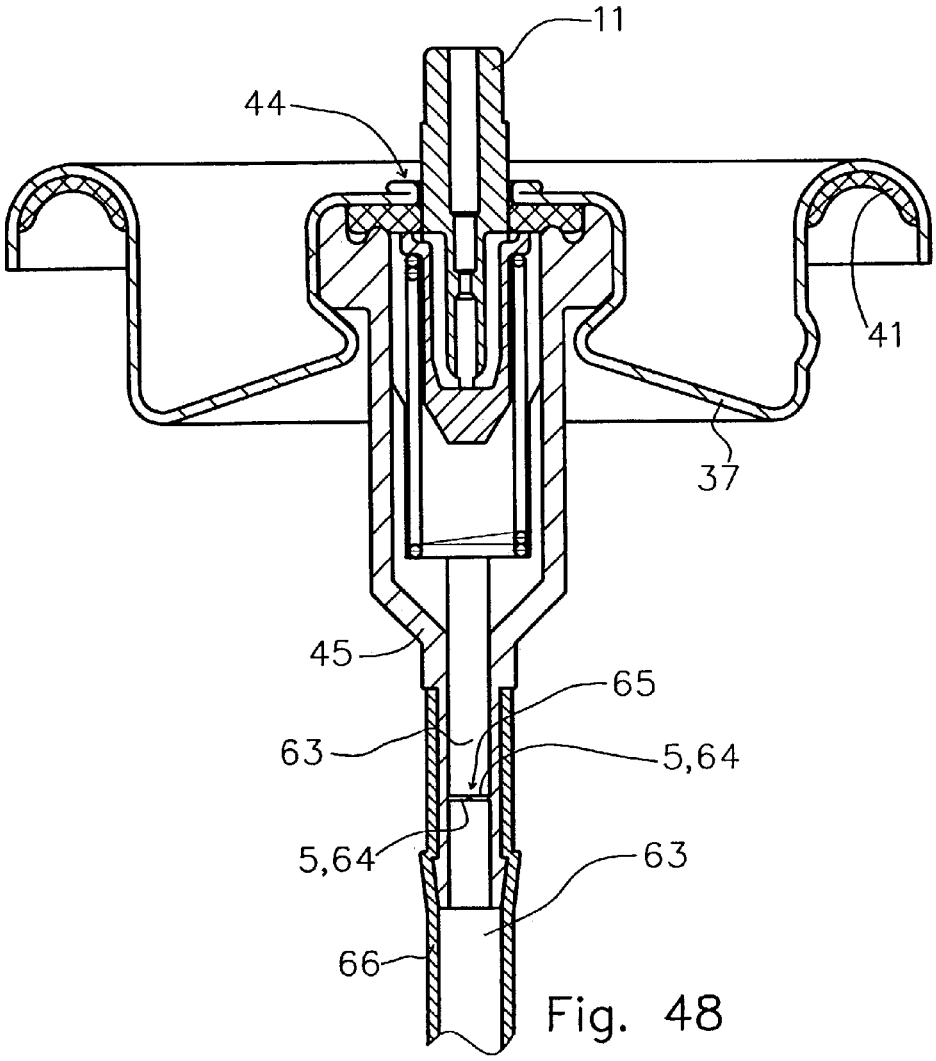
FIG. 48 shows a vertical section through a valve with a valve plate and valve stem similar to that shown in FIG. 44, but with two sounding lips oriented toward each other in the flow conduit.
Figure 49:
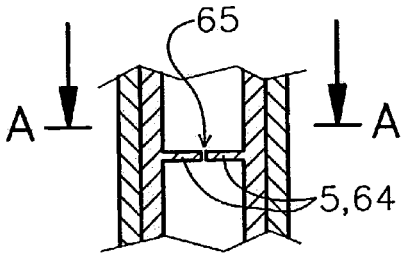
FIG. 49 is a detailed sectional view of the sounding lips shown in FIG. 48.
Figure 50:
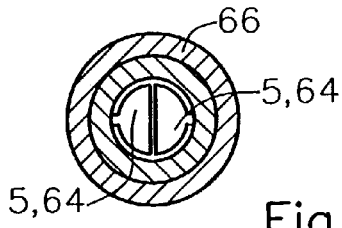
FIG. 50 shows a section taken along the line A-A in FIG. 49 through the device shown in FIG. 49.
Figure 51:
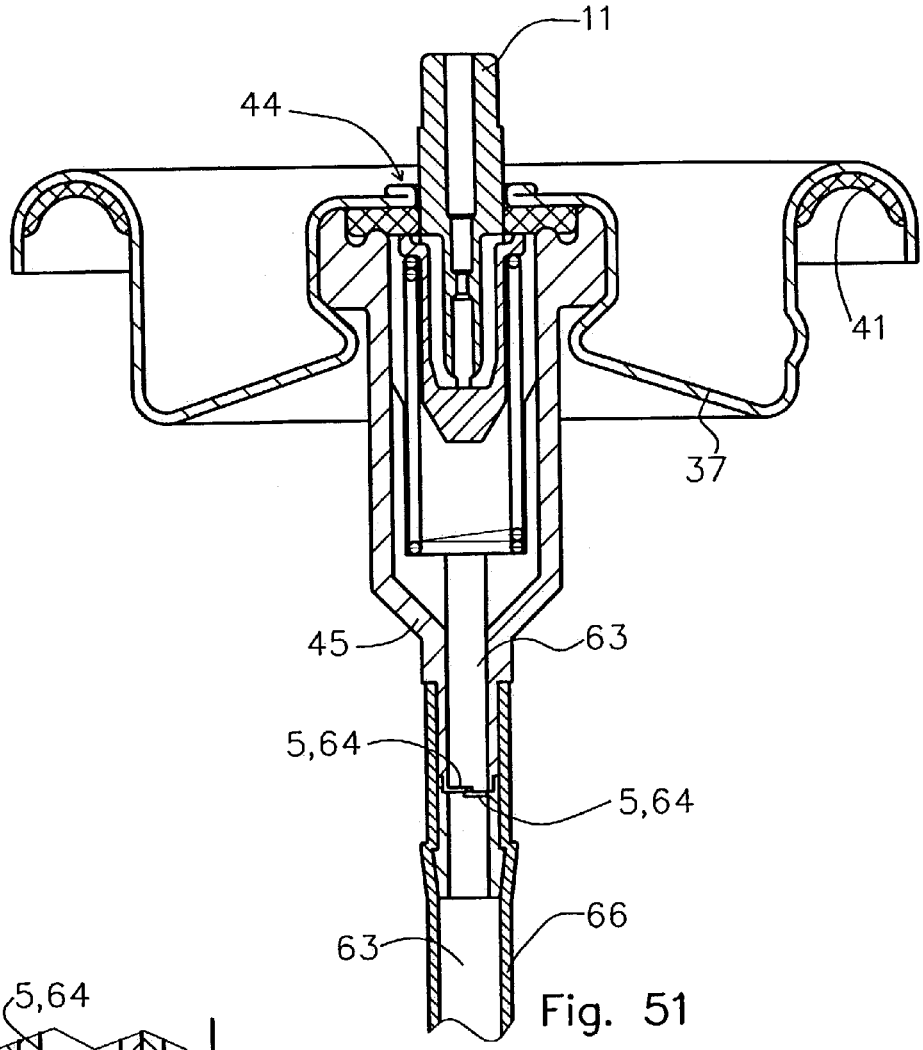
FIG. 51 shows a vertical section through a valve with a valve plate and valve stem similar to that shown in FIG. 48, but with partially overlapping sounding lips.
Figure 52:
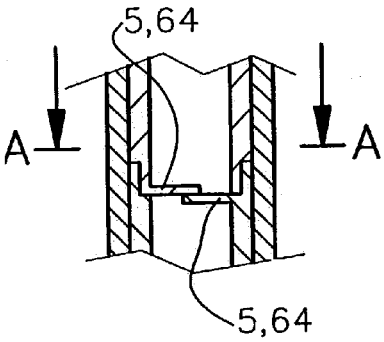
FIG. 52 is a detailed sectional view of the sounding lips of FIG. 51.
Figure 53:
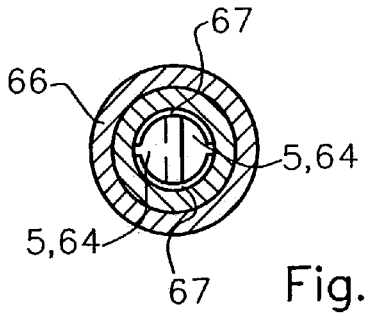
FIG. 53 shows a section taken along the line A-A in FIG. 52 through the device shown in FIG. 52.
Figure 54:
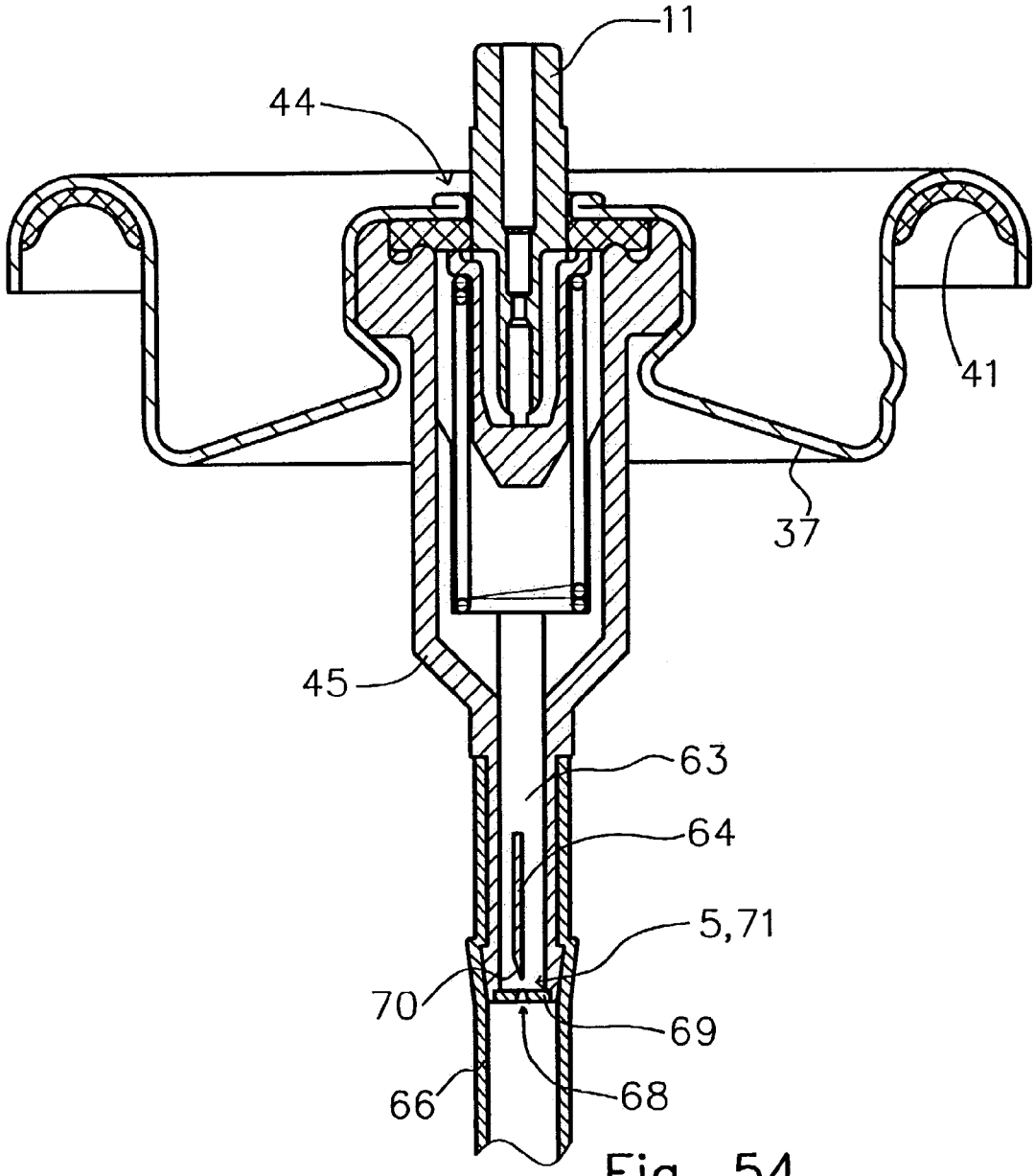
FIG. 54 shows a vertical section through a valve with a valve plate and valve stem similar to that shown in FIG. 44, but with an edge on a lower tip of the sounding lip, which extends to an opening in a separating element in order to thus constitute a labial whistle.
Figure 56:
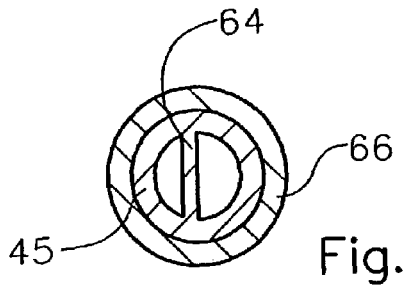
FIG. 56 shows a section taken along the line A-A in FIG. 55 through the whistle shown in FIG. 55.
Figure 55:
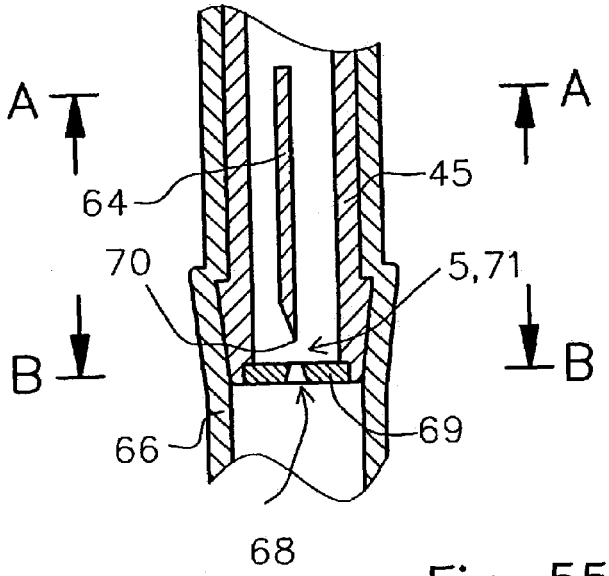
FIG. 55 is a detailed cross-sectional view of the labial whistle shown in FIG. 54.
Figure 57:
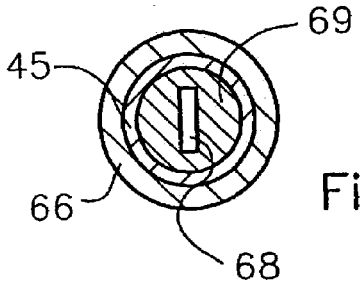
FIG. 57 shows a section taken along the line B-B in FIG. 55 through the whistle shown in FIG. 55.

In the exemplary embodiment of FIGS. 48, 49, and 50, two sounding lips 64 are provided, which are aligned perpendicular to the direction of the flow conduit 63 and are aligned in relation to each other in such a way that a gap 65 is formed between them. As a result, a relatively intense tone can be generated. Alternatively, the sounding lips 65 can also overlap (FIGS. 51, 52, and 53), which can produce an even greater sound intensity. In these two exemplary embodiments, a relatively narrow opening, through which the product must flow, is produced in the flow conduit 63. On the one hand, the opening is produced by the gap 65 (FIG. 49) and on the other hand, the opening is produced by the fact that the overlapping sounding lips are pivoted upward and therefore pressed away from each other (FIG. 52). Recesses 67 at the edge of the sounding lips 65 (FIG. 53) permit the sounding lips 65 to pivot in the flow conduit 63. The portion of the product flowing through the recesses 67 produces a different tone there. Therefore a sound is produced which on the one hand, depends on the vibration of the sounding lips 65 and their distance from each other and on the other hand, depends on the size of the recesses 67. This sound is also found to be relatively pleasant.

A vertical sounding lip 64 can be used as a sound generator 5 (FIG. 44), for example for hairspray that produces a normal hold of the hair. By contrast, sounding lips 64 in FIGS. 49 and 52 can be used as sound generators 5 in hairspray for extra hold and super hold. The user is therefore signaled as to which kind hairspray is being sprayed by the tone of the product dispensing sound.

In the exemplary embodiment of FIGS. 54 to 57, when dispensing the product from an aerosol container, a very special whistling tone is produced. An opening 68 of a separating element 69 is provided upstream of the sounding lip 64 and one edge 70 of the sounding lip 64 forms a labial whistle 71 with the opening 68. The labial whistle 71 is embodied so that the edge 70 is disposed relatively close to the opening 68. The frequency of the tone produced can be changed by altering the gap width of the opening 68 or the distance of the edge 70 from the opening 68. The tone is adjusted so that it is found to be pleasant by the user when dispensing the product. The conditions shown in FIGS. 54 to 57 produce a relatively rich tone in the mid frequency range. The sounding lip 64 could also have a gap that divides it completely from top to bottom. Then the first tone would sound along with a second tone, which would produce a different, relatively pleasant acoustic pattern.

Figure 58:
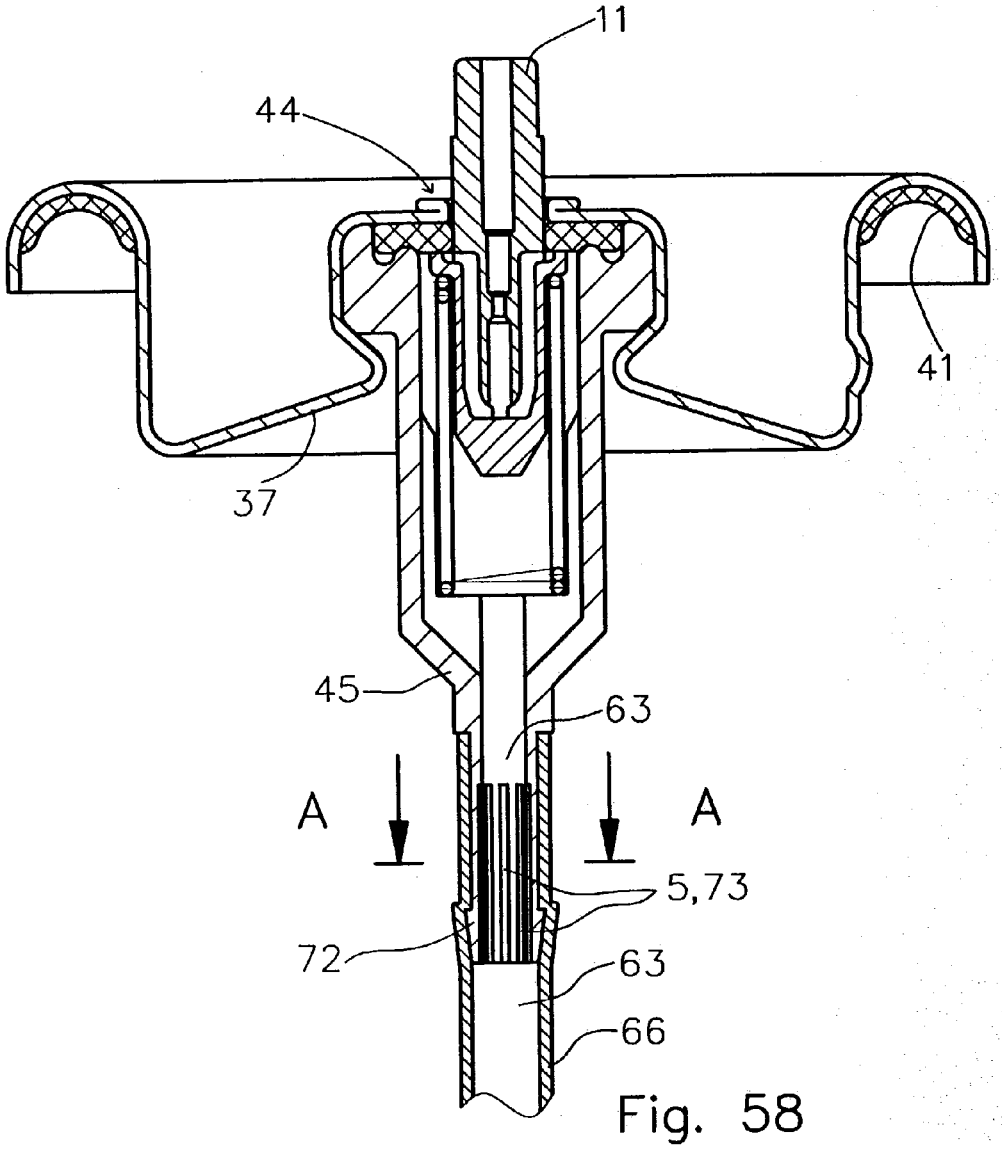
FIG. 58 shows a vertical section through a valve with the valve plate, valve housing, stem, and ascending tube for use in an aerosol container in which an attachment of the valve housing is provided with a number of grooves that adjoin a flow conduit.
Figure 59:
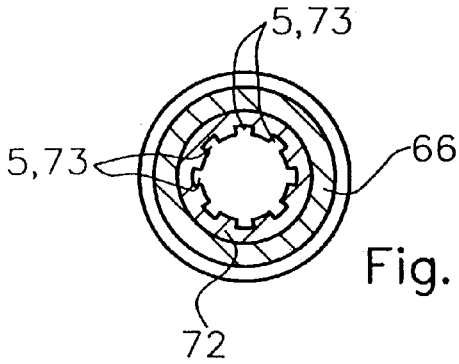
FIG. 59 shows a section taken along the line A-A in FIG. 58 through the enlarged region of the grooves in FIG. 58.

In the exemplary embodiment of FIGS. 58 and 59, a number of grooves 73 extending in the flow direction and adjoining the flow conduit 63 are provided simultaneously as noise dampers 13 and as sound generators 5. The flow conduit 63 is used for a discharge of the aerosol product through the flow conduit 63 when the stem 11 of the valve 44 of the container 1 is tilted. These grooves 73 are preferably embodied as recesses in an attachment 72 of a valve housing 45 of a valve 44. The turbulences in this region of the flow conduit 63 can therefore be reduced. Eliminating these turbulences damps the frequencies that are produced by these turbulences of the outflowing aerosol product. At the same time, the grooves 73 generate a different tone. This frequency change is found to be relatively pleasant. The corresponding sound is influenced by the length, width, and depth of the grooves 73, as well as by the number of grooves 73. The grooves 73 could also be disposed somewhat higher and could be provided inside the ascending tube 66 or inside the stem 11. They always perform the same function, but have a different effect on the product dispensing sound depending on their precise location.

Figure 60:
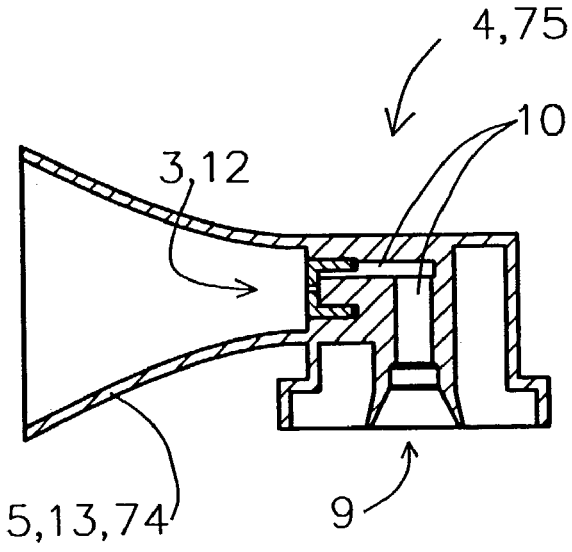
FIG. 60 is a partially vertical cross-sectional, partially side view of an aerosol container, whose stem has a top with a spray conduit, a nozzle, and a funnel-shaped speaker.
Figure 60:
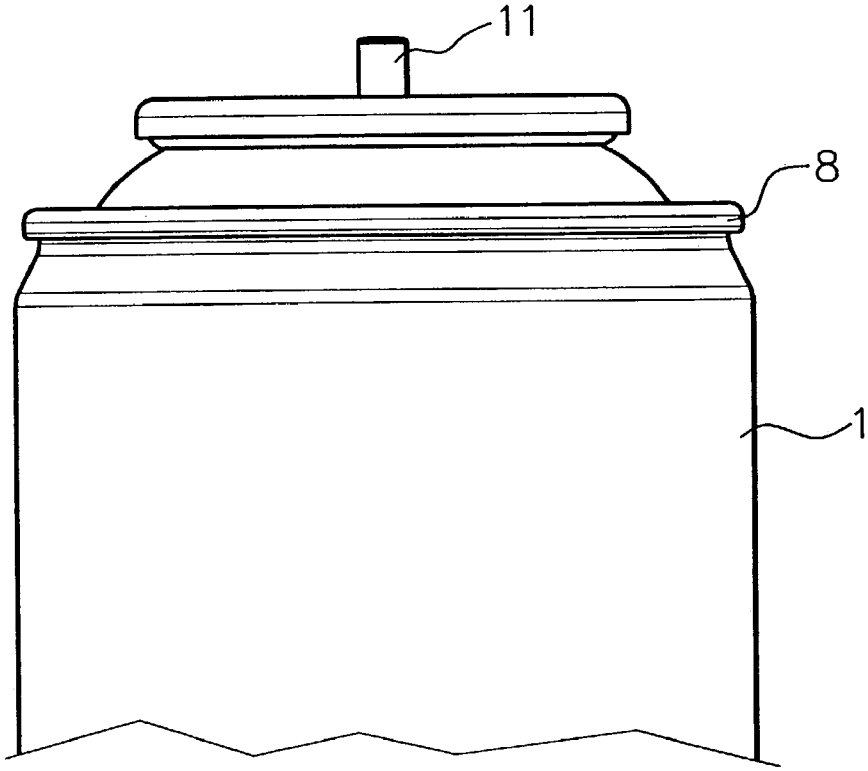

In the exemplary embodiment of FIG. 60, a funnel-shaped speaker 74 is provided both as a sound generator 5 and as a noise damper 13, which speaker adjoins a product dispensing opening 3 of the container 1 embodied in the form of a nozzle 12. The speaker 74 has a diameter that increases as it extends away from the nozzle 12. In the same way as in a megaphone, the sound while dispensing the product is altered and simultaneously amplified. The spray cone emerging from the nozzle 12 has a sufficient amount of clearance in the speaker 74. The top 75 is slid with its recess 9 onto the stem 11 of the container 11. If the top 75 is pressed downward, then an aerosol flows out through the stem 11, the spray conduit 10, the nozzle 12, and the speaker 74 and, through frequency shifting and sound amplification, produces a pleasant sound in the speaker 74. The top 75 in this instance is used as a discharge device 4.

Figure 61:
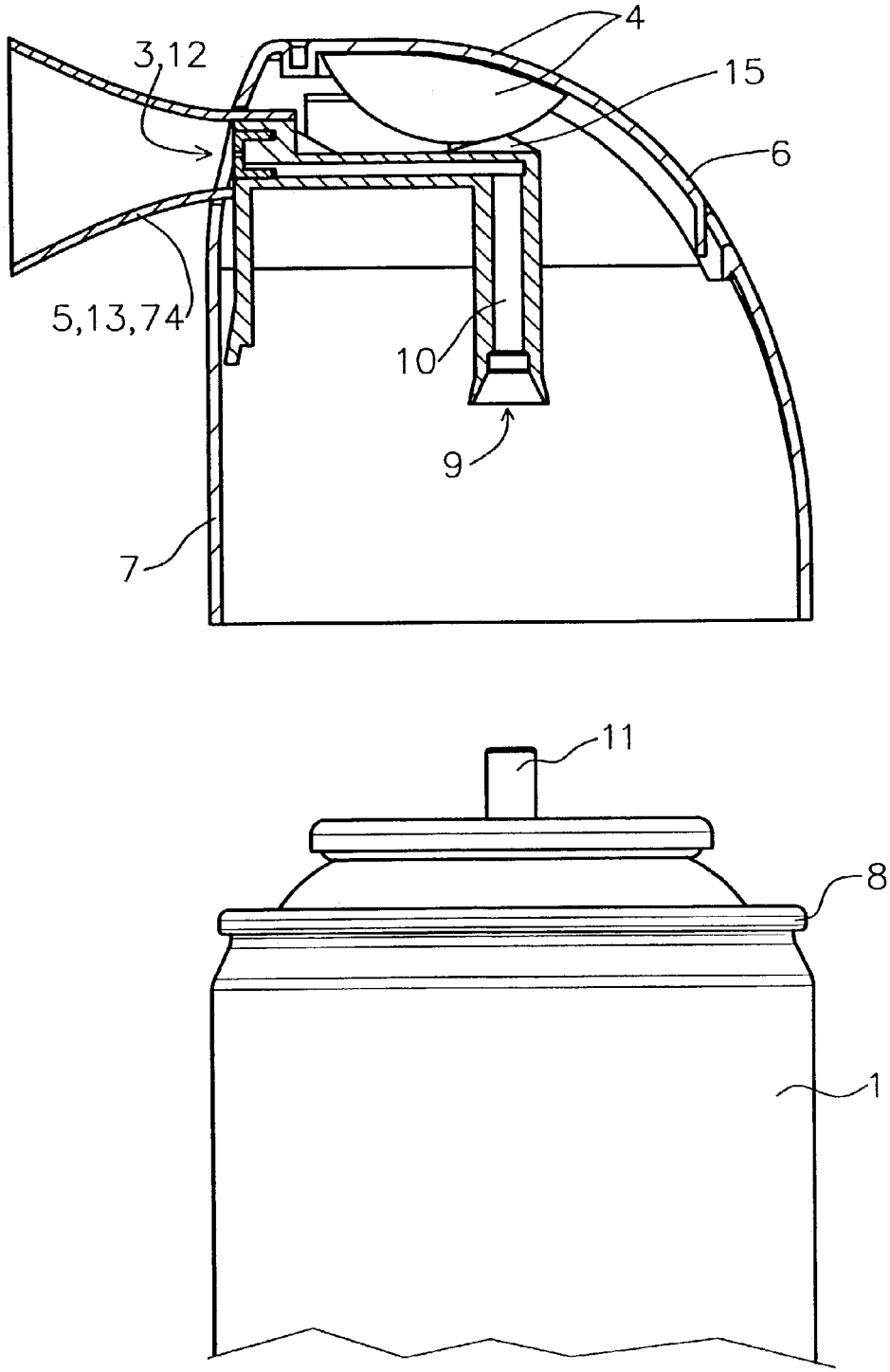
FIG. 61 is a partially vertical cross-sectional, partially side view of an aerosol container similar to that shown in FIG. 60, but with a top embodied as a cap.
Figure 62:
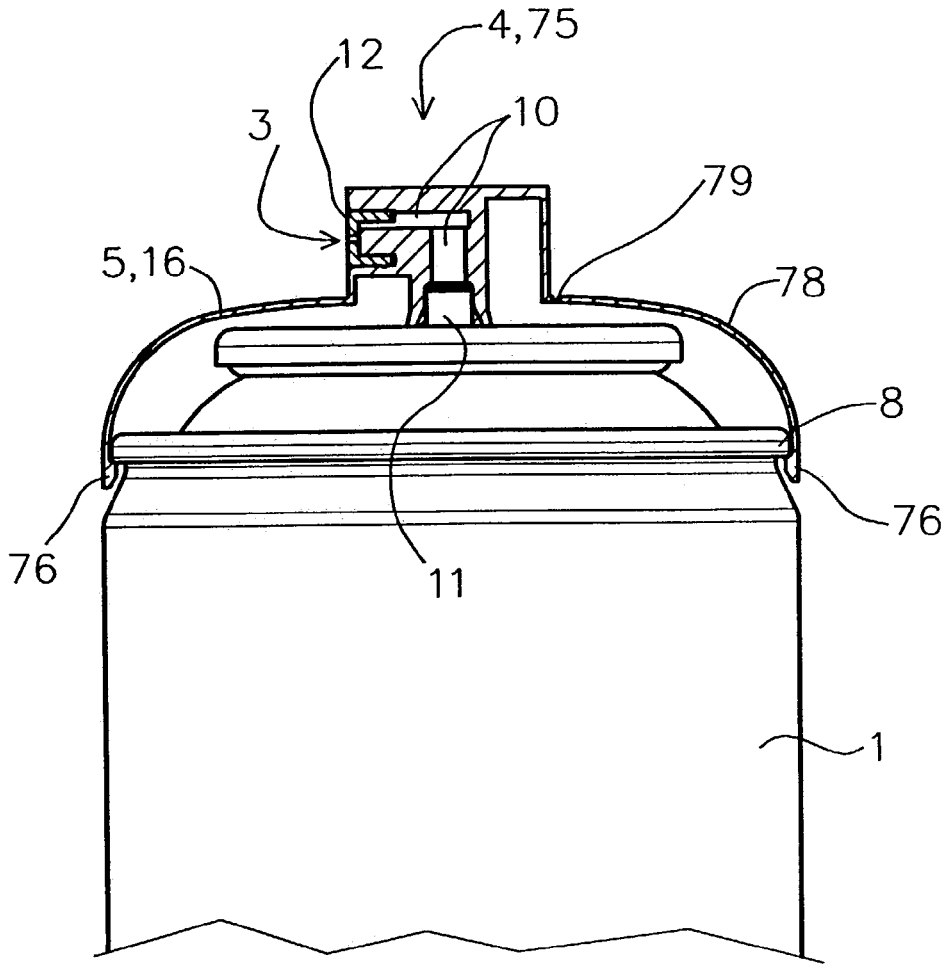
FIG. 62 is a vertical cross-sectional view through an aerosol container with a top slid onto it, in which a sounding rib is clamped between the top and an upper rim of the container.
Figure 63:
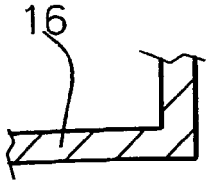
FIG. 63 is a detailed sectional view of the connection of the sounding rib in FIG. 62 to the top.
Figure 64:
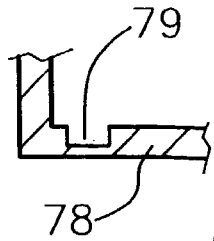
FIG. 64 is another detailed sectional view of a weakened section in the top shown in FIG. 62.

In the exemplary embodiment of FIG. 61, a button 6 of a cap 7 that can be slid 5 onto a container 1 is provided as part of the discharge device 4. The button 6 acts mechanically on the wall 15 of the spray conduit 10. The wall 15 in turn acts mechanically on a stem 11 of the container 1. When the button 6 is depressed, a valve (not shown) disposed underneath the stem 11 is opened so that the product is sprayed out through the spray conduit 10 and a nozzle 12. In the same way as in the exemplary embodiment of FIG. 60, a speaker 74 functions both as a noise damper 13 and as a sound generator 5.

Figure 65:
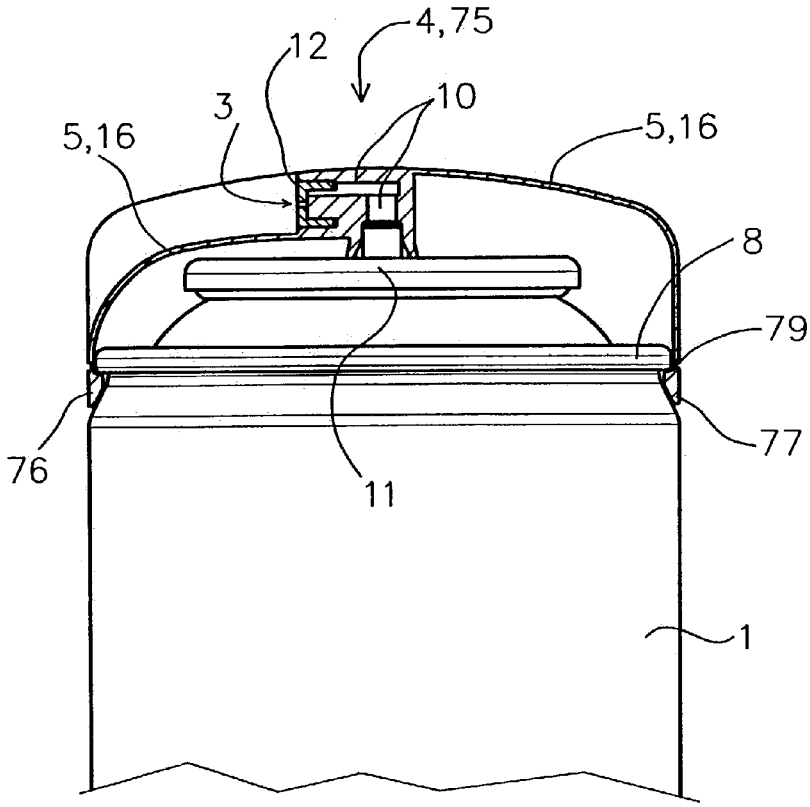
FIG. 65 is a vertical cross-sectional view through an aerosol container with a top similar to that shown in FIG. 62, but with two sounding ribs and with a tear-off ring underneath the sounding ribs.
Figure 66:
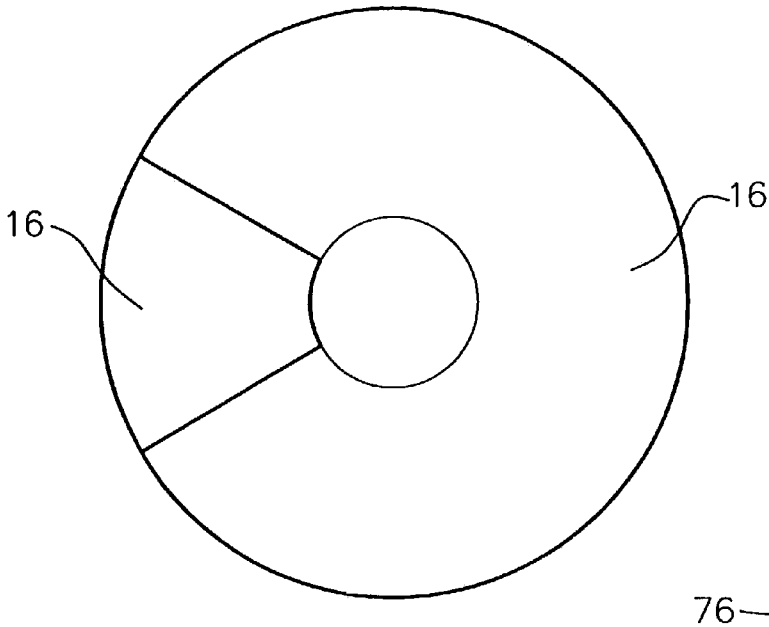
FIG. 66 is a top plan view of the container shown in FIG. 65.
Figure 67:
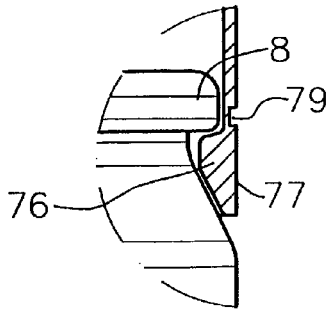
FIG. 67 is a detailed cutaway cross-sectional view of the connection between a sounding rib and the tear-off ring in the container shown in FIG. 65.

In the exemplary embodiment of FIGS. 65 to 67, a sounding rib 16 is provided as a sound generator 5, which is connected on the one hand to a top 75 slid onto a stem 11 of a container 1 filled with aerosol and on the other hand, rests against a rim of the container 1. The sounding rib 16 engages underneath the rim 8 by means of a bead 76 and is therefore relatively rigidly affixed. A tear-off element 78 can be bent at a weakened line 79 and thus removed from the top 75. A user can alternatively produce a simple or a modified sound with or without the tear-off element.

In the exemplary embodiment of FIGS. 65 to 67, a tear-off ring 77, which engages underneath the rim 8 of the container and is connected to two sounding ribs 16 by means of a weakened line 79, is provided on the container 1 in a modified manner. First, the tear-off ring 77 that is provided for transport purposes, is removed, by breaking along the weakened line 79. Then the top 75, which functions as a discharge device 4, is depressed. The product flowing out through the stem 11, the spray conduit 10, and the nozzle 12 generates a tone, which excites the two unevenly sized sounding ribs 16 to oscillate (FIG. 66). This produces a dual tone, which is found to be pleasant.

Figure 68:
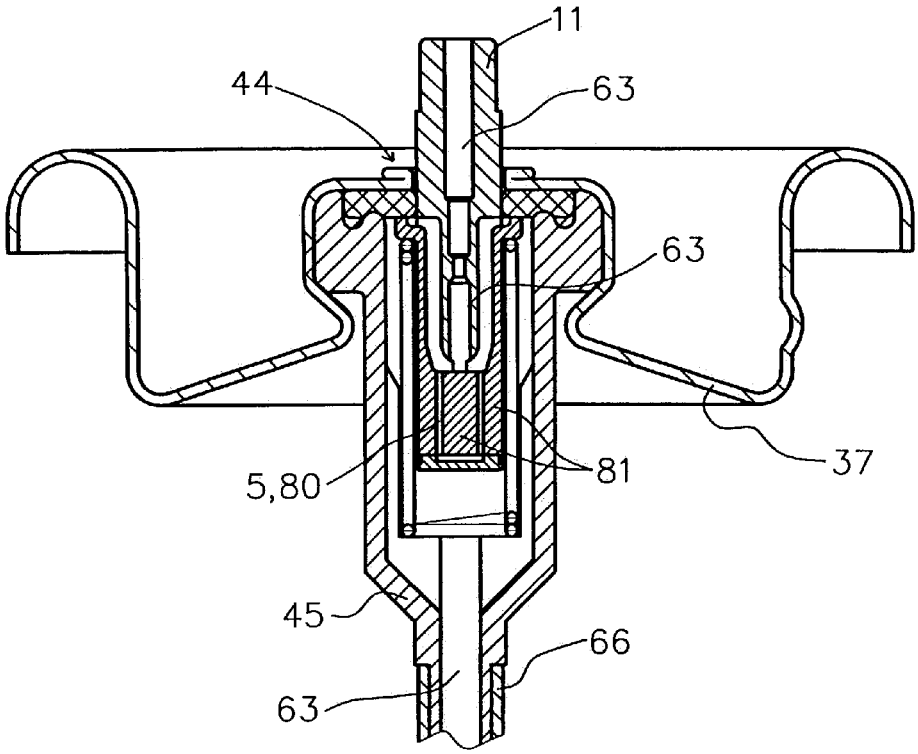
FIG. 68 is a vertical cross-sectional view through a valve of an aerosol container, with the stem and the valve plate, in which a flow loop is provided in the valve body.
Figure 69:
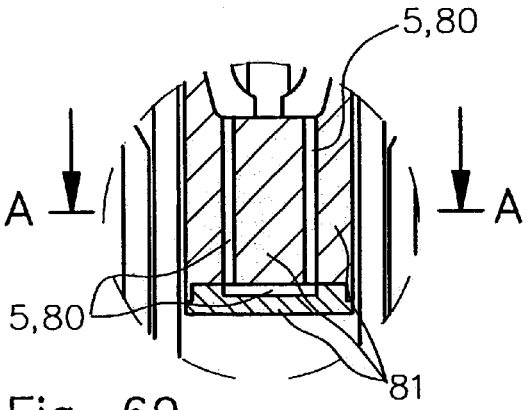
FIG. 69 is a detailed cutaway cross-sectional view of the sound generator in the device shown in FIG. 68.
Figure 70:
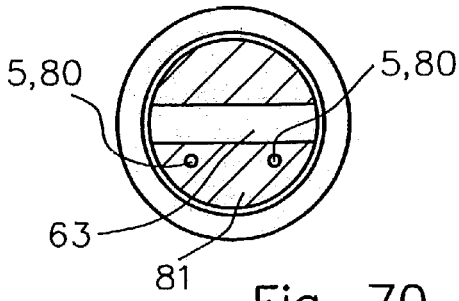
FIG. 70 is a detailed cross-sectional view taken along the section line A-A in FIG. 69.

In the exemplary embodiment of FIGS. 68 to 70, a flow loop, which is embodied as a conduit, is provided as a sound generator 5 for an aerosol container. The flow loop 80 is disposed in the valve body 81 of the valve 44. By tilting the stem 11, the valve 44 is opened and an aerosol product flows out through the flow conduit 63. Due to flow turbulences before entry into the stem 11, a relatively small portion of the product flow travels into the flow loop 80 and generates a resonance oscillation there. The expansion of the fluid propellant into its gaseous phase that occurs at the entry into the flow loop 80 is converted to pressure in the flow loop 80 and thus produces an additional should while the product is being dispensed.

Figure 71:
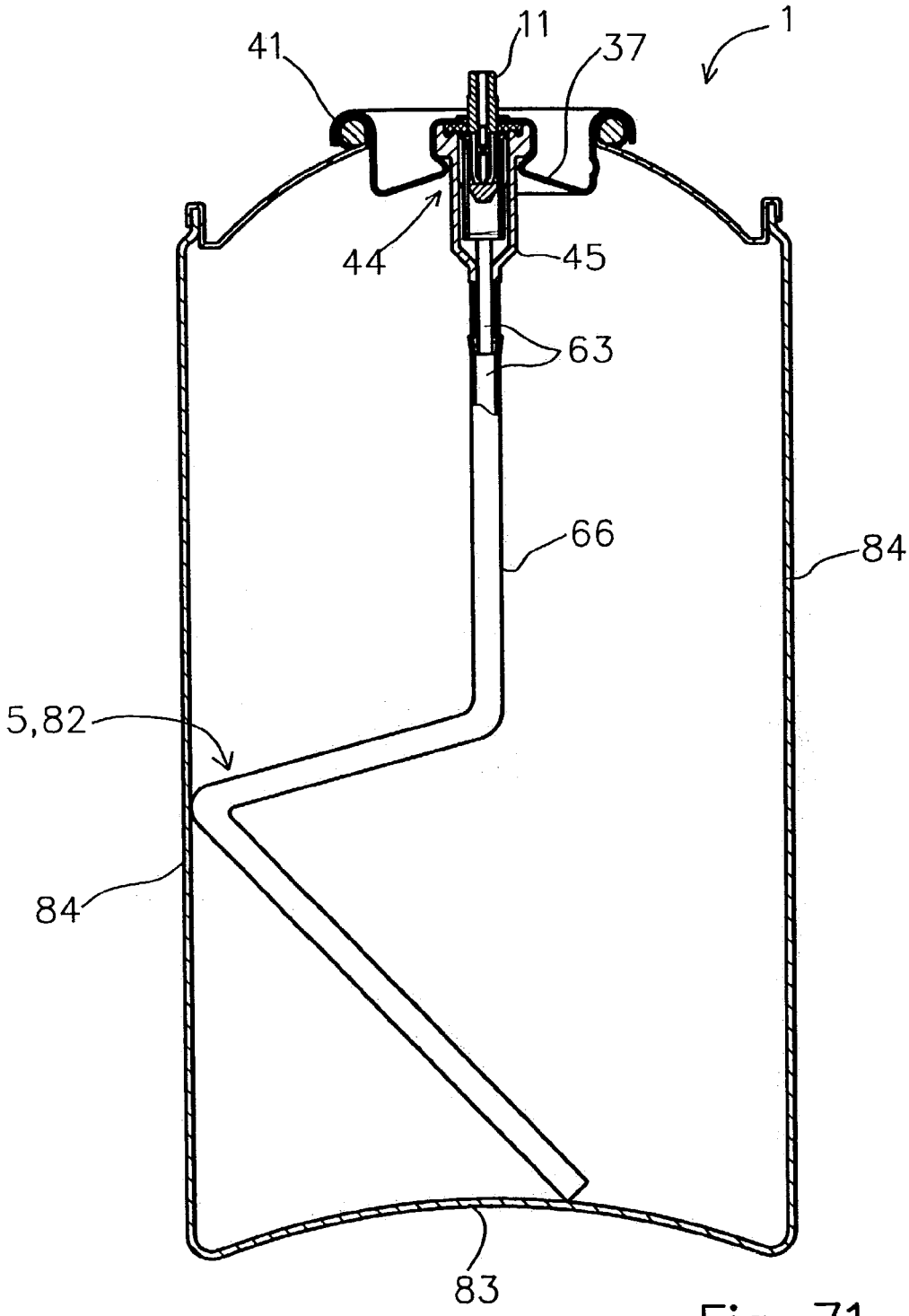
FIG. 71 is a vertical cross-sectional view of an aerosol container, which has a valve with an ascending tube, which has an extension that functions as a sound generator and rests against the bottom wall and the side wall of the container.
Figure 72:
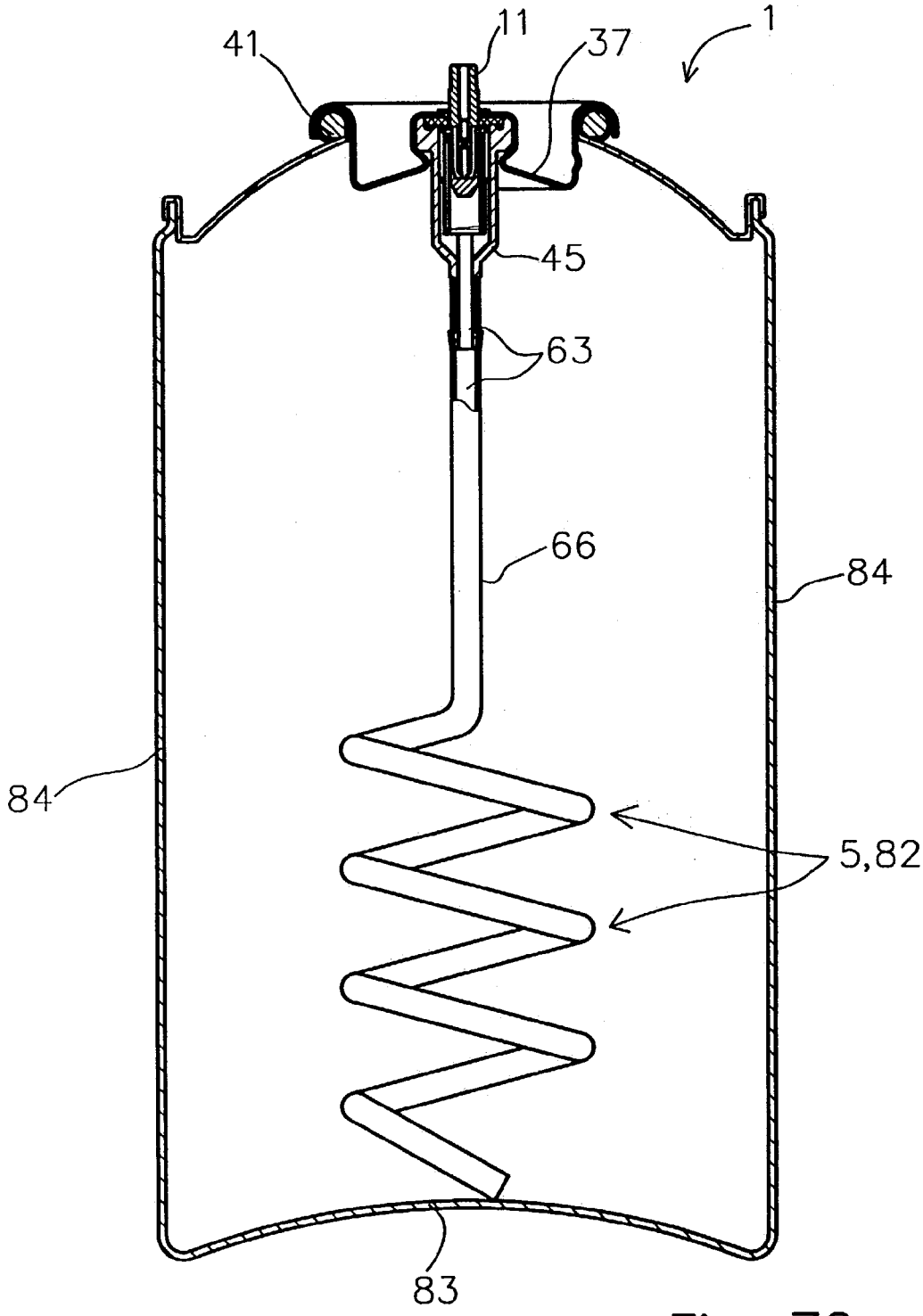
FIG. 72 is a vertical cross-sectional view of an aerosol container similar to that shown in FIG. 71, but with a spiral-shaped extension that rests against only the bottom wall.

In the exemplary embodiments of FIGS. 71 and 72, the container 1 is an aerosol container, which has an ascending tube 66 leading to a valve 44. The ascending tube 66 has an extension 82 that functions as a sound generator 5. The extension 82 rests either against only the bottom wall 83 (FIG. 72) or against both the bottom wall 83 and the side wall 84 of the container (FIG. 71). The flow sound of the aerosol in the ascending tube 45 is amplified on the one hand in the extension 82. On the other hand, this amplified sound is transmitted to a container wall so that the container wall serves as a resonator. The sound generated consequently depends on the dimensions of the walls and produces a slightly deeper, relatively pleasant sound while the product is being dispensed, particularly in aluminum containers. In the exemplary embodiment of FIG. 71, because of the two transmission points for the ascending tube 66, an amplitude shift occurs between a stationary wave in the side wall on the one hand and a stationary wave in the bottom wall on the other. This also advantageously changes the acoustic pattern.

Figure 73:
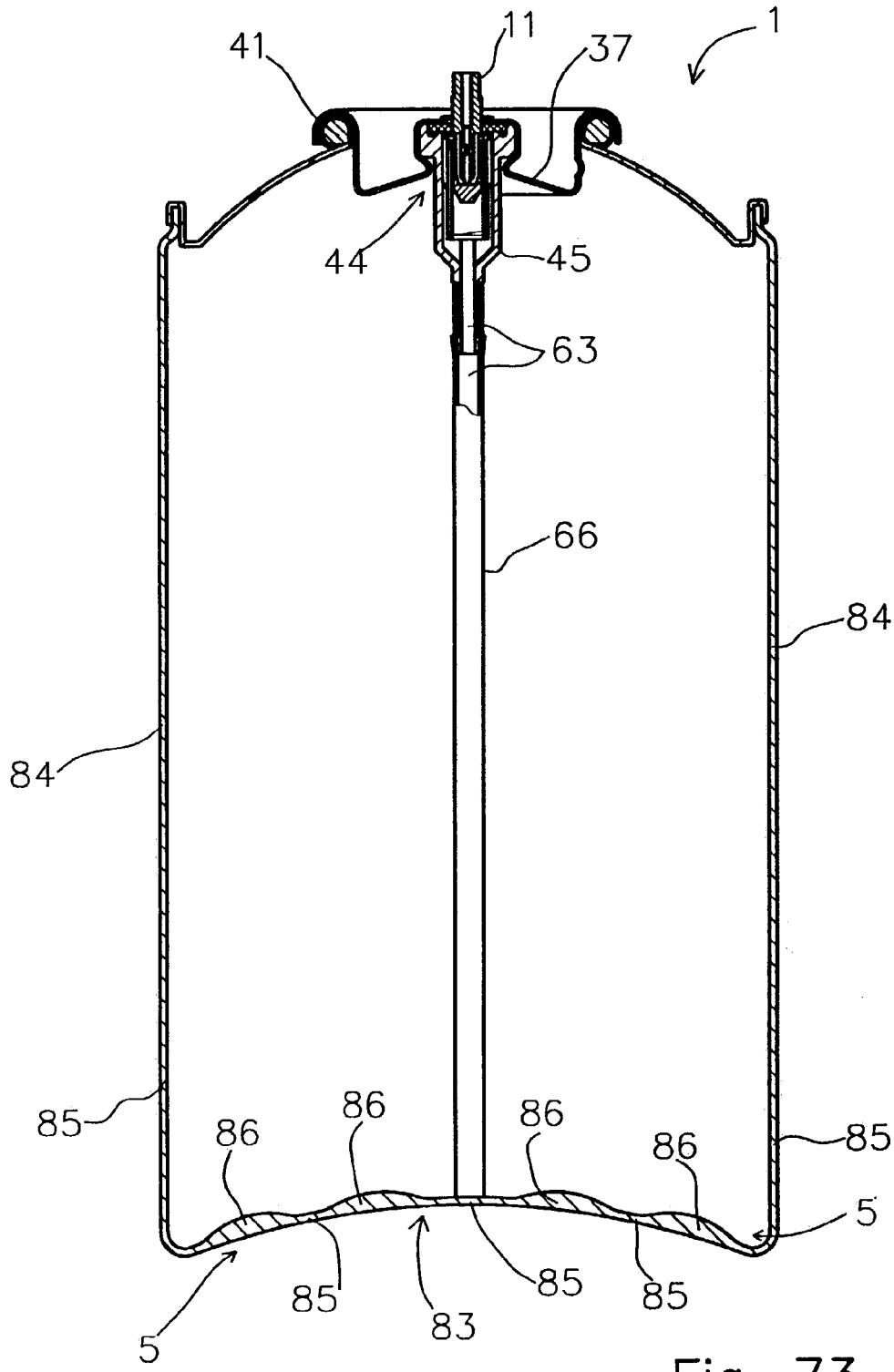
FIG. 73 is a vertical cross-sectional view of an aerosol container, which has an ascending tube leading to a valve, in which the bottom wall of the container has a sound generator due to alternating wall thickness.

In the exemplary embodiment of FIG. 73, the container 1 is an aerosol container 10 whose bottom wall 83 is provided with a sound generator 5 in the form of an alternating wall thickness that is sometimes thicker 86 and sometimes thinner 85. The bottom wall 83 thus produces an altered acoustic pattern when the product is being dispensed. An aerosol dispensing sound that is found to be pleasant can be achieved depending on the intensity difference and the dimensions of the greater wall thickness 86. Alternatively, the side wall 84 can be embodied analogously to the bottom wall 83 or a wall could be embodied in a wave form with a constant wall thickness.

The invention claimed is:

1. A container (1) for a product, said container comprising a discharge device (4) including means for discharging the product through a product dispensing opening (3), said discharge device (4) comprising a nozzle (12) and a spray conduit (10) connected to said nozzle (12), said spray conduit (10) having a continuous inner wall (15);

a valve plate (37) formed with an annular recess;

a valve comprising a valve stem (11);

means for suppressing noise produced by a product discharge when dispensing the product by means of the discharge device; and a cap (7) engaged on a remaining part of said container (1);

in which said discharge device (4) comprises a button (6) provided in said cap (7) so that, when said button (6) is actuated, said spray conduit (10) acts mechanically with said wall (15) on said valve stem (11) to actuate said valve;

in which said means for suppressing said noise produced by said product discharge comprises a valve plate insulation (38) applied to and extending on said valve plate (37); and in which said valve plate insulation (38) comprises a layer of polyurethane foam applied to said valve plate so that said layer of said polyurethane foam fills said annular recess and extends above and over said valve plate from a bottom of said valve plate so as to form a plane surface, said plane surface extends above and over said valve plate, and said polyurethane foam is provided with a plurality of pores and an open-pored structure with a porosity of up to 95% such that said noise produced by said product discharge is minimized.

2. The container as defined in claim 1 wherein said polyurethane foam has open pores with a pore size of about 0.2 mm.

3. The container as defined in claim 1 wherein said layer of said polyurethane foam is provided with an additional sealing layer closing said open-pored structure in order to further reduce said noise.

* * * * *